US012590421B2

(12) United States Patent
Larose

(10) Patent No.: US 12,590,421 B2
(45) Date of Patent: Mar. 31, 2026

(54) GAPLESS RAILWAY DIAMOND: A NEW TYPE OF RAILWAY TRACK COMPONENT PROVIDING UNBROKEN RUNNING SURFACES ACROSS THE FLANGEWAYS OF AN INTERSECTING RAILWAY LINE

(71) Applicant: Paul-André Larose, Oshawa (CA)

(72) Inventor: Paul-André Larose, Oshawa (CA)

( * ) Notice: Subject to any disclaimer, the term of this patent is extended or adjusted under 35 U.S.C. 154(b) by 828 days.

(21) Appl. No.: 17/836,388

(22) Filed: Jun. 9, 2022

(65) Prior Publication Data

US 2023/0002977 A1 Jan. 5, 2023

Related U.S. Application Data

(60) Provisional application No. 63/208,750, filed on Jun. 9, 2021.

(51) Int. Cl.
*E01B 7/14* (2006.01)

(52) U.S. Cl.
CPC ..... *E01B 7/14* (2013.01)

(58) Field of Classification Search
CPC ..... E01B 7/10; E01B 7/12; E01B 7/14; E01B 7/16
See application file for complete search history.

(56) References Cited

FOREIGN PATENT DOCUMENTS

CA 2299198 A1 * 8/2000 ..... B61L 11/04

* cited by examiner

*Primary Examiner* — Robert J McCarry, Jr.
(74) *Attorney, Agent, or Firm* — HEER LAW; Christopher D. Heer

(57) ABSTRACT

Described is a railway diamond that allows two intersecting railway lines to cross each other at-grade without incurring discontinuous miming surfaces, thus avoiding the large dynamic impacts normally occurring in traditional railway diamonds. Modified frogs with piston-mounted load-pads located at critical locations can selectively close the inactive flangeways, thus providing quasi-continuous running surfaces over said flangeways for the active route. Operation of the pistons is performed automatically through an interface with the rail traffic control system and provision is made for continued operation of the diamond in instances of technical anomalies. The operating mechanisms are located below the frogs, with risers providing the required vertical separation between the ties and the frogs. Benefits of embodiments of the invention are reduced maintenance costs, potentially increased line capacity, service life extension for the components and the diamond itself, as well as environmental improvements.

18 Claims, 27 Drawing Sheets

GAPLESS RAILWAY DIAMOND: A NEW TYPE OF RAILWAY TRACK COMPONENT PROVIDING UNBROKEN RUNNING SURFACES ACROSS THE FLANGEWAYS OF AN INTERSECTING RAILWAY LINE

CROSS-REFERENCE TO RELATED APPLICATION

The present application claims the benefit of U.S. Provisional Patent Application No. 63/208,750, filed on Jun. 9, 2021, entitled "The Gapless Railway Diamond: A New Type Of Railway Track Component Providing Unbroken Running Surfaces Across The Flangeways Of An Intersecting Railway Line", the contents of which are hereby incorporated by reference in its entirety.

FIELD OF THE INVENTION

This document addresses a railway track engineering issue. It describes a new type of railway diamond that allows two intersecting railway lines to cross at-grade with minimal discontinuity in their running surfaces, thus greatly reducing the dynamic impacts traditionally associated with railway diamonds. This invention will be particularly beneficial in high-speed and/or high-traffic railway territories, as it will significantly reduce the track maintenance costs and outages, as well as extend the infrastructure service life, including that of the sub-grade. It will also provide environmental benefits in noise and ground-vibration sensitive areas.

BACKGROUND OF THE INVENTION

A railway diamond is a track component that allows two or more converging railway lines cross each other at-grade. Instances where more than two lines intersect in a common overlapping track area are special configurations that are seldom encountered and these require individual considerations. Without any loss in generality, these will not be considered here. In all instances however, there are currently several disadvantages, as reflected in the prior art.

General Overview of Railway Diamonds

A railway diamond can be used either singly or as part of a cluster of individual units, with each one handling a pair of intersecting lines. It can be operated under a variety of permissible speed conditions, both in yards and terminals, as well as in main line environments. A representative dual-dual configuration is illustrated in FIG. 1(*a*).

In all current designs, it consists of four interconnected and rigid rail crossover points, known as railway frogs, and these have an invariant geometry. Consequently, there are no movable components in the diamond itself. There is however an exception in the case of small angle intersections where two of the four frogs may be of the switch-frog type; this will be discussed later and has no bearing on the overall discussion.

Problems Associated with Current Railway Diamonds

Its geometrical invariance makes it notoriously maintenance intensive, as permanent gaps some 2" wide are required across the running surfaces of each frog to allow for intersecting flangeway clearances. As a result, large dynamic loads are generated with the passage of traffic, causing damage to the frogs, the track structure and the sub-grade. This is particularly significant under conditions of near-perpendicular intersection angles, high operating speeds, small wheel diameters, heavy axle loadings and high traffic densities, as illustrated in FIGS. 1(*b*) to 1(*e*).

A railway diamond is thus subject to rapid deterioration and requires a high level of oversight, including frequent inspections, regular refacing of its frogs, internal defect monitoring and sub-grade work to off-set ballast pulverization. This can be at odds with transportation imperatives, particularly in areas where track capacity is limited, and can also adversely affect the productivity of track personnel as a result of delayed or interrupted work blocks.

These operating conditions, along with some unavoidable service disruptions, have significant adverse economic implications.

A railway diamond also has a limited service life, even under optimal operating and maintenance conditions, and must be replaced on a regular basis. This is both an expensive and disruptive process, adding further to the ownership costs, as can be appreciated from FIG. 1(*f*).

In addition, the resulting noise and ground vibrations are an annoyance to neighboring residents and building occupants. Any mitigation attempt through speed restrictions only leads to marginal results while worsening line capacity, fuel consumption, brake wear and transit time.

Problem Specificity

As a result of the invariant geometry of traditional railway diamonds, there are permanent open gaps in the load-bearing surfaces where they intersect the flangeways of the inactive line. These effective breaks in the continuity of the running surfaces lead to significant impact damages from normal operations. These open gaps are the root-cause of the problems that this invention successfully addresses.

As a result of said gaps, the resulting dynamic forces in a traditional diamond can be up to three times that of the static loading, resulting in metallurgical damages to the frogs and sub-grade components and consequently, in large on-going expenses to counteract their degradation.

The damages to the frogs can be either external (superficial) or internal (structural). External damage is either the result of wear or impact and can, if repairable, be remedied by welding techniques and grinding to restore proper profile. This corrective process is known as "refacing the frogs". Internal damage, on the other hand, reflects metal fatigue that is dependent on the number of load-cycles since new. It is not visually detectable and evaluation is done using non-destructive techniques (NDT). This is also used to determine the need for full replacement and this generally occurs well before any of its frogs have reached their repairable wear limit.

In addition to frog surface degradation, there can also be other undesirable consequences such as bolt loosening or breaking, tie abrasion, ballast pulverization, plate cracking, as well as possible rolling stock damages, such as with traction motors.

The damage to the underlying ballast results from its gradual abrasion under cyclical impacts, leading to water entrapment with consequent weakening of the track structure. The problem is compounded because the wear comes from the total traffic carried on both lines and, given the difficult accessibility, maintenance is time-consuming and thus, expensive.

The adverse consequences on railway diamonds were exacerbated by the decision of the rail industry to increase the permissible axle load on railway cars, as a result of the Heavy Axle Load (HAL) project initiated by the Association of American Railroads (AAR). This led in 1992 to the adoption of the increased gross vehicle weight limit of 286,000 lbs. (143 tons) for a 4 axle railway car in interchange service or 35.750 tons per axle. Previously to this date, the accepted standard had been 263,000 lbs. (131.5 tons) per car or 32.875 tons per axle.

Thus, frequent inspections and possibly disruptive maintenance activities are required, including frog "refacing" by welding and grinding. This may also cause track maintenance crews to incur significant non-productive time from continued transportation operations. In addition, periodic work and possibly outages are required to address sub-grade degradation. Ultimately, the complete infrastructure must be replaced when its service limits have been reached.

In addition to technical and economic considerations, a railway diamond generates high levels of noise and ground vibrations. These can be of significant concerns to occupants and owners of nearby buildings, possibly leading to political interventions.

From an operational perspective, any impact mitigation attempt based on speed reduction will unavoidably reduce the capacity of both intersecting lines, as well as that of any other adjacent intersecting line(s), such as found in a cluster. This illustrates the fact that a railway diamond is a shared critical resource.

However, practical speed reductions only have a minimal mitigation effect and this is achieved at the expense of longer block occupancy times, thus reflecting an overall reduction in track capacity.

Typical damage to the frogs is shown in FIGS. 2(*a*) and 2(*b*) and ballast deterioration is illustrated by the water trapping shown in FIG. 2(*c*). Various online videos capture the extent of the problem and show the severity of the impacts that the track structure is subjected to. One particularly good such video was taken at the Marion, OH, railway diamond and is entitled "CSX Q377 kills diamond"; it can be accessed through an internet search engine using the title as the key words. Given that its internet link is not permanent, specific web-link information is not provided here. Eventually, serviceable life limits are reached and a complete replacement is required. This is a major undertaking in terms of capital cost and has an adverse impact on service levels, particularly in instances where multiple lines are affected.

To help illustrate the magnitude of the economic and operational costs associated with such replacement work, a diamond package being pre-fabricated in shop and later awaiting installation in the track is shown in FIGS. 2(*d*) and 2(*e*) respectively. Another major remedial project was the US$115 Million reconstruction at "Tower 55" in Fort Worth, TX, done in 2014 (see "Trains" Magazine, February 2015). Yet another one was the Deval diamond located in Des Plaines, IL, which was replaced in 2017 and for which a time-lapse YouTube video, produced by Union Pacific, dramatically illustrates the extent and coordination of the work that is required in such a replacement process. This video may also be found using any web search engine using the key words "Deval diamond replacement".

Accordingly, it was felt that there was a definite need to address a problem that has long been plaguing the Railways by developing improvements to the prior art.

SUMMARY OF THE INVENTION

In the embodiment of the invention, the large dynamic impacts associated with railway diamonds are essentially eliminated as a result of using specially designed frogs that provide continuous wheel support, irrespective of the line intersection angle encountered in diamonds. These frogs have moveable flangeway gap fillers that consist of load-bearing pistons that are properly positioned prior to a movement being authorized across. This variable geometry produces a continuously level running surface across the diamond and is achieved using either hydraulic or electric motors. This design is particularly beneficial at large intersection angles where the problems in diamonds are most significant.

According to an embodiment, each of the pistons in the flangeways of each frog is inclined some 45° in the vertical plane of the flangeway relative to the frog base along the flangeway center line alignment. This inclination angle is not critical and is subject to specific engineering considerations during subsequent development phases. The basic concept is that the piston in the flangeway located along the intersected inactive route is extended up to the Top of Rail (ToR) elevation, whereas the piston in the flangeway located along the active route is retracted 2 inches below the ToR elevation. This provides closed flangeways along the inactive route for wheel tread support while crossing the inactive flangeways and clear flangeways along the active route for the wheel flanges. This avoids breaks in the load-bearing surfaces and the consequent generation of large dynamic forces. There can be either one or two such pistons on each of the four frogs, depending on system functionality; this is discussed in the section entitled "Single Route Variant".

As a result of this design, a piston in the extended position along the inactive route essentially closes its associated flangeway, thus providing a continuous bridging surface for the active route as it intersects the inactive flangeway. Conversely, a piston in the retracted position along the active route fully opens its associated flangeway, thus providing full clearance for the wheel flanges proceeding along the active route.

Thus, a railway diamond with four such modified frogs provides quasi-continuous running surfaces and consequently, it does not generate large dynamic forces when under traffic.

Operation of a piston is performed from underneath the rail frog structure and from within an actuating device known as a "Piston Actuation Unit" (PAU). This component is designed to be readily serviceable and removable, if need be. In addition, it also provides position sensing and locking. It is located within the piston cradle which itself rests on depressed railway ties. These embodiments can be used with any type of ties used to support railway diamonds, whether wood, concrete or hollow steel.

This effectively transforms a traditional railway diamond from a fixed geometry track component into one having a variable geometry capability and this requires proper route setting configuration prior to each use, given that each of its four modified frogs has a variable geometry. This is the essence of this invention to be known as the "Gapless Railway Diamond".

Risers provide the vertical separation required between the frogs and the ties, thus allowing for the presence of the compact operating mechanisms located under the frogs.

As a result of the increased vertical dimension of the track structure, the bottom of the sub-ties must extend some 10 inches further down into the sub-grade than the ties on the approach trackage. This affects the profile of the sub-grade and has implications in terms of drainage requirements in order to avoid future soil mechanic problems resulting from a permanently wet sub-grade.

The piston axis inclination angle relative to the frog plane extends the operating mechanism along the track length away from the intersection point, facilitating maintenance access and eliminating the possibility of precipitation water from percolating down into the vital mechanism. Because of this inclination, the vertical loading on the pistons is off-axis and lateral stiffeners provide the required structural rigidity.

The actuator always operates under minimal load conditions, as there is no live load present when transitioning from one configuration to another, except possibly for some ice shearing. Hence, it does not require high power levels. It only needs to support a live load after the mechanism locks into position.

Embodiments of the "Gapless Railway Diamond" make it equivalent to traditional railway diamonds in terms of structural strength and railway wheel guidance. As a result of its design, it is also immune from jamming from snow accumulation or wind-blown debris, from ice falling from rolling stock, as well as from acts of vandalism.

In additions, embodiments are such that a track heater is not required to maintain operational capabilities under low temperature conditions, including those that can readily bind to exposed surfaces, such as freezing rain or wet snow precipitations. This was achieved by entirely avoiding compressive external surfaces in the design and using sliding surfaces instead.

According to an embodiment, a thermostatically controlled low wattage electric heater is located in each of the actuating PAU units. This is to prevent condensation and frost in the drive mechanism. In addition, because of said operating mechanisms and the presence of the electrical contacts relating to the indexers, it is imperative to maintain proper drainage conditions in the general area. This will also ensure maximum long-term track stability.

Operation of embodiments of the invention is achieved using commercial power. If this becomes temporarily unavailable, the device can be operated in the "Disabled Mode" using the "Emergency Release Sequence" (ERS) described in the section entitled "The Peripherals", thus maintaining continuity of service.

According to an embodiment, when the diamond is not lined up for traffic, all the pistons are fully retracted within their enclosures. This avoids the accumulation of ice on the extended pistons during freezing rain conditions, as well as allows the lines to remain in service if the active feature is disabled as a result of an extended power outage, subject to a "Slow Order" possibly being issued to train crews in order to mitigate the possibility of damages to the frogs.

The control and monitoring components of embodiments are located in an enclosure in the vicinity of the diamond. These provide links to the vital circuits of the "Rail Traffic Control System" (RTCS) in the signals bungalow, while also controlling and monitoring the actuators and the overall configuration of the system indexers. According to an embodiment, either electric or hydraulic motors can be used to provide power to the pistons. Their relative merits will discussed further down below in the section entitled "The Drive Motors: Electric vs. Hydraulic".

Embodiments are linked to the RTC system in order to provide full automation in the route setting process. In addition, continued operations during technical incidents and maintenance capabilities are provided through a "Wayside Command Panel" (WCP).

In accordance with embodiments of the invention, benefits include the elimination of external and internal damages to the frogs and wheelsets, significant cost reductions in inspection and maintenance, increased service life of track and sub-grade components and improved line capacity resulting from the elimination of mitigating speed restrictions. In addition, there will be reductions in frequency of work blocks and outages, in non-productive time for the maintenance-of-way field forces and in general ground vibrations and noise levels. Finally, this will lead to a cost-effective fabrication of the components and simplify the parts inventory process as a result of the universal design for the PAU that is applicable to all intersection angles.

Other aspects and features according to the present application will become apparent to those ordinarily skilled in the art upon review of the following description of embodiments of the invention in conjunction with the accompanying figures.

BRIEF DESCRIPTION OF THE FIGURES

The principles of the invention may better be understood with reference to the accompanying figures provided by way of illustration of an exemplary embodiment, or embodiments, incorporating principles and aspects of the present invention, and in which:

FIGS. 1(*b*) to 1(*e*) show near-transverse railway diamonds under traffic;

FIG. 1(*f*) shows a traditional railway diamond cluster in a pre-installation staging area;

FIG. 2(*c*) shows significant water trapping and mud accumulation at the top surface of the ballast bed of a railway diamond, indicating a high level of sub-grade impact damage and fouling;

FIG. 2(*d*) shows a new railway diamond package undergoing in-shop fabrication;

FIG. 2(*e*) shows a new railway diamond package awaiting in-field pre-installation;

FIGS. 5(*c*) and 5(*d*) show photo-views for a near-transverse diamond, without piston stiffeners depicted according to an embodiment;

FIG. 6(*b*) shows a near-transverse diamond at top of rail according to an embodiment;

FIG. 7(*b*) shows the top view of risers, with some being removable, in a 30° diamond according to an embodiment;

FIG. 8(*b*) shows the top view of risers, with some being removable, in an 85° diamond according to an embodiment;

FIG. 11(*b*) shows the dimensional relationships of diamond frogs according to an embodiment;

FIG. 11(*c*) shows a top view of the gap closing pistons in a gapless frog rail, according to an embodiment;

FIG. 12(*b*) shows the side view of the gapless frog rail with the piston extended, according to an embodiment;

FIG. 13(*b*) shows the dimensional specifications of the sleeve, according to an embodiment;

FIG. 13(*c*) shows a view of the piston with optional greasing channels and a greasing plug, according to an embodiment;

FIG. 15(*b*) shows a side view of the piston actuation unit's mechanical drive with a long threaded shaft configuration and with the piston in the retracted position, according to an embodiment;

FIG. 15(*c*) shows a top view of the piston actuation unit's mechanical drive with a long thread and with the piston extended, according to an embodiment;

FIG. 16(*b*) shows a piston actuation unit configuration for a large intersection (obtuse) angle at a frog point, according to an embodiment;

FIG. 16(*c*) shows a piston actuation unit configuration for a near-transverse intersection angle at frog point, according to an embodiment;

FIG. 18(*b*) shows a piston actuation unit indexer with the piston in a retracted position, according to an embodiment;

FIG. 19(*b*) shows external position sensors in use on a near-transverse diamond, according to an embodiment.

DETAILED DESCRIPTION OF EMBODIMENTS OF THE INVENTION

Figure 1A:
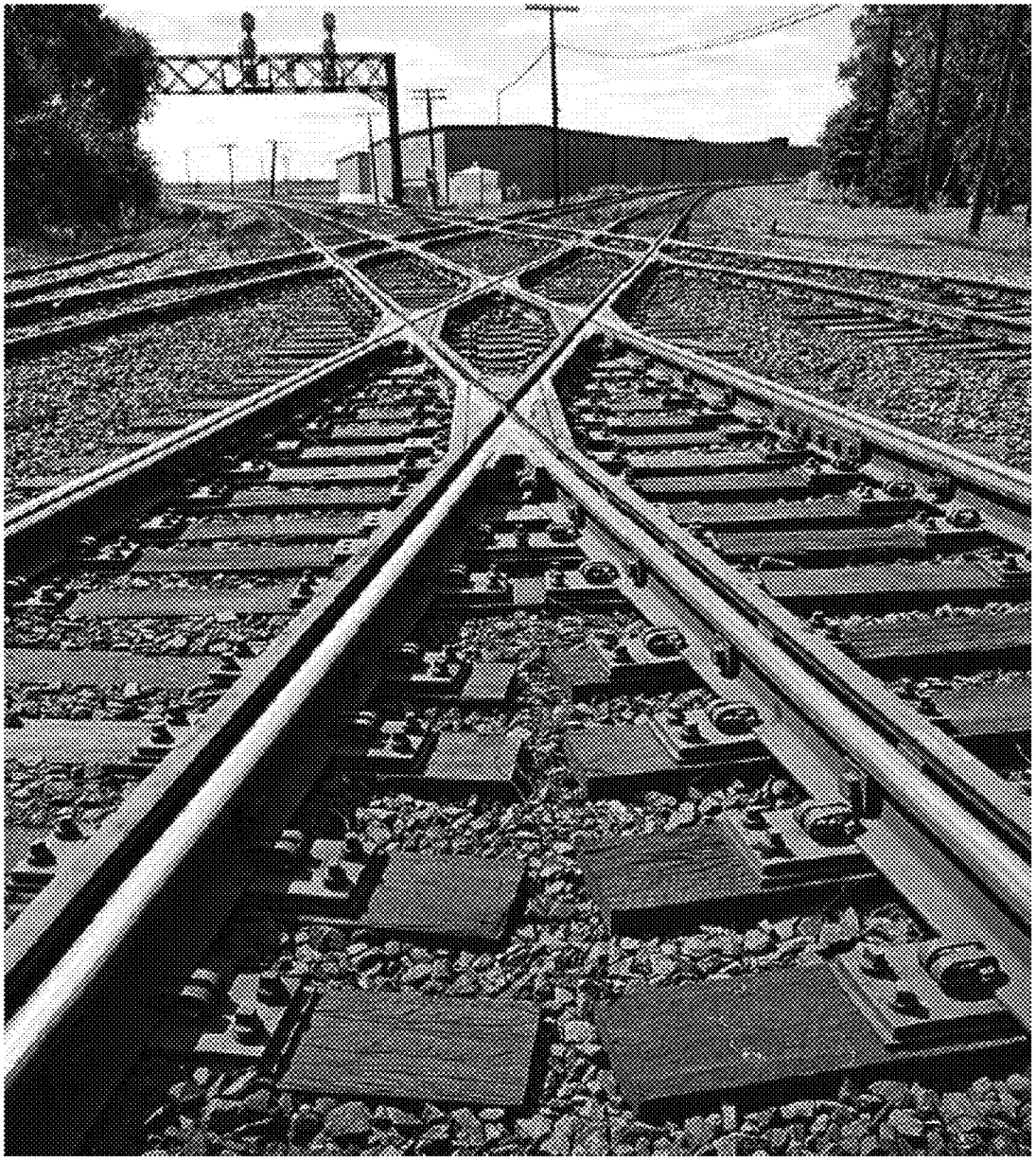
FIG. 1(*a*) shows dual-dual diagonal railway diamonds.
Figure 1B:
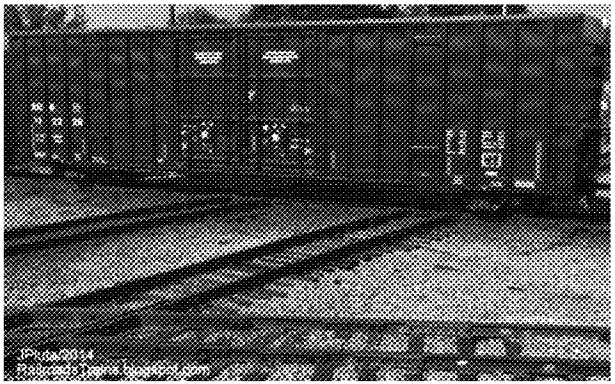
Figure 1C:
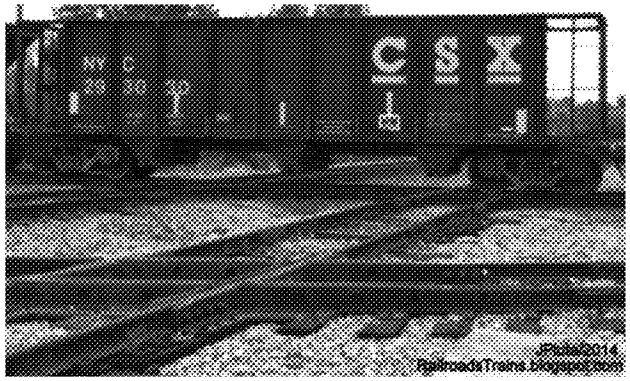
Figure 1D:
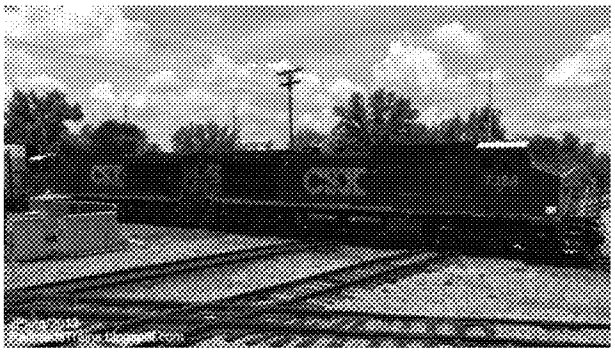
Figure 1E:
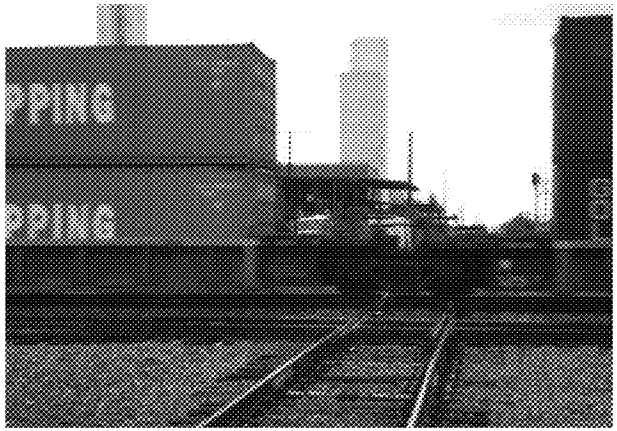
Figure 1F:
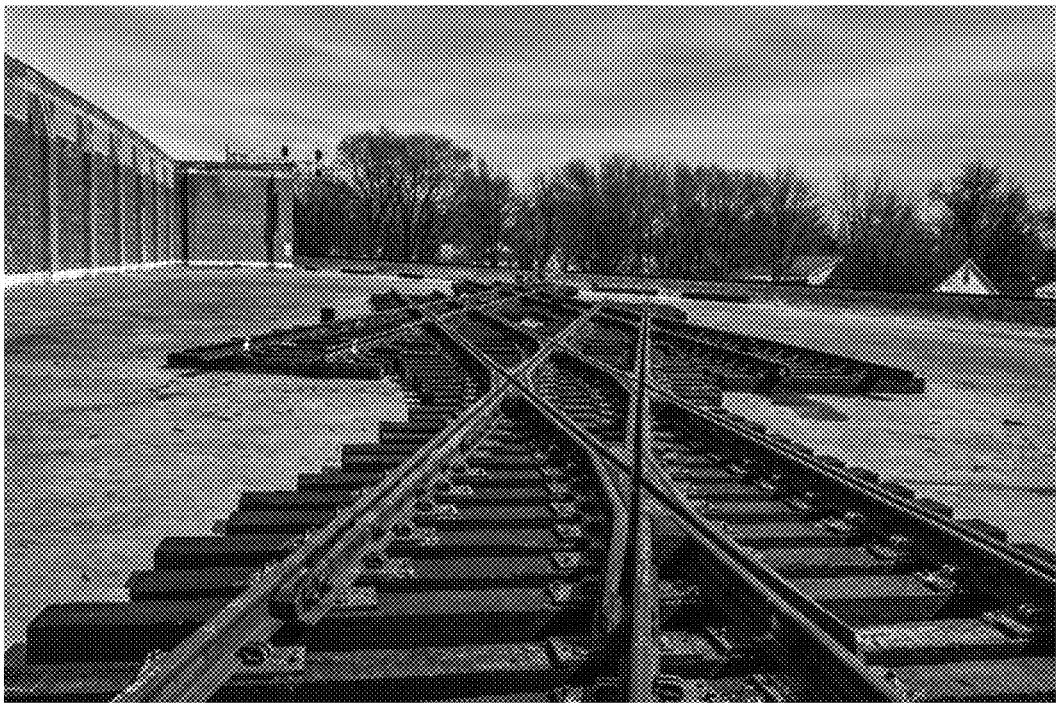
Figure 2A:
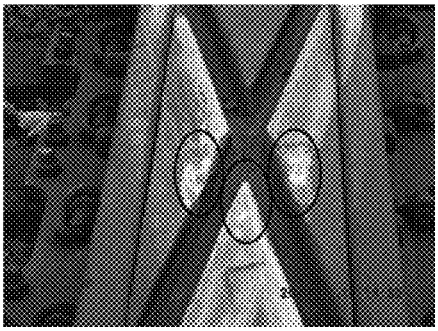
FIGS. 2(*a*) and 2(*b*) show damages to traditional railway diamond frogs.
Figure 2B:
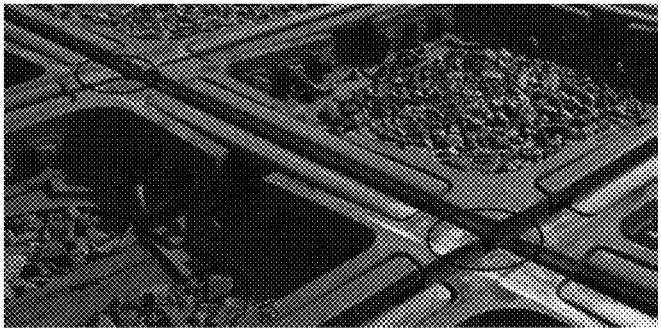
Figure 2C:
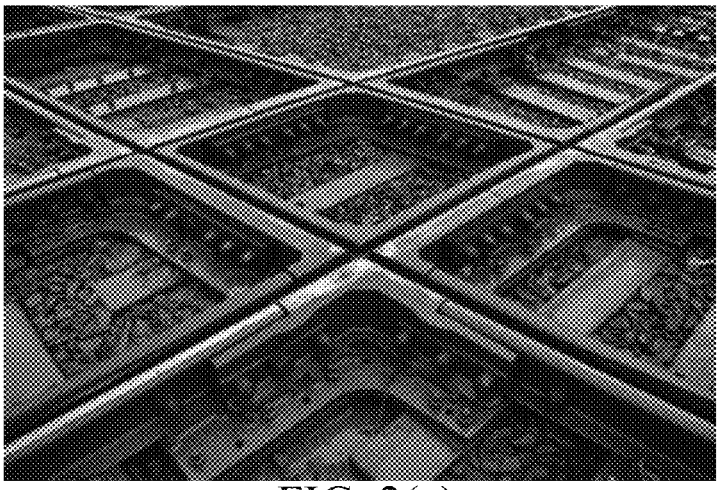
Figure 2D:
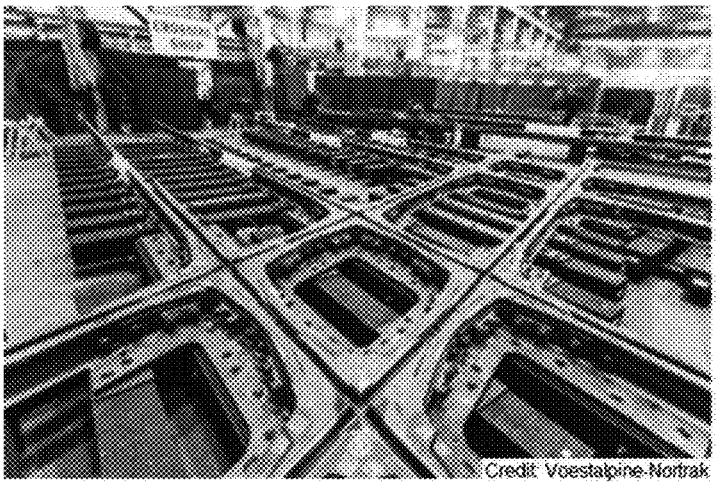
Figure 2E:
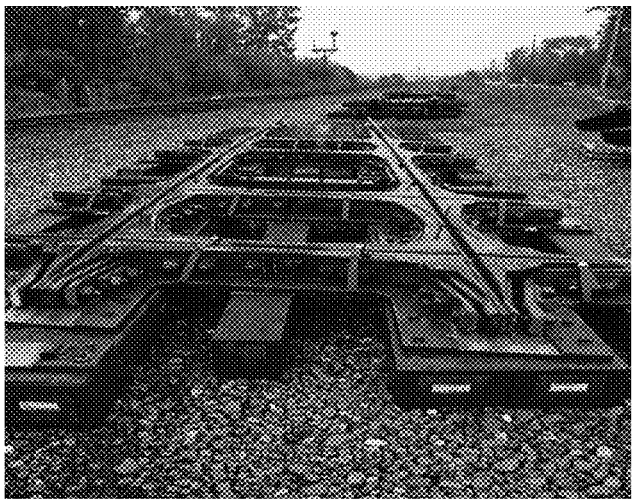

The description that follows and the embodiments described therein serve as either illustrations or examples of particular embodiments of the principles of the present invention. They are provided for the purposes of explanations and are not to be interpreted as limitations of those principles and of the invention. In the description, like parts are marked throughout the specification and the drawings with the same respective reference characters. The drawings are not necessarily to scale and in some instances, proportions may have been exaggerated to clearly illustrate certain features of the invention.

This invention addresses a major shortcoming of current designs of railway diamonds and provides significant advantages in terms of economics, as well as operational and environmental matters. It is based on an innovative design for their constituent railway frogs whereby running surface discontinuities are effectively eliminated. Consequently, the large dynamics impacts associated with traditional railway diamonds are eliminated. This is achieved without compromising on structural or climatic issues. Contrary to traditional fixed geometry diamonds, this is a variable track geometry component that requires power for its operation.

The design of the system is based on the use of railway frogs that have been slightly modified to provide continuity in the running surfaces. This is achieved using strategically located inclined pistons within the flangeways of each of the four railway frogs. Conceptually, the inclination of these pistons has a nominal value of 45° relative to the base plane of said frogs. Future engineering considerations may require variations from this nominal value and consequently, the generic expression "inclination angle", rather than a specific numerical value, has been used throughout when referring to the slant angle of the piston axis relative to the plane of the frog. Any variation in the slant angle does not affect the originality and uniqueness of this invention.

This provides for gap-free running on both intersecting lines and the most general case is referred to as the "Full System". It is also possible, when conditions so dictate, to have what is referred to as a "Half System" where only one of two intersecting lines has the gap-free functionality. This marginally reduces the capital cost requirements and corresponds to situations where one of the two intersecting lines carries a minimal level of traffic; this is later discussed in the section entitled "Single Route Variant". Thus, there are eight (8) pistons in a "Full System" configuration where gapless operation is possible on both intersecting lines and four (4) pistons in a "Half System" configuration where gapless operation is only possible along the high traffic line and the other line carries minimal traffic.

The variable configuration is achieved through the use of a Piston Actuation Unit (PAU) located underneath each of the Pistons. As noted in the section entitled "The Piston Actuation Unit (PAU)", there are various designs that can be considered to achieve the required functionality for this component. Consequently, the PAU configuration that is presented herein is used for illustrative purposes, as it is deemed to be the optimal configuration. As such, this does not limit the scope and extent of this invention and the specific method used to achieve the stated functionality of gapless operations over a railway diamond. This will be further discussed below in the section entitled "Alternative Configuration Management Systems".

Thus, according to the preferred embodiment, this invention provides for quasi-continuous running surfaces in a railway diamond, thereby eliminating the large dynamic impacts occurring at the open gaps of traditional diamonds. This new type of track component is referred to as a "Gapless Railway Diamond". It successfully addresses a problem that has long been plaguing the railway industry and that has become of greater concern in light of mounting economic and operational constraints.

This invention addresses the problem at the source by eliminating its root-cause on all of the four constituent frogs of a railway diamond. This required the development of an innovative variable geometry frog design that provides the full bridging over the intersecting flangeways in the range of intersection angles that is representative of that encountered in railway diamonds. This could not be achieved through variants or adaptations of existing gap closing designs, such as those used on movable point frogs or on switch diamonds, as these are intrinsically limited by geometric considerations to small intersection angles, whereas the problems with diamonds are most significant at near-perpendicular intersection angles.

Given that the geometry of such frogs is variable, the "Gapless Railway Diamond" itself is also a variable geometry track component that must be properly lined up in the route setting procedure prior to use, just like a power turnout. This innovative type of frog is an essential element of this invention and is fully discussed in the section entitled "The Frog". Overall, the design achieves the intended functionality, thus providing improved economic, operational and social benefits along with immunity against climatic factors and vandalism.

The system includes ancillary components located in close proximity to the physical diamond for functions such configuration management and interfaces with the "Rail Traffic Control System" (RTCS). This provides for automatic operations when proper rail traffic control facilities exists at the site. In the normal setting, the design allows the geometry to be altered automatically according to which of the two intersecting routes is carrying the traffic. This provides continuous running surfaces along the active route where it intersects the flangeways of the inactive route, resulting in significant improvements in operating costs from the reduced maintenance requirements and extended component life cycles, as well as in potential line capacity improvements and in tangible environmental benefits. In addition, a "Wayside Command Panel" (WCP) is provided for continued operations under anomalous conditions, although in a perturbed operating mode, through the use of an "Emergency Release Sequence" (ERS). This panel also allows for maintenance functions.

Within each of the four frogs and depending on the extent of functionality (e.g. "Full System" or "Half System"), there can be either one or two set(s) of load-bearing pistons, along with their associated load pads. These are located within the flangeway adjacent to the frog point of the intersecting lines. The load pads can be extended up to the Top of Rail (ToR) elevation, so as to close the intersected flangeways gaps. Consequently, this effectively provides a bridge over the area where there would otherwise be a continuity break in the running surface where it crosses the intersected flangeway. Instead, there is an unbroken and continuous running surface across said intersected flangeway. Other embodiments have examined the effects of the type, location and piston inclination in variants of this gap-closing design.

In the embodiment, each of the four frogs is supported by a set of risers and has, at strategic locations for each flangeway to be bridged, one piston, along with its related peripheral components, so as to provide the running surface intersecting said flangeway with gap-free functionality. Such components consist, amongst others, of a dedicated drive mechanism, a power source, a position indexer and a locking system, as well as a load-bearing cradle and an interface with the RTC system. The cradle provides reproducible positioning of the actuator following removal for maintenance purposes, in addition to a load-bearing function that complements that of the risers. This arrangement gives each frog and hence, the diamond itself, a variable geometry capability, resulting in constant level for the running surfaces where they intersect the inactive flangeways. As there is only a very minimal physical gap across the intersecting flangeway, this design practically eliminates the dynamic impacts where two railway lines cross at-grade and hence, reduces the maintenance costs of diamonds, while also effectively addressing the environmental concerns of nearby residents and building occupants.

According to the embodiment, the actuator can be either electrically or hydraulically powered. Hydraulic power has definite advantages, particularly in light of its compactness and immunity to adverse environment factors. It can consist of either hydraulic motors or hydraulic pistons and both of these make possible a design where the PAU has minimal dimensional requirements. In the case of hydraulic motors, this allows direct mounting of the hydraulic motor on the individual PAU's. This corresponds to one PAU for each hydraulic motor. Alternatively, the option of using electric motors was examined and this required a sharing of the loads from the PAU's on no more than two such motors, given the dimensional requirements for their enclosures. Consequently, there is in this case the additional need for flexible drive shafts and load splitters at the various PAU's and there are eight of these for a "Full System" configuration. As the piston operating mechanism is partly located underneath each of the four frogs, the embodiment comprises a riser arrangement that provides the required vertical clearance, as well as access capabilities for the inspection and maintenance of the operating mechanism. Each piston is inclined in the vertical plane relative to the frog plane by an inclination of some 45°, with embodiment for a side stiffener in order to increase its structural rating for off-axis loads. The minimum rating for an extended piston is 27 tons for a nominal 45° off-axis load.

According to an embodiment, the piston indexing function is accomplished using a indexing rod that is anchored to the top of the piston load pad and runs parallel to its shaft. Hence, it moves in unison with the piston and the position of its lower end, which is located below the frog, activates the indexing system in a way that truly reflects the position of the top end of the piston. This can be supplemented by a side-mounted indexing system located on the side of the frogs and that independently measures the position of the piston. This provides redundancy to the piston indexing function, as it is considered as a "Vital System" and reflects the safety philosophy of the RTC system that recognizes that, in any engineered system, eventual component failure is inevitable, irrespective of the individual component reliability factor. Consequently, the design must be such that the system automatically reverts to a more restrictive configuration when partial or total system failure occurs. In addition, when a variable geometry component is involved, the system configuration can only be reliably ascertained if it is determined from the direct measurement of the movable component itself.

The piston position locking function consists of disabling the rotational power through a fail-safe clutch arrangement or other means where the rotational power is physically isolated, or disengaged, from the mechanical drive shaft which itself is held locked, also in a fail-safe mode. An optional third safety feature consists in disabling the power feed to the motor, either electrical or hydraulic, supplying mechanical rotational power to what is referred to as a "Piston Actuation Unit" (PAU).

The system is protected against adverse climatic conditions, including freezing precipitations and cold weather operations. In particular, it has side grooves that account for the risks associated with freezing rain by providing areas of sliding contact interspersed with areas of non-contact. Embodiments may further comprise one or more drainage channel(s) positioned under the piston. Such channel(s) will be protected against becoming obstructed by freezing run-off through the thermal release from a low-power heater located below in the PAU. Embodiments may also comprise a "Configuration Management Module", located close to or on the piston actuator, whose function is largely to provide proper indexing and control interface to the actuator and feedback to the control unit.

According to the selected embodiment, the PAU itself is located within a fixed PAU cradle that complements the load-bearing function of the risers, while also providing lateral load restraints, a protective enclosure for the mechanism and facilitate PAU realignment when maintenance work requires its removal.

Current Technical and Operational Mitigation Measures

The problems currently associated with traditional railway diamonds are often mitigated by adopting speed reduction policies in their vicinity, thus marginally lowering the severity of the impact forces that the frogs are subjected to. However, this has an adverse impact on line capacity and may not always be desirable to do so, based on commercial or operating considerations.

A railway diamond is a shared critical resource and, consequently, it should be occupied for the least amount of time possible in order to achieve overall system optimization and, as a result, the highest permissible speed should be used.

The damage mitigation method based on speed reduction run contrary to this optimization philosophy, as this effectively prolongs the use of a scarce resource and hence, reduces line capacity. This is particularly important when traffic density in any of the lines is approaching the ultimate practical capacity of the physical plant, also known as its saturation level.

Therefore, current mitigation measures, such as speed reductions, are the very opposite of what should be done in order to maximize line capacity, as they invariably lead to increases in the diamond occupancy times and hence, to reductions in the available plant capacity. This is particularly critical when traffic levels are approaching the saturation point.

However, operating without reducing the permissible speed over a diamond will invariably result in large dynamic loading effects on the track infrastructure as wheels cross over the intersecting flangeways. The severity of this loading is particularly significant in instances of high axle loads, high speeds, small wheel diameters and near-perpendicular line intersections.

In short, current mitigation methods lead to the unavoidable consequences of longer occupancy time for a critical resource such as a railway diamond and its approach control blocks without significantly reducing the damages to frogs. This is in addition to minimal reductions in terms of maintenance requirements.

In an attempt to address the economic aspects of the issue, the industry has developed, in recent decades, two ways to reduce the extent of the dynamic impacts. Both of these are based on the concept of flange running whereby the loads from the wheels are transferred, in whole or in parts, from the treads to the flanges as movements proceed over the diamond, thus preventing drops into the intersected flangeways.

These methods have led to the recent development of specific types of track components in an attempt to address the very problems of frog damage. These are the One Way Low Speed (OWLS) diamond, the Full Flange Bearing (FFB) diamond and the Wheel Climbing frog. Each of these have very restrictive operating constraints, such as for trains carrying revenue passengers and, consequently, none of them can be considered as a solution to the problems that this invention is addressing.

The OWLS diamond is a railway diamond where the running surfaces for the high-traffic line are continuous (i.e. unbroken by flangeway gaps). On the intersecting low-traffic line, movements must transition from tread running to flange running in order to go over the unbroken high-traffic line while crossing the diamond. Speed is restricted to 10 MPH on the low-traffic side, as this is considered to be a Class 1 track, whereas it is unrestricted on the high-traffic line. Similarly, the FFB diamond is a railway diamond where the wheels of traffic on both intersecting lines are gradually raised from the railhead to achieve flange running in both instances. This avoids the wheel drops into the open flangeways, thus eliminating the dynamic impacts. Generally, both lines are considered as Class 1 and speed is restricted while going over such a diamond. In certain cases however, the USA Federal Railroad Administration (FRA) has issued special waivers where higher speeds are permissible.

In addition to this and as part of a patent literature search (discussed elsewhere in the section on "Patent History"), a total of 15 patents relating to the design of a vibration-free diamond for street railways was identified. None of these were deemed to be practical solutions in the heavy rail environment.

Public and Political Considerations

In certain situations, there are non-operational issues such as noise and ground vibrations that are irritating to the general public residing or working in close proximity to a railway diamond. These grievances may at times even escalate to the political level. One such example can be found in the Toronto (Canada) area where there have been strong political pressures to resolve the issue.

The invention described herein now provides a solution to this problem. In fact, it is well suited to be applied on a priority basis at this location as part of the initial demonstration and testing project, as there is already political agreement that something must be done in this sensitive area where mitigation methods are inadequate and alternatives, such as OWLS or FFB diamonds, are not suitable.

There are other similar situations across North America where such a problem exists as a result of main line traffic generating public nuisances, even in instances of minimal traffic levels on the secondary line being intersected. In such cases, gaps are nonetheless required on the high traffic primary line, even though they are only required for the infrequent traffic on the secondary line. Consequently, this results in significant continued maintenance costs and nuisance factors, irrespective of the fact that the secondary line traffic is minimal.

When conditions permit, a variant of the "Full System" configuration where only the high traffic line has the gap closing feature could well provide a cost effective alternative, with none of the mandated restrictions being required. This will be further discussed below under the section entitled "Single Route Variant".

Thus, and irrespective of traffic levels, this invention will provide a full resolution of this issue, in addition to numerous operating and maintenance benefits resulting from the elimination of gaps in the running surfaces.

In addition, it can address social and public relations concerns in instances where capital spending may not be warranted solely on the basis of traffic or economic considerations.

General Engineering Considerations

This section briefly details the engineering of railway diamonds and matters closely related to embodiments of the invention described in this report.

Types and Metallurgy of Railway Diamonds

The frogs are the essential elements of the diamond and they have running surfaces that are convergent with each other, effectively intersecting at a theoretical point known as the "Frog Point".

In general, two of these have an acute intersection angle and the other two have an obtuse intersection angle. Only in the exceptional case of a strictly perpendicular line intersection are these four running surfaces all at 90° to each other. In practice however, intersection angles ranging between 75° to 105° can be considered as perpendicular for track engineering purposes.

The frogs used are of the various types generally found in the North American track environment. Their metallurgy and fabrication are such that they have a high metallurgical hardness index in order to avoid rapid deterioration due to the dynamic impact effects as traffic goes over the open gaps of the intersecting flangeways.

Generally, they consist of manganese-steel alloys containing from 12% to 15% manganese. In addition, these may be further subjected to explosive hardening.

Without getting into the specifics of frog engineering, it should be pointed out that the commonly used types of frogs are the rail-bound manganese-steel core design (known as RBM frogs), the solid manganese rail frog design, the reversible manganese insert rail frog design and the lap beam design.

According to various embodiments, the concepts herein pertaining to gapless operation are applicable to all of these types of frogs and consequently, all of them can be used with the proposed invention.

Diamonds of the three-rail crossing design were once widely used and are now a legacy component still found in low traffic and industrial environments. However, they are not suitable for this invention and will not be further considered.

Effects of the Intersection Angle

A turnout is a track assembly, with either a fixed or movable point frog, that allows movement from one track to another. In a turnout, the frog angle is comparatively shallow and wheel support is provided by the extended width of the wheel tread during passage over the intersecting flangeway gaps.

In a diamond however, this is geometrically not the case and lateral wheel support cannot be provided at large intersection angles, particularly with near-perpendicular crossings were the dynamic impact problems are most significant. Specifically, the extent of the lateral support decreases to zero as the line intersection angle approaches 90°, with the worst case being for a 90° intersection. Such an extreme case effectively corresponds to a break-of-rail discontinuity that is some 2 inches long in each of the running surfaces.

Consequently, the most adverse configuration in a railway diamond corresponds to near-transverse (or near-perpendicular) intersections where the passing wheels have little or no lateral load bearing support as they cross over the intersecting flangeways.

This effective discontinuity in the running surface results in large dynamic forces, with consequent structural damages, noise and ground vibrations being generated with the passage of each wheelset and hence, significant maintenance costs. The magnitude of these forces is related to the axle loading, the wheel size and the speeds of the movements.

This is a problem that embodiments of this invention, known as the "Gapless Railway Diamond", will alleviate with the effective closing of the gaps at the intersecting flangeways in the full angular range of interest up to, and including, 90°. In addition, maintenance costs will be reduced, while the service life of diamonds will be significantly extended.

Critical Resources and Line Capacity

A critical resource is one whose capacity limits that of the rest of the line or related lines, such as a slow order (permanent or temporary), gauntlet tracks, bridge speed restrictions, draw-bridges, interlockings and railway diamonds, among others. A critical resource can be either shared or not; it effectively sets an upper limit on the overall maximum utilization that can be expected of a resource, such as the possible throughput of a railway line.

A railway diamond is a critical resource whose occupancy, and that of its approach blocks, should be expedited, so as not to adversely affect its throughput capacity of both of the intersecting lines and thus, that of the rest of the system, particularly any of its intersecting lines. Consequently, it should be crossed at the maximum track speed that is consistent with safety in the area in order to minimize its occupancy time.

If, in order to mitigate damages to the diamond, the permissible speed is lowered, then the occupancy time of the diamond, and that of its approach blocks, is correspondingly increased and the consequent failure to expedite the use of a critical resource results in a reduced line throughput. This is effectively a Permanent Slow Order (PSO) and, for long freight trains, this results in a significantly increased approach and diamond block occupancy times. This, in turns, leads to an effective reduction in the throughput capacity of both the line itself and the one, or any other(s), intersecting with it, thus resulting in longer track unavailability and interference time for conflicting traffic. An increase in crew and equipment cycling time (particularly in repetitive rail commuter operations) will then occur, leading to decreased productivity and competitiveness levels through correspondingly increased transit times. In addition, there may be additional operating expenses in the form of brake wear and increased fuel consumption when approach deceleration and subsequent re-acceleration are required.

In terms of track capacity considerations, this is the very opposite of what should be done. Since it is a "critical" resource, a railway diamond should be used at the maximum allowable track speed in order to minimize joint occupancy times and hence, maximize line capacity.

However, when line capacity is not a limiting factor (i.e. for low traffic levels), damage mitigation measures, such as speed restrictions, are often adopted, although these have adverse implications in terms of fuel consumption, transit time and brake wear.

When, on the other hand, capacity or commercial imperatives do not allow such mitigation, the result is a higher level of mechanical abuse and hence, higher operating costs as a result of the increased maintenance requirements.

Thus, the "Gapless Railway Diamond" will provide substantial tangible benefits from the technical, operational and economic perspectives, as well as from the intangible considerations associated with reduced ground vibration and noise levels.

The Grade Separation Option

One option that completely eliminates the needs for diamonds is to vertically separate the intersecting lines. This leads to what is known as a "fly-over/fly-under" or a "overpass/underpass".

This has at times been used, often at the expense of potential connectivity, particularly when lines of different railway companies cross each other.

However, this is an extremely expensive solution, both in terms of capital and land use, particularly if there are inter-connections to be made between the intersecting lines.

This requires large vertical clearances, particularly on electrified freight lines, and can also have implications in terms of dimensional loads and drainage. Moreover, significant grade variations can lead to track-train dynamics problems with long freight trains.

From a track capacity perspective, a grade separation rather than an at-grade intersection could only be justified on the basis of very high traffic densities, characterized by close headways and maximum occupancy of short traffic control blocks on either of the two intersecting lines.

Fortunately, current traffic densities are generally such that such extreme measures are seldom required.

Consequently, at-grade intersections are well within the effective line capacity requirements of most North American railways, so long as traffic movements are promptly expedited across diamonds as a result of having proper traffic management practices.

This invention, referred to as the "Gapless Railway Diamond", has the potential to improve the economics and operations of the Railways.

Analytical Development Process

The process of devising and creating this invention was performed in a holistic manner addressing a vast range of related issues. These included the development of extensive functional specifications, investigation of possible adaptations and modifications to track components and review of pertinent prior art and research. Also required was the evaluation of various designs, identification of a preferable method, preliminary designs for the operating mechanism and addressing the matter of the "Rail Traffic Control System" (RTCS) interface components. This latter aspect is essential to achieve safe operation in a high-density traffic environment by ensuring proper route protection. This had to include full component indexing and locking.

Figure 3A:
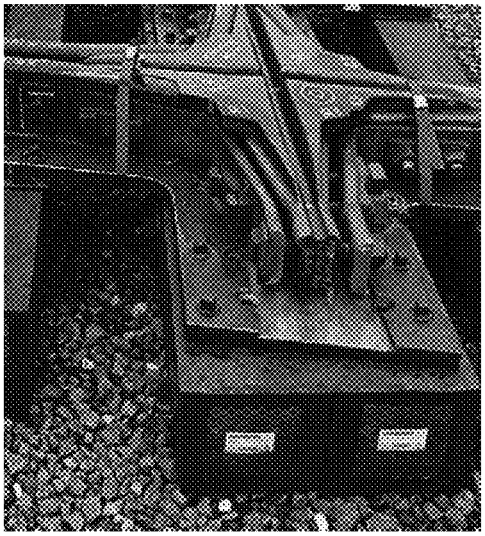
FIGS. 3(*a*) and 3(*b*) show railway frogs for near-transverse and shallow angle intersections.
Figure 3B:
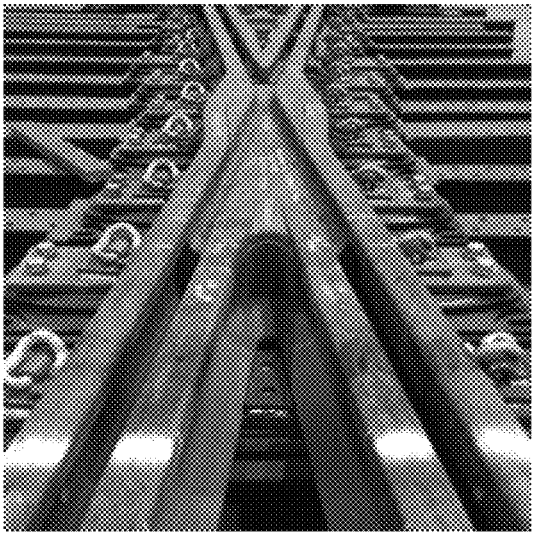

Frogs can be of different types and, consequently, the design had to be suitable for all of these types. Namely, frog types include the rail-bound type, the manganese-steel type, the reversible insert type and the lap-beam type. FIGS. 3(*a*) and 3(*b*) illustrate two of the most common types used in different intersections, as well as the corresponding tie arrangements for each of these.

The design had to be structurally sound, immune from climatic effects and from jamming, as well as not being dependent on the use of the equivalent of switch heater systems.

The design also had to be such that the invention can be used in a wide range of line intersection angles and ideally, its components, except for the frogs, should be fully interchangeable, so as to best manage the fabrication costs and that of spare part inventories.

As such, the invention and its embodiments should address several important issues, including: reducing the requirements for track inspection and maintenance, both light and heavy; eliminating the external and internal damages to the frogs and the on-going needs to regularly re-face the frogs through field-welding; reducing the deterioration and abrasion of ties and related track hardware; and reducing the fouling of the ballast as a result of its accelerated pulverization in an area that is particularly difficult, time-consuming and expensive to under-cut.

Furthermore, the invention and its embodiments should improve line capacity through decreased diamond control block occupancy times on all intersecting lines, as well as improve fuel consumption and reduce braking equipment wear where speed restrictions are used as a mitigating procedure. The invention and its embodiments should also extend the service life of plant components, including that of its underlying ballast, thus reducing the frequency of line outages and associated costs. Lastly, the invention and its embodiments should eliminate possible electromechanical problems with the rolling stock traction motors, reduce area noise and ground vibration levels and eliminate possible damages within wheels, axles, bearings and track components that could eventually lead to further negative outcomes if not corrected.

These benefits should be achieved in a manner that is both cost effective and immune to environmental factors by addressing at the source and without compromising on reliability the direct cause of the noise and vibration issues associated with traditional diamonds.

Although beneficial to all types of rail intersections, the system should be particularly suitable for near-perpendicular intersections, i.e. in the range of 60° to 120°, as these are the most adversely affected by the traditional designs and that will most benefit from this invention.

In addition, the invention and its embodiments should significantly extend the useful life of such diamonds, including that of the ballast, while eliminating the possibility of damage to the rolling stock and the public nuisance factors.

This system should be operated automatically through the "Rail Traffic Control System" (RTCS) or, under exceptional circumstances, through the use of a "Wayside Command Panel". The automatic operation is through an interface with the RTCS, while the degraded operation requires a radio clearance to the train crew from the RTCS dispatcher. Such a clearance allows it to use the "Wayside Command Panel" to go into the "Released Mode" and for its train to proceed, possibly with some restrictions, past the home signal displaying a "Stop" indication. More details on this are provided in the section entitled "The Peripherals".

Developing a Solution

Design Objectives

The objective of this invention is to design a railway diamond where there are effectively no gaps or discontinuities along the running surfaces where they cross the flangeways of the intersecting line. The very existence of gaps is the root cause of the various technical, operating, economic and environmental problems associated with traditional diamonds.

This required the development of a new type of frog where gap closure can be achieved over a wide range of intersection angles, contrary to current designs, such as in moveable point frogs, where the gap closure can only be achieved at very small intersection angles. In particular, such a frog would have to be suitable for near-perpendicular intersection angles, as this is the configuration that is most problematic in railway diamonds. This requires a variable configuration capability on each of the four constituent frogs, thus making the diamond an active track component. As indicated earlier in this section, this can only be achieved using a set of four uniquely designed frogs that were specifically designed for this invention. These provide fully continuous and unbroken running surfaces across the diamond, irrespective of the route intersection angle, and do so without any possibility of jamming. This critical component is more fully discussed below in the section entitled "The Frog".

Such a device must meet all applicable track engineering and reliability standards without compromising current operating safety levels. In particular, its structural strength and physical properties must be comparable to those now available with current designs.

Moreover, embodiments must avoid the needs for customized designs, irrespective of the line intersection angles, and allow for component standardization in order to minimize the logistic costs of fabrication and spare part management.

Embodiments must allow for rapid configuration changes during configuration for a specific routing, ideally in a time frame that is comparable to that of a power turnout.

Embodiments must also provide for full reliability under hostile railway operating and environmental conditions, as well as against vandalism. Designs that could possibly lead to jamming were avoided, given the need for unattended operations in remote locations under all climatic conditions.

Ease of access for inspection and maintenance is a prime concern in order to maximize reliability, as the sub-grade area is notoriously difficult to access, particularly in congested areas where there is adjacent trackage in close proximity.

Finally, a significant benefit of this undertaking is the elimination of noises and ground vibrations normally generated by traditional diamonds, as this would result in improved public relations with respect to the railways. This is especially true in certain sensitive areas, such as adjacent to residential communities or businesses.

All of these deliverables are achieved by embodiments of this invention, known as the "Gapless Railway Diamond".

Like for any active track component, embodiments must allow for proper route configuration as part of the route setting procedure. Accordingly and under normal operating conditions, this is done automatically as part of the pre-clearance process performed by the route setting algorithm. Provision is also made for continued operations in instances of possible technical incidents.

Consequently, in signaled territories, an interface will be required with the "Rail Traffic Control System" (RTCS), such that the proper configuration is automatically set-up and monitored as part of the route setting procedure and in accordance with the intrinsic safety philosophy of the RTC system.

Requirements and Specifications

Various aspects of the invention were considered, including design, mechanical, operational, maintenance, environmental and financial aspects.

Of particular concern was the all-weather reliability factor, especially with respect to freezing rain and snow precipitations. The design must prevent the effects of ice build-up on critical components while completely avoiding compressive contact areas. This climatic immunity had to be achievable without depending on power-hungry and sub-grade fouling heaters, such as those known as "switch heaters".

In addition to being resilient against adverse environmental conditions, the design of embodiments had to be immune from interference by debris or vandalism.

Structural considerations however had to be of prime importance and as a result, some configurations that met strictly geometrical requirements were rejected because these resulted in a structural weakening.

An "Emergency Release Sequence" (ERS) was deemed essential to allow the "Gapless Railway Diamond" to operate in a degraded way in order to allow operations to continue in instances of a technical failure or power outage. According to an embodiment, the ERS uses variants of existing operating rules applicable to dual-control power turnouts by allowing field crews to initiate transfer from the "Automatic Mode" to the "Disabled Mode" under abnormal conditions, after receiving proper clearance from the "Rail Traffic Control System" (RTCS) operator.

Embodiments also permit operation in a "Disabled Mode", allowing it to revert to a standard passive railway diamond in instances of technical anomalies. In addition, it also had to provide a "Maintenance Mode" to facilitate the maintenance process.

These various operating modes are discussed elsewhere in the section on the "Wayside Command Panel". In meeting these requirements, the invention and its embodiments outlined herein satisfy all "Essential" and "Desirable" requirements outlined in Table 1 below.

TABLE 01

Design Requirements and Specifications

| Categor | # | Att. | ===>Attributes Deemed as Essential (E) or Desirable (D) |
|---|---|---|---|
| General Design | 1 | E | Maximum gap of 1/4" in the running surface |
| | 2 | E | Jam immunity from climatic conditions and foreign objects |
| | 3 | E | No compressive contact areas |
| | 4 | E | No speed restriction (PSO) on either intersecting routes |
| | 5 | E | Interfaceable with Signal and Rail Traffic Control Systems |
| | 6 | E | Full vehicle guidance and guard rail functions |
| | 7 | E | Consistent with AREMA design standards and requirements |
| | 8 | D | Applicable to various types of Diamond Frogs |
| | 9 | D | Suitable for Frog intersection angles ranging from 30° to 150° |
| | 10 | D | Similar components for all Diamond intersection angles |
| | 11 | D | Minimal modifications on the Frog design and manufacturing |
| | 12 | D | No adverse implications on track engineering and maintenance |
| | 13 | D | Design applicable to curved track Diamonds |
| | 14 | D | Possibility to temporarily revert to traditional inactive Diamonds |
| | 15 | D | Suitable for installation on highest-traffic route only |
| Mechanical | 1 | E | Full structural strength of the track structure |
| | 2 | E | Suitable for Heavy Axle Loading (HAL) requirements |
| | 3 | D | Minimal structural and running surface modifications |
| | 4 | E | Wheel thread bearing with no radial load on wheel flanges |
| | 5 | E | Immunity against damage by dragging equipment |
| | 6 | D | Minimal components in the exposed mid-track area |
| | 7 | D | Positive locking from lateral wheel forces, if applicable |
| | 8 | D | Mechanical securing induced by vertical load, if applicable |
| | 9 | D | Simple mechanical linkages and activation mechanisms |
| | 10 | E | Ruggedness and reliability, with minimal component complexity |
| | 11 | E | All critical components above properly drained areas |
| | 12 | E | Unaffected by traction, braking or temperature stresses |

TABLE 01-continued

| Design Requirements and Specifications | | | |
|---|---|---|---|
| Categor | # | Att. | ===>Attributes Deemed as Essential (E) or Desirable (D) |
| Operational | 1 | E | Suitable for either manual and automatic operations |
| | 2 | D | Route set-up cycle of no more than one (1) minute |
| | 3 | E | Immunity to track sanding |
| | 4 | E | No diamond-specific speed restriction |
| | 5 | D | Reduces extent and frequency of line outages |
| Maintenance | 1 | E | Reduction in inspection and maintenance requirements |
| | 2 | D | Ease of component accessibility and maintainability |
| | 3 | D | Use of field-replaceable sacrificial components |
| | 4 | D | Reduction in field welding and grinding requirements |
| | 5 | D | Minimal interference with ties and ballast maintenance |
| | 6 | D | Reduced wear to the sub-grade and improved accessibility |
| Environmental | 1 | E | Reduction in noise and ground vibration levels |
| | 2 | E | Resistance against vandalism |
| | 3 | E | Immunity against snow, freezing rain and/or ice build-up |
| | 4 | E | Immunity against shifting ballast and wind-blown debris |
| | 5 | E | Immunity against water entrapment and frost action |
| | 6 | D | Avoidance of need for track component heaters |
| Financial | 1 | D | Cost-effective in procurement, installation and maintenance |
| | 2 | D | Marginal cost no higher to that for a powered two-way cross-over |
| | 3 | E | Improved asset utilization |
| | 4 | E | Reduced operating costs for Operations and Engineering |
| Overall | 1 | D | Increased line capacity |
| | 2 | D | Increased Diamond service life |
| | 3 | E | Reduced operating costs |
| | 4 | D | Reduced over-the-road time and crew/equipment cycling times |
| | 5 | D | Reduced fuel consumption and brake wear |
| | 6 | D | Reduced track down-time and maintenance |
| | 7 | D | Reduced wheel, bearings and traction motors maintenance |
| | 8 | D | Reduced ballast and sub-grade degradation |
| | 9 | D | Reduced environmental impact and improved public perception |

Possible Adaptations and Modifications

Certain track components were examined to determine the feasibility of modifying them to achieve the stated objectives. Two such configurations were deemed to have such a potential.

One of these is the "movable point frog", also known as a "swing-nose frog", and the second one is a particular type of diamond known as a "switch diamond", where movable closure rails are used to reduce by half the number of frogs required and hence, the number of gaps encountered along the running surfaces.

Each of these has a variable geometry and generally has its own power machine to operate the movable components.

In both instances however, there are compressive surfaces in the design and these make them highly vulnerable to snow and freezing rain conditions. In light of the climatic reliability criteria outlined in the section on "Requirements and Specifications" above and in Table 1, this limitation would have to be satisfactorily addressed if they were to be retained as the basis for further work towards the functional objectives. This however would require the use of thermal equipment, contrary to the design objectives (Table 1), and thus would result in increased economic and environmental costs.

It was however conclusively demonstrated that neither of these two existing designs could be adapted or modified for general application in diamonds, largely as a result of their inability to operate at large angle intersections where the problems are most significant.

Further analysis indicated that there were no other ways to meet the functional specifications that had been developed other than by adopting a totally innovative perspective to achieve a fully gap-free diamond capability.

Patent History

Given that railroading is a mature industry, research was undertaken to see if there were any previous work addressing similar concerns.

Most of the designs on the matter dealt with "street railways" operations and were intent on finding ways to limit the noise and vibrations associated with intersecting streetcar lines. This was achieved either through a range of passive systems with fixed configuration involving flange running operations or through the adoption of various complex active systems with variable configurations of the track-work.

In all, this research identified 60 different patents. All of the proposed designs involving variable geometries were found to be highly inadequate for streetcar applications, particularly on public roads when taking into consideration unavoidable fouling and winter conditions.

The suitability of their designs for heavy railway applications was even more dubious, as they were either lacking structurally and/or were displaying operating mechanism complexities that were impractical in the railway environment.

Of these, there were only three that were considered worthy of special considerations.

The first one refers to U.S. Pat. No. 2,948,497 by N. F. Higgs (1960/08/09). It consists of a sliding (or retractable) flangeway tapered filler blocks. This was deemed to be an interesting concept but it failed to meet the criteria outlined in Table 1 on the basis of its inability to cope with freezing precipitations without the adjunct of a heating system.

In addition, there was European Patent EP 1626124-B1 by H. Friedberg and T. Chris (2006/02/15). This is basically a trapezoidal sliding block, where the apex (or point) of the frog is shaved off, is remarkably similar to an option that was identified and analyzed as part of this research. It was however rejected because its structural design was deemed not suitable for the heavy axle loads found in North American railways. Moreover, it permitted for rain/snow infiltration and thus, would not be usable in a low temperature environment without proper freezing protection equipment.

Finally, there is U.S. Pat. No. 1,703,716 by L. Botto (1929/02/26). The approach proposed herein is the use of circular disk that rotates in position according to the direction of the route being authorized. While it is an apparently worthy concept, it leaves much to be desired structurally since it has minimal lateral support and so do any possible variants; this makes it unsuitable for the dynamic loads characteristic of heavy rail operations.

Thus, an exhaustive search of the patent literature has demonstrated that the concepts and designs relative to the invention presented further on in this document do not conflict with any previously made proposals or Patents issued. The findings of this search on previously granted patent claims pertaining to railway diamonds are documented in Table 2 below. Hence, a radically different approach to the problem was needed in order to achieve a successful resolution of the issue.

TABLE 02

List of Related Patents

| By Pat. # Gapless | | Gapless Railway Diamond Grouping by Patent Number | | | | | | Note: Low-Speed Only for Wheel-Activation (Cyclical and Non-Cyclical) and Flange Bearing | |
|---|---|---|---|---|---|---|---|---|---|
| Patent Number | Issued Date | Inventor | Description-1 | Ice + Snow | Wheel Actv | Cycl Actv | Sub-Rails | Comments | Gapless Rating |
| US 403,060 | 1889 May 7 | Morgan/BB | Sliding scissor plates - light duty | no | no | | no | Two intersection angles shown. Primitive | 1 |
| US 467,817 | 1892 Jan. 26 | Leach/SS | Central mech. drive (complex). Side-sliding triangles + pads | no | no | | yes | Complex series of levers. Buff forces | 1, 2, 4 |
| US 571,215 | 1896 Nov. 10 | Collen/D | Slideable series of rails, with derails—totally impractical | no | no | | yes | Convoluted and impractical—like clockwork | 2, 4 |
| US 630,748 | 1899 Aug. 8 | Scott/D | GaplessRrx: rotating gap filler blocks | no | no | | yes | | 2, 4 |
| US 674,748 | 1901 May 21 | Wadey/E | Automatic device for Opening/Closing Spaces between rails | no | yes | yes | no | Wear expected from repetitive action | 3 |
| US 764,726 | 1904 Jul. 12 | Ingram/AB, Heard/T | Track slice wedge (moveable rail slice triangles) | no | no | | no | For very light loads | 1 |
| US 768,171 | 1904 Aug. 23 | Elliot/WHH | Base plate spring loaded (w/frog "Bed Plate") | no | yes | yes | no | Mtce item. Ineff. at large track angle intercept | 3, 4 |
| US 772,061 | 1904 Oct. 11 | Ritzler/GA | Gapless: mini-disks wheel activated | no | yes | no | yes | Frail componentry, including short rails | 1.2 |
| US 776,867 | 1904 Dec. 06 | Schaefer/ | Two small rail turntables, 1 turning lozenge | no | no | | min | Frail componentry | 1 |
| US 779,410 | 1905 Jan. 0110 | Campbell/A | Continuous Rail Crossing: Sliding triangles made with rails | no | no | | no | Buff config.: not suitable. Numerous levers | 2 |
| US 819,992 | 1906 May 8 | Hardman/CC | Complex linkages | no | no | | min | Complex mechanical system | 1, 2, 3 |
| US 828,054 | 1906 Aug. 7 | Renner/JW | Rotatable splice rails or "mini-disks" automatically positioned | no | yes | no | min | Totally impractical and simplistic | 1, 3 |
| US 860,734 | 1907 Jul. 23 | Cushing/ | One+four turn-tables. Rotating rails. Not locking | no | no | | yes | 90 deg: 1 disk; others: 4 disks + rotating rails | 1, 2.4 |
| US 904,037 | 1908 Nov. 17 | Adams/PO | Gapless: geared crankshaft angled cut rails | no | no | | yes | | 2, 4 |
| US 909,189 | 1909 Jan. 12 | Kaltschmidt/AE | Temporary filling of gap | no | no | | min | | 4 |
| US 911,997 | 1909 Feb. 9 | Keith/GP | Gapless: elevated sliding track section | no | no | | yes | | 1 |
| US 955,145 | 1910 Apr. 19 | Ennis/CE | Mechanical linkages. Rail segments pivoting. Not locking | no | no | | yes | Intricate series levers, clockwork. Impractical | 1, 2.4 |
| US 963,258 | 1910 Jul. 05 | Stitzel/F | Thread rocker blocks | no | yes | | no | Non-functional: this should produce an up-bump | 1, 3, 4 |
| US 1,020,834 | 1912 Mar. 19 | Marshall/R, Norbury/A | Railway Crossing, mechanical sliders, triangles. | no | no | | no | Sliders, intricate linkages, "square" mini-frog | 1, 2 |
| US 1,029,978 | 1912 Jun. 18 | DiedreachC | Bevelled sliding rails - auto | no | yes | yes | min | Reliable operation mechanically impossible | 1, 3 |
| US 1,072,706 | 1913 Sep. 9 | Dickson/CA, Burton-Jones/NL | Railway Diamond and Other Crossings | no | yes | | no | For small angles only | 1, 2 |
| US 1,080,841 | 1913 Dec. 9 | Milholland/RD | Spring loaded vertical tiltable block in groove—auto | no | yes | yes | no | | 3, 4 |
| US 1,095,788 | 1914 May 5 | Blake/BF | Track turntable | no | no | | yes | For 90 degrees diamond only | 1, 2 |
| US 1,135,888 | 1915 Apr. 13 | Fogerty/JV | Rail head flipping over below flangeway, on the field side | no | no | | no | For 90deg. Field side flip gives low side strength | 1, 2, 4 |
| US 1,169,196 | 1916 Jan. 25 | Sadler/L, Geckler/RC | Disks. Groove+wheel mounted sensors, ball support | no | yes | | yes | Requires wheel-mounted actuator sensors | 1, 3 |
| US 1,172,795 | 1916 Feb. 22 | Helfer/CA | Electric or hydraulic thread block riser—auto | no | yes | | yes | Complex powered system—like clockwork | 1, 2, 3 |
| US 1,213,070 | 1917 Jan. 16 | Brown/D | Diagonal scissors | no | no | | no | Light-duty | 1, 2 |
| US 1,238,005 | 1917 Aug. 21 | Douglas/DC | Pivoting bridging rails, many levers | no | no | | no | Light-duty | 1, 2 |
| US 1,244,439 | 1917 Nov. 23 | Forrester/GL | Gapless Rrx: rising gap fillers | no | no | | yes | Light-duty | 2, 4 |
| US 1,261,519 | 1918 Apr. 2 | HammerDE | Multiple mini-disks and linkages | no | yes | no | no | Light-duty | 1, 2, 3, 4 |
| US 1,283,672 | 1918 Nov. 5 | Clark/C | Load-bearing triangle sliders | no | yes | no | no | Load-bearing traingles—like slider option | 3, 4 |
| US 1,305,211 | 1919 May 27 | Hare/JA | Gapless: mini-disks mechanically geared driveshaft actuated | no | yes | no | yes | | 2, 3 |
| US 1,331,831 | 1920 Feb. 24 | Thomas/LV | Tracks at different heights and pivoting "rail bridge" | no | no | | no | | 1, 2, 4 |
| US 1,338,253 | 1920 Apr. 27 | Rothwell/R | Wheel activated sliding non-load-bearing triangles (guard) | no | yes | no | no | Sim. "Slider". Not "Self-Locking". Mid-track comp. | 3 |
| US 1,344,866 | 1920 Jun. 29 | Coulter/HA | Through Rail Diamond. One large turntable | no | no | | no | Only for 90 deg. | 1 |
| US 1,354,080 | 1920 Sep. 28 | VanDyke//BG | Wedged mid-track pushers | no | no | | yes | Like clockwork | 1, 2 |
| US 1,362,047 | 1920 Dec. 14 | Sheehan/E | Gap closing through wheel-activated riser in flangeway | no | yes | yes | no | | 2, 3.4 |
| US 1,364,315 | 1921 Jan. 4 | Rihn/CM | Vertically moveable rail sections to raise/lower one rail | no | no | | | Application renewed 1920 Jul. 05 | 1 |

TABLE 02-continued

List of Related Patents

| By Pat. # Gapless | | Gapless Railway Diamond Grouping by Patent Number | | | | | | Note: Low-Speed Only for Wheel-Activation (Cyclical and Non-Cyclical) and Flange Bearing | |
|---|---|---|---|---|---|---|---|---|---|
| Patent Number | Issued Date | Inventor | Description-1 | Ice + Snow | Wheel Actv | Cycl Actv | Sub-Rails | Comments | Gapless Rating |
| US 1,367,837 | 1921 Feb. 8 | Spaulding/T | Mini-disks wheel activated 4 turntables | no | yes | no | yes | | 2, 3 |
| US 1,378,277 | 1921 May 17 | Rihn/JM, Rihn/W | Gap filler blocks: Four casings at rail intersections | no | no | | yes | Movable blocks. Susceptible to jamming | 4 |
| US 1,399,289 | 1921 Dec. 6 | Brady/JF | Four horiz. pulleys+chains positioning guard rail to close gap | no | yes | no | no | Non-cyclical wheel activation | 1 |
| US 1,417,964 | 1922 May 30 | Abbott/ES | Load-bearing blocks automatically slanting to clear gaps | no | yes | no | no | Complex lever arangement | 1, 3 |
| US 1,418,559 | 1922 Jun. 6 | Giannacopoulos/GJ | Bridging plunger in rail-head, mult mvg parts(spring loaded) | no | yes | yes | no | Not suitable for heavy weight | 2, 3 |
| US 15,391 Re | 1922 Jun. 20 | Wilson/BE | Mechanically activated sliding triangles (Re-issue) | no | no | | no | Very limited loading capabilities | 1 |
| US 1,425,472 | 1922 Aug. 8 | Hardy/JH | Flappers: rails moved laterally by action of moving train | no | yes | no | no | For near-90 deg intersections only. Non-cyclical | 1, 2 |
| US 1,440,223 | 1922 Dec. 26 | Jacobs/JF | Intricate series of levers linking to moving triangles | no | no | | no | Complex. Mech. puzzle. Slack not considered | 1, 2 |
| US 1,440,754 | 1923 Jan. 2 | Walker/FA | Wedge joining tracks (angle rails), with large central disk | no | no | | yes | | 2, 4 |
| US 1,443,559 | 1923 Jan. 30 | Carlson/AE | Spring-loaded pivoring gap closure bellcranks | no | yes | yes | no | Clever. Concern re: directionality. See 2266293 | 3, 4 |
| US 1,626,146 | 1927 Apr. 26 | Morrow/L | Full load-bearing helical gear operated risers | no | no | | yes | | 2, 4 |
| US 1,655,521 | 1928 Jan. 10 | Spahr,Sr/C | Spring loaded return to vertical position when no traffic | no | yes | yes | no | Concern about pivot wear and load capabilities | 2, 3, 4 |
| US 1,670,845 | 1928 May 22 | Cooley/CJ | Gapless Xing with Disks | no | no | | no | Clockwork | 1, 2, 3 |
| US 1,703,716 | 1929 Feb. 26 | Botto/LT | Railroad Crossing: Rotating Disks | no | no | | no | No lateral support | 5 |
| US 1,713,008 | 1929 May 14 | Sadler/L | Mini-disks mechanically operated. Requires 4 pits | no | no | | yes | | 2 |
| US 1,782,182 | 1930 Nov. 18 | Stoller/MG | Hotizontal inserts—intricate levers | no | no | | yes | Claims to be suitable for snow/ice! WRONG. | 2, 4 |
| US 2,021,905 | 1935 Nov. 26 | WhalenMH | Circ. disks. Elect, heat. Mech. inter-links. 2 Gauges | no | no | | yes | Lock: cam plates+notches. Ind through-drive link | 2, 4 |
| US 2,266,293 | 1941 Dec, 16 | Alexander/L | Moveable crescent-type closure rails. Compress stock rails | no | no | | no | Numerous gaps. Good drafting. See 1,443,559 | 4 |
| US 2,285,559 | 1942 Jun. 9 | Blair/CH | Lozenge pivoting rail segment/central rods+disk | no | no | | yes | Simplisitc, impractical, not safe | 1, 2, 4 |
| US 2,294,793 | 1942 Sep. 1 | Munroe/BC | Moveable in-crossing geared scissors(2) w/ gearing | no | no | | yes | Akin to slider, but load bearing surface is smaller | 1, 2, 4 |
| US 2,948,497 | 1960 Aug. 9 | Higgs/NF | Sliding flangeway filler and tapered filler block | no | no | | no | Linkages with SCS. Good but affected by icing | 5 |
| EP 1860238 A2 | 2007 Nov. 28 | Winter/A | Principle of translations; undertrack rollers | no | | | | Minimal info provided | 1, 2, 4 |
| EP 1626124 B1 | 2008 Mar. 26 | Friedberg/H,Chris/T | Trapezoidal (triangular) sliding block | | | | | Pub. 2006/02/15. Like Opt 2. Mid-track comp. | 5 |
| Evaluation Legend ===> | | | | | | | | Overal Evaluation | |
| | | | | | | | | Simplistic and/or Impractical | 1 |
| | | | | | | | | Mechanically Complex and/or Unsuitable | 2 |
| | | | | | | | | Cyclical or Low-Speed Wheel Activation | 3 |
| | | | | | | | | Not Jam-proof and/or Immune to Weather | 4 |
| | | | | | | | | Consider | 5 |

Possible Options

Nine (9) configurations were initially developed and six (6) of those did not require access from under the frog and hence, the use of risers. Although all of these could meet the geometrical requirements, the broader list of functional specifications could only be met in the one instance that has been retained for this invention.

The Retained Option

According to an embodiment, this configuration consisted of having pistons for each of the two intersecting routes, i.e. two for each of the four frogs, located at the mid-width of the flangeways, with their operating mechanisms located below the frogs. This provides for full gapless operation on either of the two intersecting routes. A simplified variant providing full gapless operation on only one of the intersecting routes will be discussed below in the section entitled "Single Route Variant".

The pistons can be activated to assume an up or down position, also known herein as being in an "extended" or "retracted" position, depending on whether there is a requirement to close or open the flangeway gaps. This option served as the basis for the retained solution that forms the basis for this document.

Each of these pistons has a load pad, which may or may not be cylindrical, at its end to provide support to the passing wheels, thus preventing said wheels from dropping into the flangeway gap intersecting the running surface, thereby effectively bridging it.

Thus, when extended, the pistons provide support to movements as they proceed over the intersecting flangeways, resulting in quasi-continuous running surfaces. Conversely, when retracted, they provide totally clear flangeways that allow movements as they proceed along the associated running surfaces.

According to an embodiment with an optimal configuration, pistons are centered at the mid-width position of each of the flangeways, with their axis in the vertical plane of each of the flangeway center lines and inclined away from the frog point towards its base by the value of the piston axis inclination angle relative to the frog plane. The piston inclination also facilitates maintenance access, as the power and control unit, namely the Piston Actuation Unit (PAU) to be later discussed, is then located further away from the central portion of the sub-frog area.

This provides increased physical separation at the base of the frogs between the piston axis, thus allowing the design of the sub-frog operating mechanism to have the same form factor for all intersection angles ranging from 30° to 150°. This design standardization is beneficial in terms of minimizing fabrication and inventory costs.

After the best option in terms of gap bridging had been identified, the options of the motorization of the process were examined. A total of five (5) such configurations were developed and analyzed.

Both the issues of the investigated options relative to the gap closing mechanism and the actuator are outlined below in the section on the "Investigated Frog and Actuator Options".

Details of the Retained Option

According to an embodiment, the preferred option, for the "Full System" and "Half System" configurations, consists of pistons located at the mid-position of the flangeways of each of the four inter-connected frogs making up a railway diamond.

These two pistons operate in the vertical plane of the flangeway and are located adjacent to the point of the frog. They are inclined relative to the frog plane by the value of the piston axis inclination angle, with their distance moving further away from the geometric "intersection point" at the base of the frogs along the axis of the flangeways.

A set of two such pistons in a given frog is referred to as a "conjugate pair", as they operate in opposite phase to each other. That is, a conjugate pair of pistons is comprised of two flangeway-closing pistons located on the same frog, with each one controlling one of the two intersecting flangeways and operating in opposite phase to the other.

Thus, they either fill or clear the flangeway depending on whether they are raised up from the body of the frog (i.e. they are in the "Extended Position") or are lowered into it (i.e. they are in the "Retracted Position").

According to an embodiment, when the piston is up (or extended), the top end of its load-bearing pad is level with the Top of Rail and this bridges the gap in the running surface that would otherwise have been created by the flangeway being intersected. Consequently, this provides a continuous and level running surface across the intersected route.

Conversely, when it is down (or retracted in the body of the frog), the top end of its load pad is retracted below the bottom of the flangeway, thus clearing said flangeway and allowing movements on the corresponding route.

Figure 4:
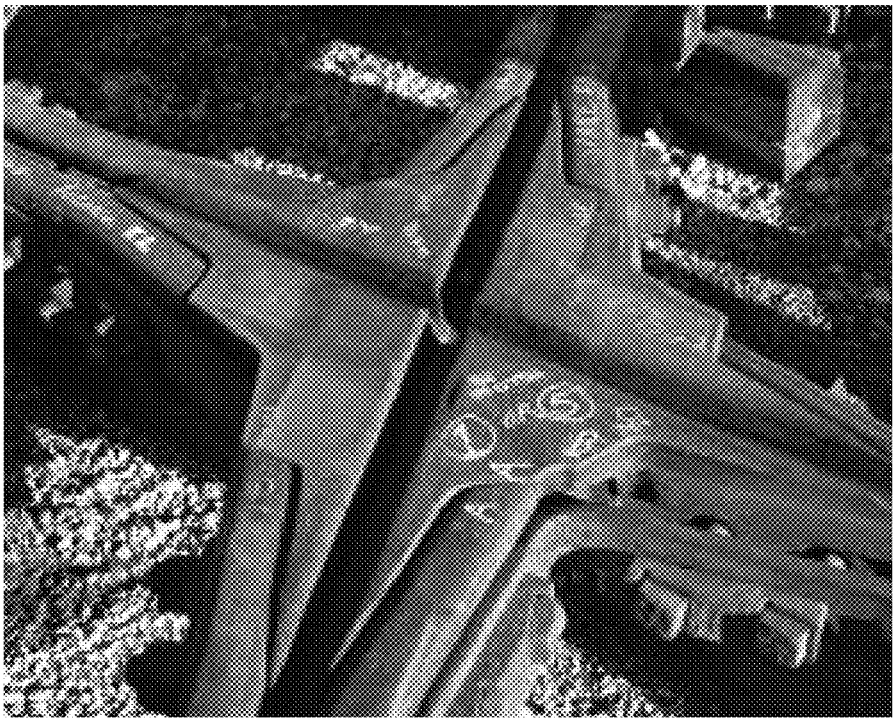
FIG. 4 shows a pre-installation close-up of a near-transverse reversible frog core, according to an embodiment.
Figure 5A:
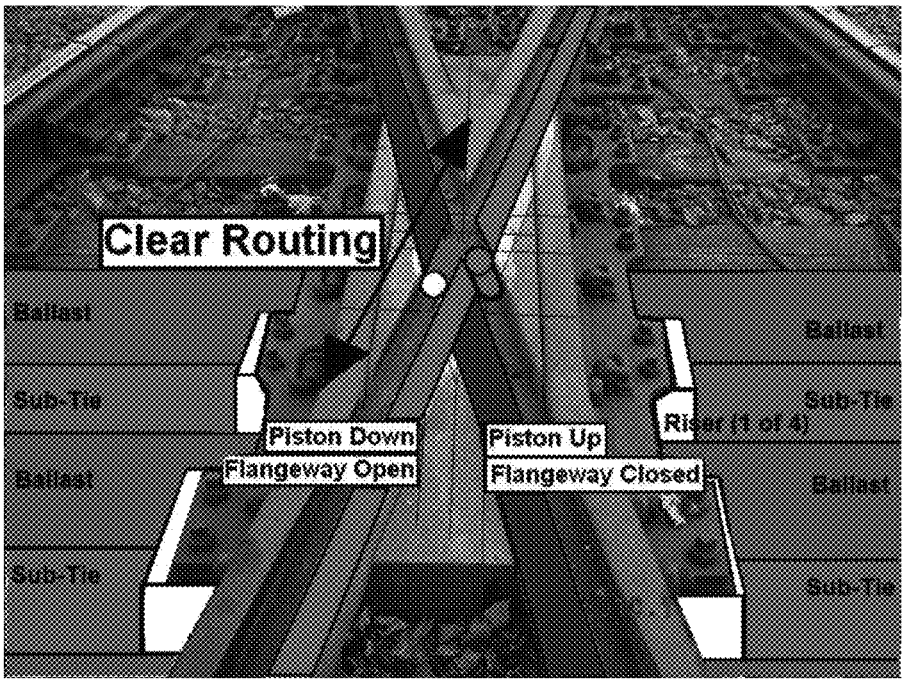
FIGS. 5(*a*) and 5(*b*) show photo-views for a shallow angle diamond, without piston stiffeners depicted according to an embodiment.
Figure 5B:
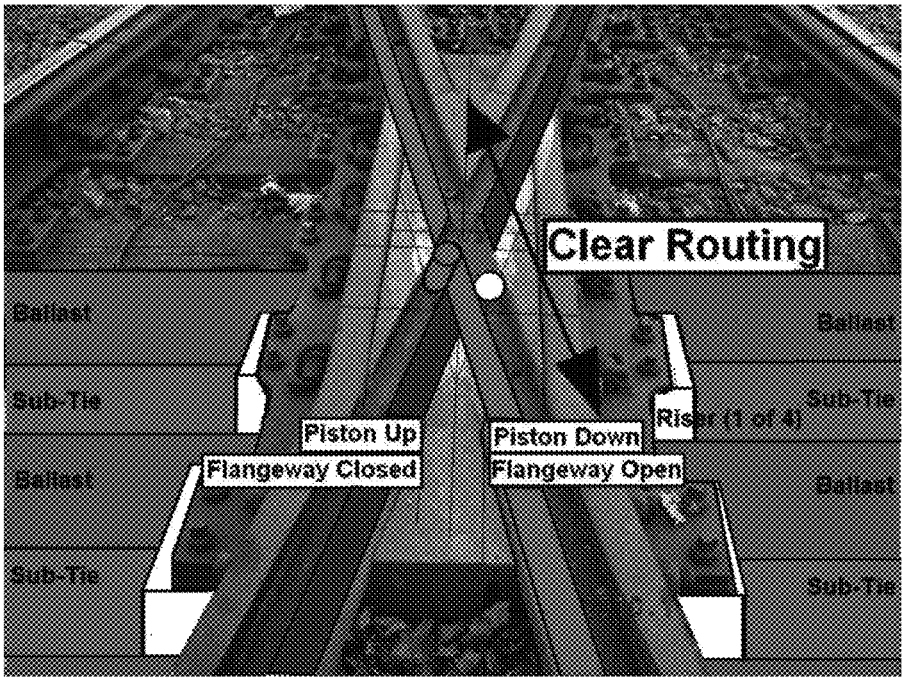
Figure 5C:
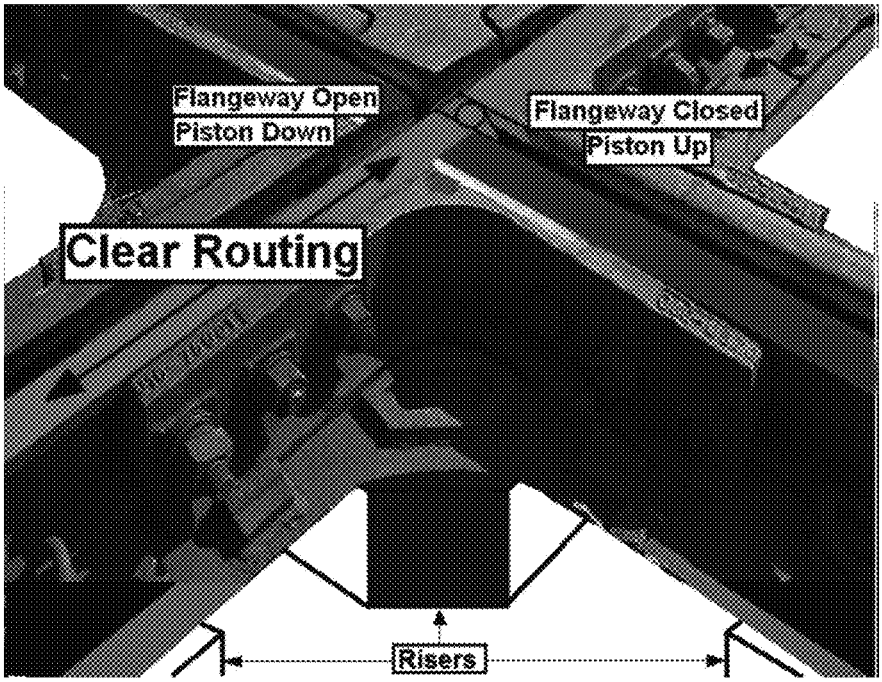
Figure 5D:
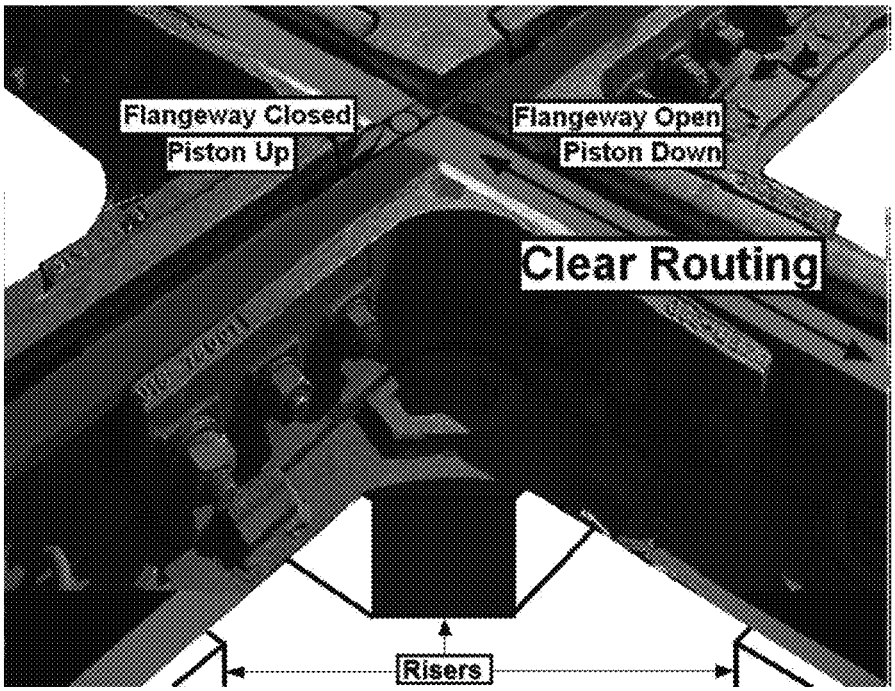

A close-up view of a reversible frog core is shown in FIG. 4, as this particular type of frog is eminently suitable for this application.

According to an embodiment, risers were used in the design to provide the vertical separation that is required between the frogs and the ties in order to locate the operating mechanisms that operate the variable geometry. In the context of this invention, risers refer to structurally solid components used to support a rail or a frog, typically some 8 to 10 inches above the load-bearing ties in some embodiments, depending on the type of resilient material used.

This arrangement makes it possible to perform the needed inspection and maintenance functions in the congested area of a diamond.

It also offers excellent immunity against snow and freezing rain without the need for heaters, as it does not have, by its very nature, any compressive surface.

In addition, there are distinct sets of modules that are located within each of the piston actuating enclosures. These provide for the operating, locking and sensing mechanisms that is performed within the Piston Actuation Unit (PAU). In the context of this invention, the PAU is located below the running surface of a frog and is an essential component of embodiments of the "Gapless Railway Diamond", as each of these operates the piston that sets the geometry of the frog. This is fully discussed in the section on "Core Components" below.

According to an embodiment, each of the frogs only requires minor modifications during fabrication for the provision of 1% inch diameter piston bores that are inclined relative to the frog plane by the value of the piston axis inclination angle in the vertical plane of the flangeways. In addition, some minor machining will be required, such as for the channels for the piston position indexing rod.

Furthermore, two small diameter (5/16 inch interior diameter) channels should be made near the top of the frogs to allow for an alternate means of piston position indexing.

All of these modifications in the railway frog are inconsequential from a structural perspective as a minimal amount of material is removed in the frogs and the required machining is performed along lines of minimal internal stress loads.

Overview of Innovative Elements

According to an embodiment, gapless functionality is achieved through a selective gap bridging process provided by load pads and pistons. The process for each of the four frogs on this new type of Railway Diamond involves closing down the flangeways being intersected by extending the associated pistons on the inactive route, while opening up the flangeways being used by retracting the associated pistons on the active route. All pistons are inclined below their flangeways by some 45° relative to the frog base, away from their frog point, to allow locating the operating mechanism further away from the relatively inaccessible frog intersection point, while also allowing for a PAU form factor that is suitable for small angle intersections. Risers provide the vertical separation from the ties that is required for the mechanisms.

According to an embodiment, elements such as the actuator assembly, i.e. the "Piston Actuation Unit" (PAU), the system control equipment, the interface with the "Rail Traffic Control System" (RTCS) used for automatic operation and the "Wayside Command Panel" used for both disabled operations and maintenance purposes all provide the essential peripherals for the dynamic configuration of the frogs and hence, for this invention which is known as the "Gapless Railway Diamond".

The Gapless Railway Diamond

General Description

According to an embodiment, the gap-bridging function in a railway diamond required the development of a new type of variable geometry railway frog that provides effective gap closing capabilities in the full specified angular range between the intersecting lines, while meeting all the specified structural, environmental and operating criteria.

According to an embodiment, each of the four frogs has, depending on overall functionality levels, either one or two slanted pistons on the point side of the intersecting flangeways and in proximity to the frog point. Each of these can provide intersected gap closure along one of the two intersecting routes. According to a further embodiment, these pistons have a load-bearing pad on their shaft and are operated from below the frog through an accessible mechanism called a Piston Actuation Unit (PAU).

Depending on which of the two routes is carrying the traffic, this makes it possible to selectively close flangeways that are intersecting the running surfaces, thereby eliminating the gaps normally associated with traditional railway crossings at-grade.

As a result of the absence of any wheel drops as wheels cross over the intersecting flangeways, the large dynamic forces normally associated with diamonds are eliminated.

For full functionality, both intersecting lines have gapless capabilities and there are two piston-operated load pads in each of the four frogs. In instances of partial functionality, there is only one of the intersecting lines that has gapless capabilities and hence, there is only a single piston-operated load pad in each of the four frogs. In both instances, risers are required to provide the vertical clearances required for the operating mechanisms.

There are other less evident aspects, such as the power system, the control system and the RTC interface system. The power system is based on either hydraulic or electric motors.

These are the essential components of the "Gapless Railway Diamond" and they form the basis for the related embodiments.

According to an embodiment, the design does not affect structural or wheel guidance properties and provides full immunity against adverse operating and environmental conditions.

Embodiments of the invention are applicable to all intersection angles within the specified line intersection range of 30° to 150° outlined in Table 1. According to an embodiment, it is not required to fabricate customized components for different intersection angles. Alternative embodiments of the invention may be used with intersection angles outside of the 30° to 150° range by modifying the form factor of the PAU.

Embodiments of the invention may revert back to the traditional diamond mode of operation if the variable geometry functionality were to be temporarily unavailable as a result of technical failures, thus minimizing downtime.

Embodiments of the invention device are jam-proof and immune to vandalism. According to an embodiment, use of the "Gapless Railway Diamond" will be most beneficial for line intersections that are nearly perpendicular, as these correspond to the most adverse situations when two lines cross each other at-grade.

As a result of the general embodiment, large reductions in dynamic forces will lead to benefits in terms of decreased requirements for oversight and maintenance, as well as to extended service life for the frogs and the associated track components, including the sub-lying ties, ballast and subgrade. Hence, it will reduce the need for maintenance, with some being in notoriously difficult areas to access, thus significantly improving the overall economics.

Embodiments also address and improve public relations as a result of drastic reductions in the noise and ground vibrations levels associated with railway crossings at-grade.

Overall, embodiments of the invention will provide significant economic and operational benefits, as well as achieve better asset utilization. Embodiments will help improve utilization over critical resources and improve recovery times in areas where line capacity is limited. Finally, embodiments have the potential to improve fuel consumption and reduce idle time both for train crews and maintenance crews.

Operating Principles

For each of the four frogs, embodiments with a gap-free configuration are achieved by raising, prior to the onset of a movement, a load-bearing pad in the flangeway of the route being intersected while lowering the one in the flangeway of the route in service. Like for a power turnout, this is controlled either centrally by the RTC or locally by the field crew.

This means that the piston in the flangeway of the intersected inactive route must be fully extended, thus supporting the movement, whereas the one in the flangeway of the through active route must be fully retracted, thus providing an unobstructed flangeway for the movement.

This configuration provides a gap-free running surface along the active route by temporarily bridging the intersected flangeway gap, while clearing the flangeway of the active route itself. This avoids generating large dynamic impacts as a movement is proceeding across.

When the active and inactive routings are interchanged, so also are the positions of the pistons.

Consequently, the diamond becomes a variable track geometry component basically consisting of four variable geometry modified frogs that provide, when properly configured, gap-free running surfaces for the movements proceeding over the intersecting flangeways.

The result is this invention which is referred to as the "Gapless Railway Diamond".

In terms of engineering, the piston shafts are cylindrical in shape, with a 1½ inch diameter and are made of regular soft steel, intentionally providing them a lower hardness than that of the frog. They operate within a sleeve located in the flangeways of each frog and consisting of a through bore having a diameter of 1% inch through the frogs. As a result of their material composition, they are considered as sacrificial components that can be readily replaced, if the need arises.

They are inclined relative to the frog plane by the value of the piston axis inclination angle and each one connects with its respective operating mechanism located under its corresponding flangeway in each of the frogs. These mechanisms operate the variable geometry of the frogs by raising (i.e. extending) or lowering (i.e. retracting) the gap-bridging pistons.

Thus, in a "Full System", the two pistons on the same frog always operate in opposite phase to each other, (i.e. when one is up in its extended state, the other one is down in its retracted state and vice versa) to form what is known as a conjugate pair. In such a case, the piston in the inactive line is always extended up to provide support to the traffic on the active line. Similarly, in a "Half System: there is only one piston on each frog, namely on the low traffic line, and it is always extended when the high traffic line is active.

Embodiments of the "Gapless Railway Diamond" consist of five main sub-systems. First, a set of four frogs modified so as to provide full bridging of the intersected flangeways, irrespective of their intersection angle, through the use of strategically located inclined piston shafts having the required structural strength. Second, an operating mechanism located below each of the frog flangeways, on the field side of the intersected rail, to modify the frog configuration by varying the extension of the pistons within their respective flangeways. Third, a tie and riser arrangement to support the frogs and provide the vertical clearance required for the mechanisms and accessibility for maintenance purposes. Fourth, a motorization system, either hydraulic or electric, to operate each of the mechanisms within the four frogs, with ancillary components located on the wayside in close proximity, with provision for operations under anomalous conditions. Fifth and lastly, the necessary controls and interfaces with the wayside control panel and the RTC system located either within the existing climate protected and secured field signal bungalow or a separately provided and equally suitable nearby enclosure.

Specifics of the Design

According to an embodiment and as already outlined, the gap-bridging function is accomplished by elliptical load pads and pistons located in each of the flangeways of the frogs close to their geometrical point. These pistons are in the vertical plane of the flangeways and are inclined from the top of the frogs relative to the base of the frogs and away from the frog point. Gap closing is achieved by raising the pistons so that their load pads are at the Top of Rail (ToR) elevation, whereas gap opening is achieved by lowering the pistons so that their load pads are 2 inches below the ToR elevation, thus making them fully imbedded in the frogs. This provides a continuous running surfaces over the intersecting route, while permitting an clear flangeway along the authorized route. Pistons are load bearing, both axially and off-axis, and have a 1½ inch outside diameter. Under "Full System" functionality, the two pistons on each of the four frogs form a conjugate pair and they operate in opposite phase. Under "Half System" functionality, there is only one piston on each of the four frogs and it is located in the flangeway of the low traffic line. In both instances, the piston operating mechanism being located under the frog. According to a further embodiment and pending future engineering studies, the piston axis is inclined some 45° from the plane of said frog and away from its geometrical point.

According to an embodiment, there are three distinct configuration modes for the pistons associated with each of the four frogs in order to provide the running surfaces with gap closing over the intersected flangeways. The first configuration mode corresponds to that of the piston located in the flangeway of the inactive route being intersected, where said piston is fully extended, having its load pad at the Top of Rail (ToR) elevation. This essentially provides the traffic on the active route with a bridge over the intersected flangeway, effectively eliminating the break that would otherwise have been encountered in the running surface. The second configuration mode corresponds to that of the piston located in the flangeway of the active route carrying the traffic, where said piston is fully retracted into the body of the frog, having its load pad at least 2 inches below the ToR elevation, effectively providing a clear flangeway along the active route. The third configuration mode corresponds to the transition mode as a piston is being positioned until the system detects a "Set and Locked" status prior to the issuance of a permissive clearance. During this transition period for the configuration process, the railway diamond is unavailable to traffic.

According to an embodiment, when the active and inactive routes are interchanged, so are the respective modes for the pistons and full support is provided to the traffic crossing the flangeways, irrespective of the active route chosen. In terms of loading factors, there are no loads acting on the pistons during the second and third configuration modes and live loads are only experienced while in the first configuration mode, only when traffic is over the load pad. As there is no requirement to either raise or lower the loads, the actuator design only has to provide static support, without the need for dynamic travel under load.

According to an embodiment, there is a "Stand-By Mode" during which no route authorization has been issued and during which all pistons in the "Gapless Railway Diamond" are fully retracted within the body of their respective frogs. As a result, all of the flangeways are clear, i.e. unobstructed, and the configuration is basically equivalent to that of a traditional diamond.

According to an embodiment, the "Stand-By Mode" configuration serves a triple purpose. First, it ensures that the piston shafts are in an extended position only for a limited period of time prior to a movement, thus minimizing possible ice accumulation on protruding areas under freezing rain conditions. Second, it provides an opportunity to "scrape" the piston sides after the completion of every movement whether along the same route or not, thus minimizing the effects of possible ice accumulation. Third, it allows the pistons to be already positioned in a retracted configuration, like a traditional fixed geometry diamond, in case of an unforeseen power outage, thus maintaining continued system availability, issued possibly in conjunction with a speed restriction.

According to an embodiment, when a route is being set the system proceeds through a "Route Configuration Set-up" to ensure that all four (4) pistons located in the flangeways of the active route are verified to be lowered and locked (i.e. they are fully retracted into the body of the frogs) and that all of the remaining four (4) pistons located in the flangeways of the inactive, or intersected, route are raised and locked (i.e. they are fully extended out of the body of the frogs so that their load pads are at the Top of Rail elevation). This is to ensure that the flangeways of the active route are free of obstructions and that full wheel support over the flangeways of the inactive route is enabled.

According to a further embodiment, after completion of a movement across the "Gapless Railway Diamond", all the pistons automatically revert to their fully retracted "Stand-By Mode" position, even if they have to reemerge promptly afterwards as a result of a new clearance along the same routing.

According to an embodiment, in instances of a power or other technical outage, it is possible to operate in the "Disabled Mode" to revert to a standard passive railway diamond. The usual mitigation measures, such as those described in the section on "Current Technical and Operational Mitigation Measures" above, would then be used and this would result in track capacity reduction for the duration of the operation in this mode.

Thus and according to an embodiment, the gap-bridging function is achieved using an inclined piston that is slanted relative to the frog plane by the value of the piston axis inclination angle and has a diameter of 1½ inch. This piston fits within the width of the flangeway, which ranges from 1⅝ inch to 1⅞ inch, depending on the wear history. As a result of this inclination, the piston, when extended, is subjected to a bending moment estimated to be up to 10,000 ft-lbs, when supporting a wheel load. The required mechanical strength is provided both by the piston shaft itself as well as by the stiffener mounted on its upper sidewall.

According to an embodiment, each piston is actuated by a mechanism known as a "Piston Actuation Unit" (PAU) and located underneath the frog structure. A vertical space, typically of some 8 inches between the frogs and the sub-ties, is required for this mechanism and its load-bearing enclosure and slightly more depending on the type of resilient material used. This space is provided by risers located between the frog and the sub-ties. According to a further embodiment, gap management is accomplished through the actions of the PAU without the need for any modifications to the running surfaces or to the frog points. When extended, a piston located in the flangeway of the intersected line provides movements with a continuous and level running surface as they crosses said flangeways. The remaining gap on each side of the piston depends on the cumulative wear of the frog (see Table 1).

According to a further embodiment and as discussed further on, the PAU's can be operated either electrically or hydraulically. Both of these require provisions for operations under normal as well as anomalous conditions, as well as for maintenance purposes.

According to an embodiment, there are no compressive surfaces in the design. Consequently, the use of snow-melting devices is not required. This is beneficial both in terms of energy cost savings and avoiding possible obstructive freezing within the ballast.

According to an embodiment, piston shafts are designed to minimize the contact area with the walls of the cylinders. This is to prevent these from seizing up if they are laden with clear ice.

As a result of the operating mechanism residing within the structure of the diamond, proper water drainage of the area is essential to achieve the expected system reliability. This will avoid the possibility of water damage, as well as possible interference as a result of ice formation.

Thus, embodiments consist of minor modifications to the frogs to permit the installation of the pistons required to provide the necessary variable geometry, with related equipment and instrumentation. Embodiments require the provision of an operating mechanism, known as the "Piston Actuation Unit" (PAU) and related track-side actuators. Embodiments use risers to provide the required separation of the frogs from the ties to allow for the operating mechanism. Embodiments also relate to the provision of a control interface system in the signals bungalow, a wayside command panel to allow continued operations under anomalous conditions. Lastly, embodiments provide ancillary components, such as for the "Emergency Release Sequence" (ERS).

Photo Views of General Embodiments

The tie arrangement used to support a railway diamond is different depending on whether the railway line intersection angle is "Shallow" or "Near-Transverse". Such intersections can be considered as "Shallow Angles" if less than 60° and as "Near-Transverse Angles" if in the 60° to 90° range.

A visual representation is provided of shallow intersections in FIGS. 5(*a*) and 5(*b*) and of near-transverse intersections in FIGS. 5(*c*) and 5(*d*), each without piston stiffeners depicted. According to the embodiments depicted in FIGS. 5(*a*) to 5(*d*), the design for the gap-bridging mechanism is similar between shallow and near-transverse intersections, even though there is a marked difference with respect to the arrangements of the ties.

These two views illustrate the basic principle of embodiments of the invention. Specifically, the pistons in the flangeways along an authorized route, indicated by a lighter coloration, are fully retracted, thus providing an unobstructed routing, while those in the flangeways of the intersecting line, indicated by the darker coloration, are fully extended, thus providing a gap-free load-bearing surface for authorized movements.

FIGS. 5(*a*) to 5(*d*) also illustrate the general layout that provides the vertical clearance required for the "Piston Actuation Unit" (PAU). The sub-tie area, which is not clearly depicted, provides the required separation between the ballast and the operating mechanisms, which is at a level above that of the ballast.

Diagram Views of General Embodiments

Railway track diagrams are used to illustrate the modifications required in embodiments of the invention.

Figure 6A:
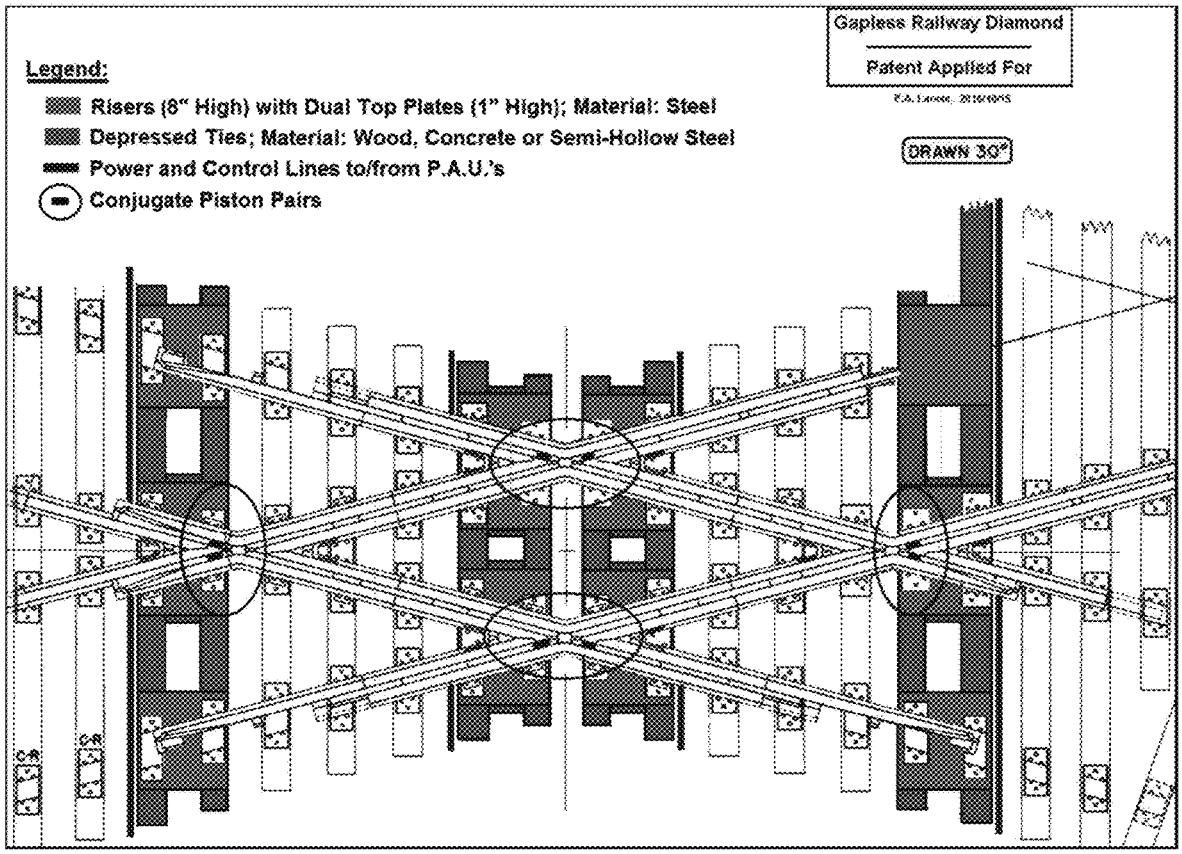
FIG. 6(*a*) shows a shallow angle diamond at top of rail according to an embodiment.
Figure 6B:
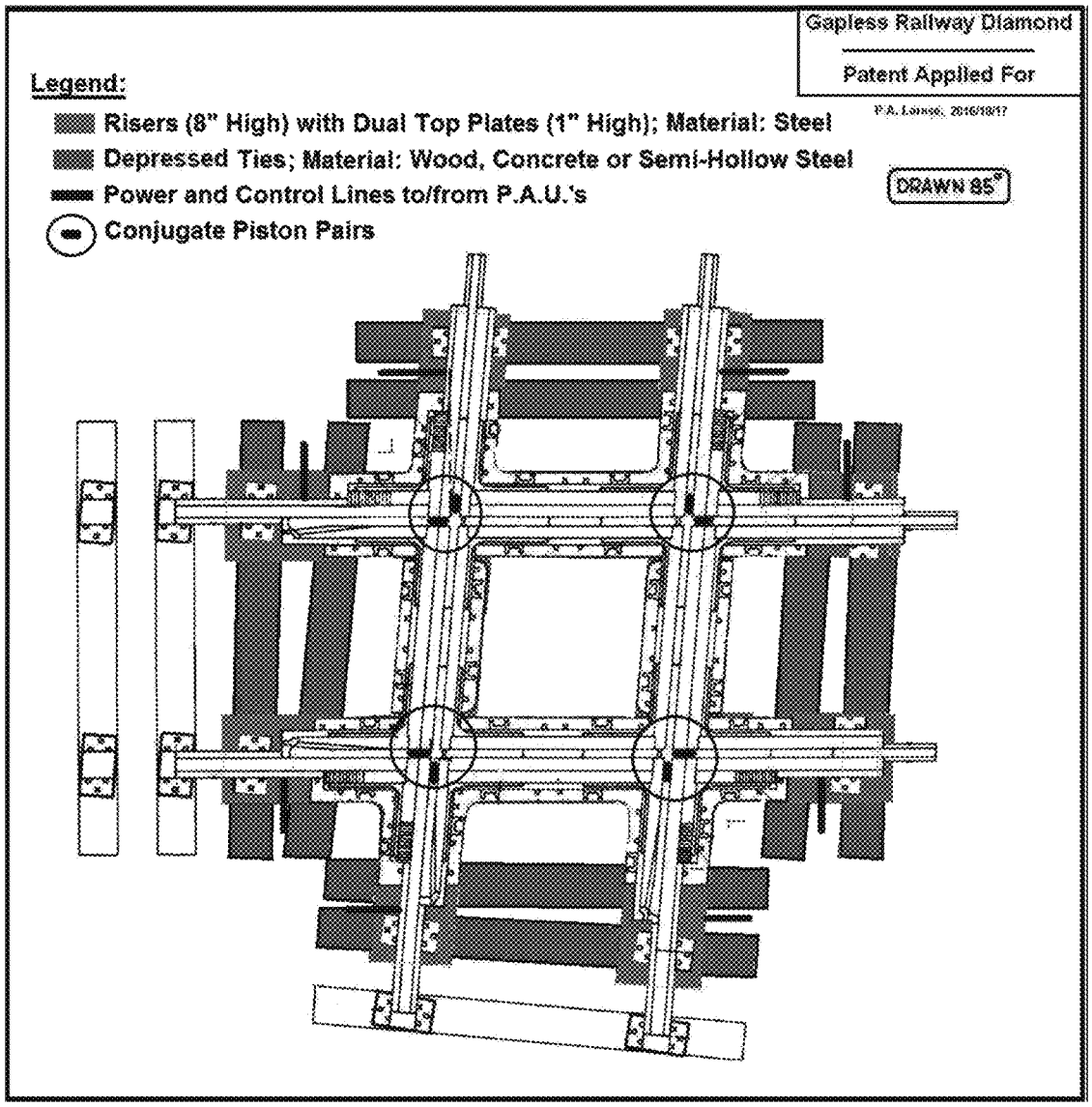

According to the embodiments depicted in FIGS. 6(*a*) and 6(*b*), conjugate pistons are located on each of the four frogs and provide the gap-bridging functionality for both shallow-angle and near-transverse intersections. These two types of intersections differ from each other by the configuration of their ties and by the form factor of their frogs that both affects differently their sub-frog area for maintenance purposes.

Thus, a "Gapless Railway Diamond" consists of four (4) inter-connected standard fixed geometry frogs that have been minimally modified to have a variable geometry capability.

According to an embodiment, the vertical space required for the PAU's is provided by risers. According to a further embodiment, risers are 8 inches high, 8 inches wide and of variable length ranging from 12 inches to 24 inches. Risers may be attached to the top of the 8-inch-high sub-ties that hold the gauge and that distribute the loads to the ballast and the sub-grade. The attachments are of the appropriate type depending on the material used for the ties, such as treated wood, pre-stressed concrete or hollow tubular square steel beams.

According to an embodiment, there are two main types of risers. First, "Frog Risers" provide physical separation between ties and frogs and can be either with or without "Piston Actuation Units" (PAU's) and their associated cradles. Second, "Rail Risers" provide physical separation between ties and trackwork in areas where there are no frogs and hence no PAU's.

The ties, alternatively referred to as sub-ties, are laid out in a manner similar to that of passive traditional diamonds, except for some minor modifications for large intersection angles. According to a further embodiment, their cross-section is 8 inches by 8 inches.

The Vertical Layers

According to an embodiment, the "Gapless Railway Diamond" has three super-imposed vertical layers. According to a further embodiment, these layers have an approximate overall height of up to 24 inches, as measured from the Top of Rail to the bottom of sub-ties, compared to the overall height of some 14 inches for a traditional fixed-geometry diamond.

According to an embodiment, these three layers include: a bottom layer comprised of the sub-ties that maintain the track gauge and distribute the vertical loads on the ballast and sub-grade; a middle layer comprised of the PAU's, the frog risers and rail risers which themselves are resting on the supporting sub-ties, thus providing the vertical space for the actuation mechanism; and the top layer comprised of the four modified frogs and the inter-connected rails, some of which rests on the frog risers, the rail risers and the piston cradles.

Sub-Track Requirements

The vertical dimension of the "Gapless Railway Diamond" embodiment has an overall height that is approximately 10 inches more than that of the traditional railway diamond and hence, that of the adjacent railway track structure.

According to an embodiment, resilient mats, although not essential to this invention, are used to build at minimal cost additional protection into the sub-grade to further reduce the possibility of future maintenance issues. This can readily be done during the field assembly phase and is further discussed in the section on "Energy Absorber Considerations" below.

The tie arrangement for the near-perpendicular configuration of the "Gapless Railway Diamond" is different from that of a traditional diamond where there are two side-by-side ties under each of the rails of the primary line (i.e. the one corresponding to the preponderant traffic). Also, in a traditional diamond, there is only a single tie at the mid-position between the frogs of the secondary line (i.e. the one corresponding to the lesser traffic). This is illustrated in FIGS. 2(*d*) and 2(*e*) where the tie arrangement is clearly visible.

According to an embodiment, the ties are arranged so as to facilitate access to the ballast for maintenance purposes by doing away with the tie across the center of the diamond without reducing the load bearing and gauge holding functions. The resulting layout consists of a set of two side-by-side ties and sub-ties arranged in groups of 3 feet 4 inches, 6 feet and 8 feet.

A System for Achieving Variable Diamond Geometry

According to an embodiment, several elements are required to achieve variable geometry in a high intersection angle railway frog and hence, in a railway diamond. These include gap-bridging pistons, PAU's with position sensors and drive clutches, controllers and their interfaces with the RTCS, specialized control systems, electrical or hydraulic power system components (depending on power option used), wayside panel for operation and maintenance, emergency use components, ties, risers, cradle and resilient components.

Embodiments may be adapted to accommodate situations where rail traffic is predominantly along one of the two lines. Examples of this include instances of short and infrequent transfers, in which case such traffic would not be benefiting from gap elimination and the usual mitigation techniques used for traditional diamonds may be required. This could include low speed operation across the diamond and would be acceptable if the high traffic line is not approaching saturation.

However, such embodiments would provide full gap-bridging capability on the high traffic line. Consequently, the requirements would be reduced since only half of the pistons and their respective drive mechanism would be required. In practice, the cost reduction would be minimal, as most of the costs are related to common overheads relating to the control and interface of the equipment with the Signal Control System (SCS).

The result is a variant of the "Full System" of the "Gapless Railway Diamond" and is known as a "Partial Gapless Railway Diamond". It corresponds to a "Half System" and this is further discussed in the "Single Route Variant" section below.

One advantage of using a simplified version of the "Gapless Railway Diamond" for this type of application would be that the low traffic line is not limited to 10 MPH, as in the case of an OWLS diamond, and there is no restriction relative to use by revenue passenger trains.

Functional Evaluation and Prototyping

Embodiments meet the functional specifications outlined in Table 1. Critical acceptance concerns included structural strength and safety, jam immunity from climatic conditions, vandalism and foreign objects, ice shearing capabilities, no mid-track components, reliability and minimal impact from technical incidents, connectivity with the RTCS and easy maintenance.

In order to illustrate the proposed "Gapless Railway Diamond" and its functioning, a 1:32 reduced scale working prototype has been developed. This model clearly shows the basic principles of operation, along with the risers and the depressed ties.

Core Components

This section and those that follow describe the essential components of the "Gapless Railway Diamond", as well as the operation of the variable geometry mechanism.

According to embodiments of the invention, the dimensions listed herein are illustrative and approximate, as final values, including tolerances, will depend on engineering and fabrication considerations.

As discussed previously in this document, the closing of flangeways cutting across active running surfaces is achieved by the extension of inclined pistons in said flangeways and these are operated by their respective Piston Actuation Units, herein referred to as PAU's. In a "Full System" where both intersecting lines have gapless functionality, there are two pistons and two PAU's on each of the four frogs. In a "Half System" where only the high traffic line has gapless functionality, there is only one piston and one PAU on each of the four frogs.

According to an embodiment, contrary to traditional diamonds, the frogs (and their approach rails) are not in direct contact with the ties. Rather, vertical risers are used to provide the 8 inch vertical separation required between the base of the frog plates and the top of the ties.

Consequently, the ballast bed is depressed in the area of the crossing and this is reflected in the vertical profile of the sub-grade.

This separation is necessary as a result of the PAU's being located under the frogs. This is achieved without compromising on the anchoring functions of the ballast on the track structure.

Each PAU fits into an enclosure known as a cradle. It has the same external height as the risers and serves to provide a reproducible positioning for a PAU when it is inserted after repairs or replacement during maintenance. According to a further embodiment, some of the risers are removable to facilitate this. In addition, it also serves a load bearing function that complements that of the risers.

Embodiments result in significant reductions in dynamic loadings at the crossover point of the two lines. Hence, the service life of the frogs, as well as that of the sub-grade and of the diamond itself, will be greatly extended, in addition to achieving reductions in the maintenance requirements and in the level of noise and ground vibrations.

According to an embodiment, the design can be grouped under three main categories. First, are modifications to the frogs in order to achieve their required variable geometry capabilities and to allow monitoring component status in real time. Second, is the fabrication of operating components, including pistons, PAU's, power drives, risers, indexers, clutches, configuration locks and sub-grade materials. Third, is the provision of controls and RTC interfaces, such as system controller, monitoring system, wayside control panel and emergency actuation system.

According to an embodiment, the control of the system is similar to that found in other instances where there is a variable configuration, such as with power turnouts. This requires interfacing with the RTC system for automatic operations and monitoring, as well as providing means for continued operations under anomalous conditions.

The proposed design meets all of the functional specifications outlined in Table 1. In particular, it permits fully automatic operation under harsh environmental conditions without the need for snow clearing devices or manual interventions.

The Risers

According to an embodiment, dimensionally, the risers are 8 inches high, with a width of 8 inches, giving them an 8 inches×8 inches cross-section; their lengths vary according to their specific location. Risers are made of steel, irrespective of the material used for the ties, and have an H-beam cross-section. According to a further embodiment, the minimum vertical structural load rating of individual risers is 27 tons.

According to embodiments of the invention, there are three types of risers. These are those with no PAU that only support straight rails and frog inter-connecting rails, those with a single PAU for use in near-transverse crossings as well as in the mid area of shallow angle crossings, i.e. on obtuse angle frogs, and those with a double PAU for use in end points of shallow angle crossings, i.e. on acute angle frogs.

According to an embodiment, the bases of the risers are bolted or anchored onto the sub-ties and their top itself is bolted or anchored into the base plates of the frogs. This avoids differential movements between track components that could possibly affect the relative piston extensions as loads proceed across the diamond.

According to a further embodiment, optional resilient pads could be positioned both at the top and bottom of the risers prior to bolting them or anchoring them in order to further reduce the dynamic loading on the sub-structure and hence, further reduce the maintenance requirements. Further out in the approach area where there are no risers, similar optional resilient pads could be used under the rails in the area adjacent to the diamond. According to an even further embodiment, resilient pads could also be used under the rails in the approach trackage to the diamond. This would complement the soil engineering practices that are used in addressing the structural issues when a "Gapless Railway Diamond" is first installed.

According to embodiments of the invention, the length of the risers may vary. According to an embodiment with short risers, the length of the risers is approximately 8 inches long. According to an embodiment with near-transverse diamonds, there are also long risers under the inter-frog segments, these being respectively 3-feet 4 inches and 6 feet in length.

Embodiments for Shallow-Angle Intersections

Figure 7A:
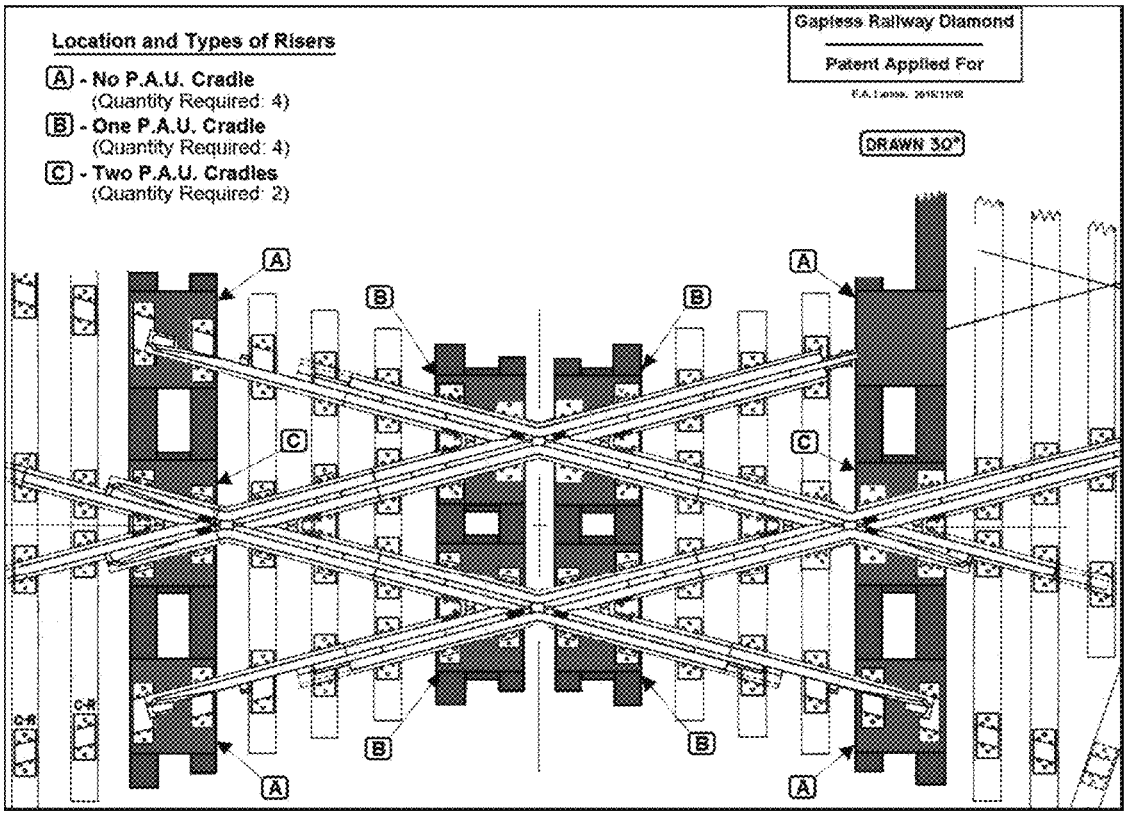
FIG. 7(*a*) shows the location and types of risers used in a 30° diamond according to an embodiment.
Figure 7B:
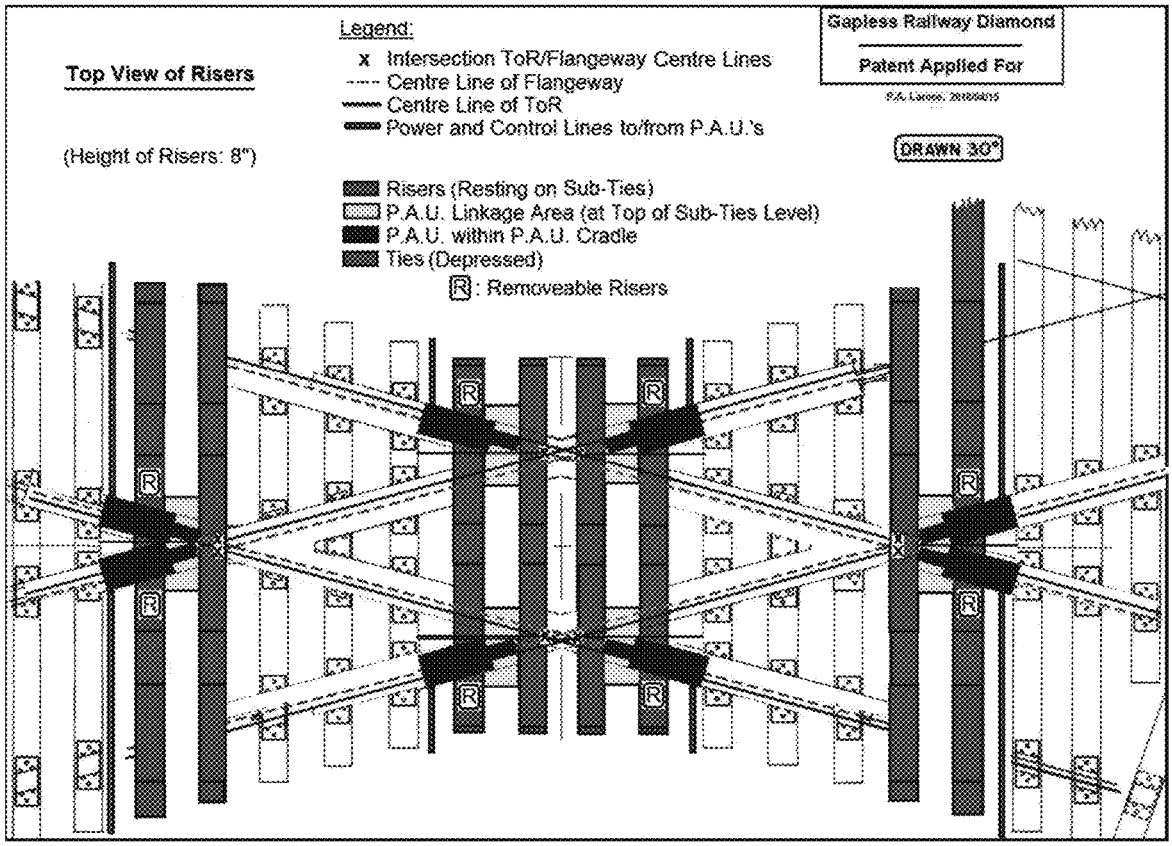

Embodiments configured for use with shallow-angle intersections are illustrated in FIGS. 7(*a*) and 7(*b*). According to the embodiment shown in FIG. 7(*a*), there are four sets of risers under the rails only and these do not have any operating mechanism. Thus, these four sets of risers are not associated with any frog or cradle. They are located at the extreme ends of the diamond and are shown as type "A" risers.

According to the embodiment shown in FIG. 7(*a*), there are also six sets of risers under the four frogs and all of these are used in conjunction with cradles. Four of these, labelled "B" in FIG. 7(*a*), are used with the two frogs located at the mid-position of the diamond and have well-separated cradles. These four sets are associated with obtuse angle frogs and their associated cradles.

The other two sets of risers in the embodiment, labelled "C" in FIG. 7(*a*), are used at each of the other two frogs located at the extreme ends of the diamond. These two sets have cradles that are in close proximity to each other and, as such, can only be accessed for maintenance purposes from the gauge side of the track. These two sets of risers are associated with acute angle frogs and their associated cradles.

According to an alternative embodiment shown in FIG. 7(*b*), some risers are removable to allow access to the PAU and its cradle during major maintenance operations. The locations of such risers are indicated with an "R" in FIG. 7(*b*).

Embodiments for Near-Transverse Intersections

Figure 8A:
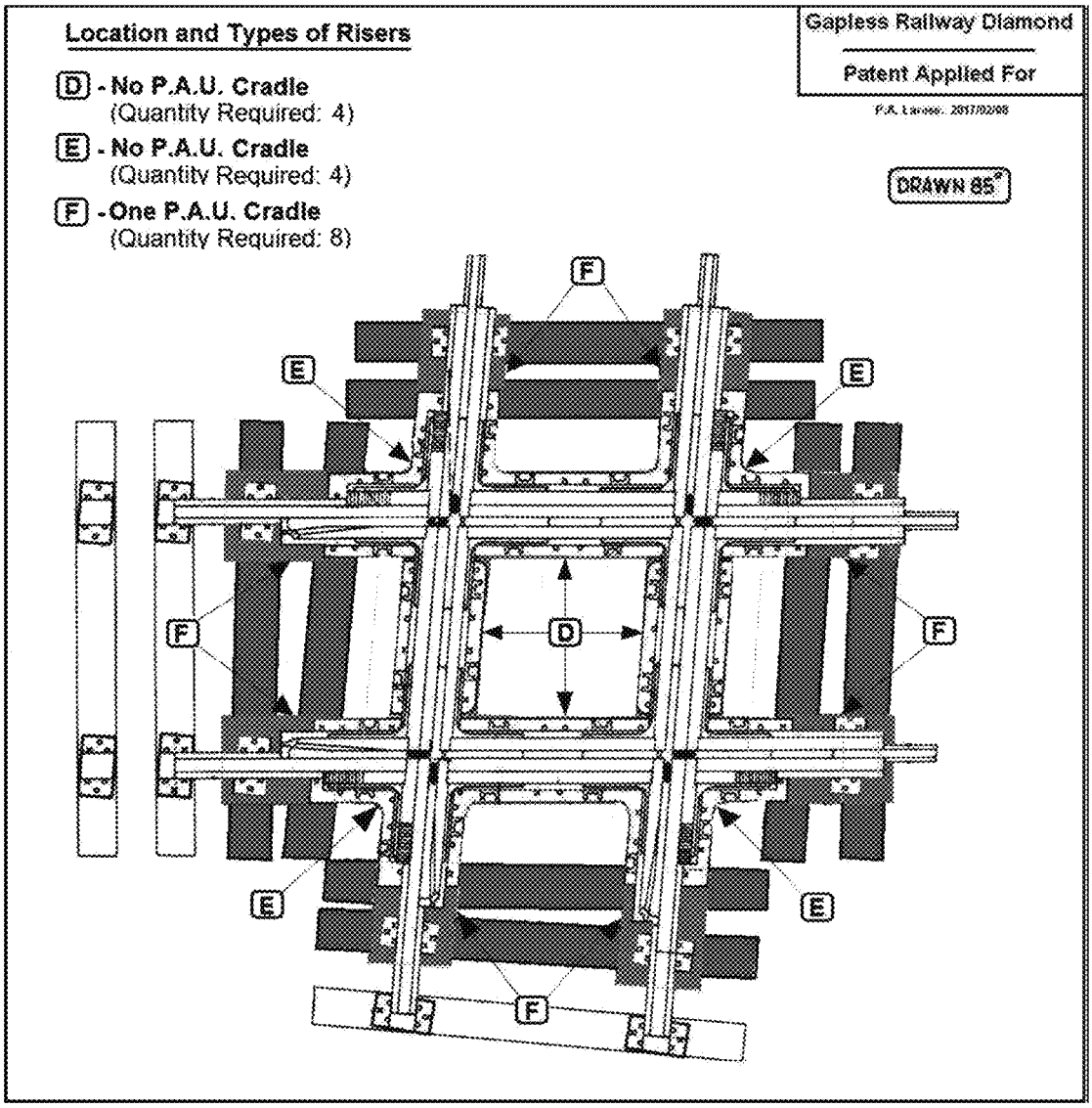
FIG. 8(*a*) shows the location and types of risers used in an 85° diamond according to an embodiment.
Figure 8B:
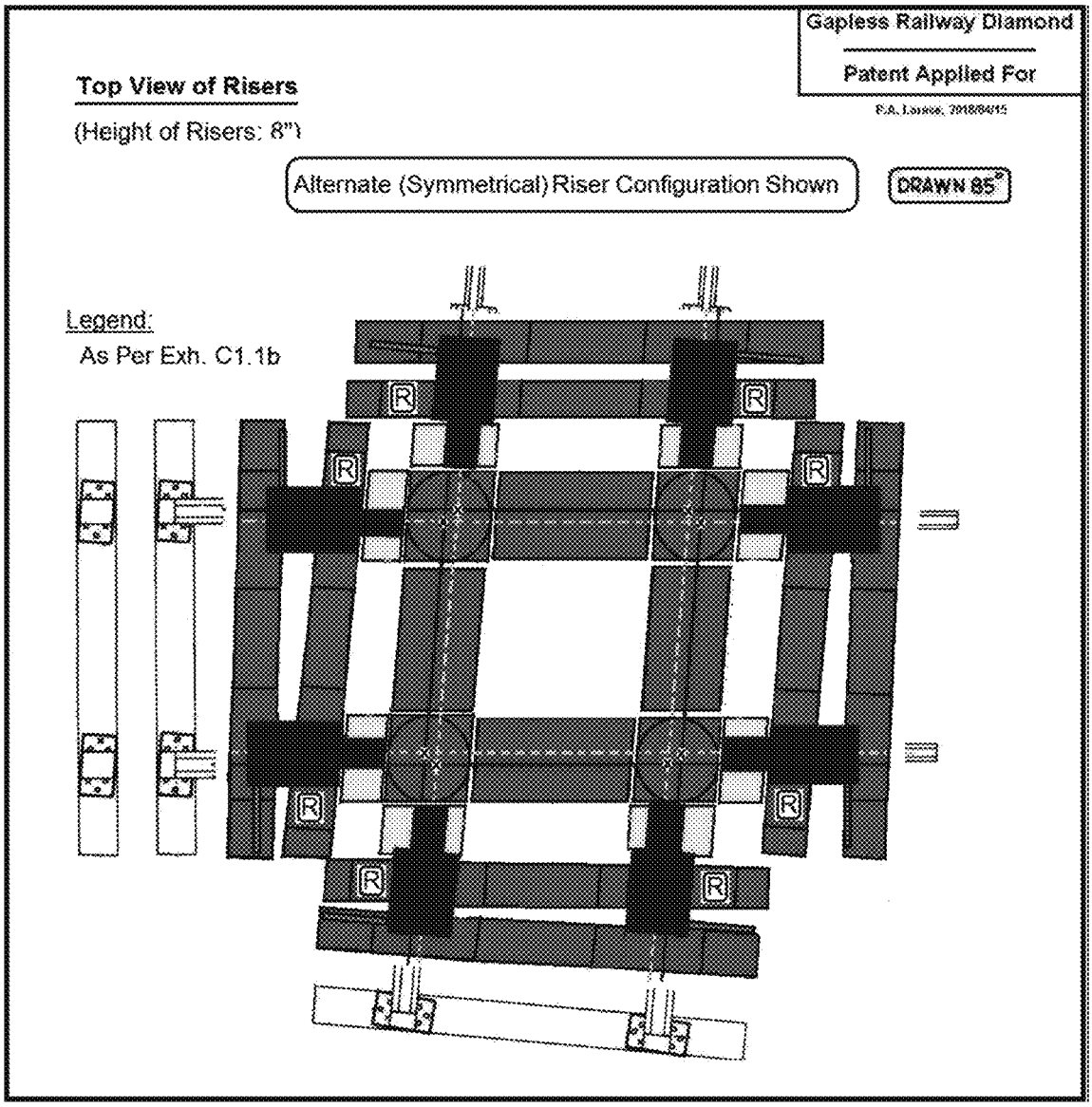

Embodiments configured for use with near-transverse intersections are illustrated in FIGS. 8(*a*) and 8(*b*). According to the embodiment shown in FIG. 8(*a*), the configuration has four sets of inter-frog risers under the rail segments between the frogs. These are not associated with an operating mechanism. Identified as type "D" risers in FIG. 8(*a*), these four are not associated with any frog or cradle. Instead, they are simply supporting the connecting running surface links between the frogs.

According to the embodiment shown in FIG. 8(*a*), there are also four sets of core risers under the central 16 inches of each of the four frogs. These core risers only provide support to the central core of a frog. Identified as type "E"

risers in FIG. 8(*a*), these four are associated with near-transverse angle frogs and have no associated cradle.

Lastly, the embodiment depicted in FIG. 8(*a*) has eight sets of risers that are associated with a cradle. These provide support for the external portions of the frogs linking with the intersecting lines as well as complement the load-bearing function provided by their cradles. Identified as type "F" risers in FIG. 8(*a*), these eight are associated with near-transverse angle frogs and their associated cradles.

According to an alternative embodiment shown in FIG. 8(*b*), some risers are removable to allow access to the PAU and its cradle during major maintenance operations. The locations of such risers are indicated with an "R" in FIG. 8(*b*).

The Piston Actuation Unit (PAU) Cradle

According to an embodiment, the main function of the PAU cradle is to provide a consistent reference point for the assembly of the PAU relative to its associated frog when it must be removed and subsequently reinserted for maintenance purposes. This ensures that the PAU is properly aligned relative to the frog and its associated piston axis after being reinserted.

According to an embodiment, there is one PAU cradle for each PAU and it is located in the vertical separation space located between the ties and the frogs. Thus, there are two cradles associated with each of the four frogs.

According to an embodiment, each cradle consists of ½ inch thick steel plates, arranged both vertically and horizontally, which provide the required load bearing capabilities. According to a further embodiment, cradles must have a minimum vertical (lateral) load rating of 27 tons, similar to that of the adjacent risers.

In addition to the vertical load applied onto it from the frog located above it, a cradle is also subjected to a lateral load resulting from the inclination angle of their piston relative to the frog plane. Based on considerations of the forces involved (see the section on "The Piston" below), the minimum horizontal (longitudinal) load rating for embodiments of the cradle is 15 tons.

Figure 9:
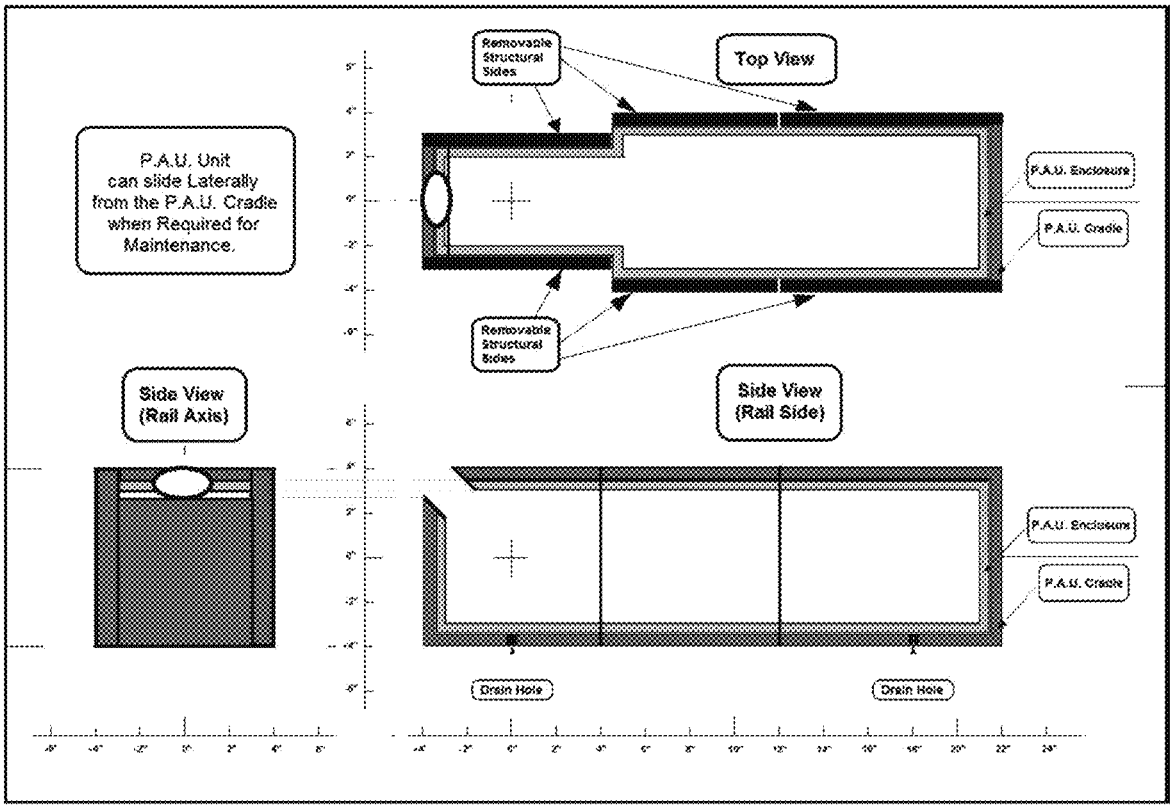
FIG. 9 shows the dimensions of the piston actuation unit cradle according to an embodiment.

According to an embodiment depicted in FIG. 9, the overall external length of the PAU cradle is 26 inches and its long dimension is parallel to the running surface above it, with its centerline directly under that of the associated flangeway. According to a further embodiment, the PAU can slide laterally from the PAU cradle when required for maintenance.

According to an embodiment, at the actuator end of the cradle, it has a representative external cross-section of 8 inches by 8 inches, giving a usable internal cross-section of 7 inches by 7 inches. At the piston end and for a distance of 8 inches, it is 8 inches high and 6 inches wide, giving it a usable internal cross-section of 7 inches high and 5 inches wide. This allows for the physical constraints associated with small intersection angles.

According to an embodiment, the cradle is bolted into the frog plates from above. This ensures that the Piston, when extended, maintains a constant extension relative to their adjacent running surfaces, irrespective of the flexing of the track structure as movements proceed across.

According to an embodiment, the cradle rests on sub-ties and on support pads, known as cradle pads, which are located in between the sub-ties, at the sub-tie elevation. These pads provide support over the extended length of the PAU and help avoid uneven load support and bending efforts within the PAU.

Figure 10:
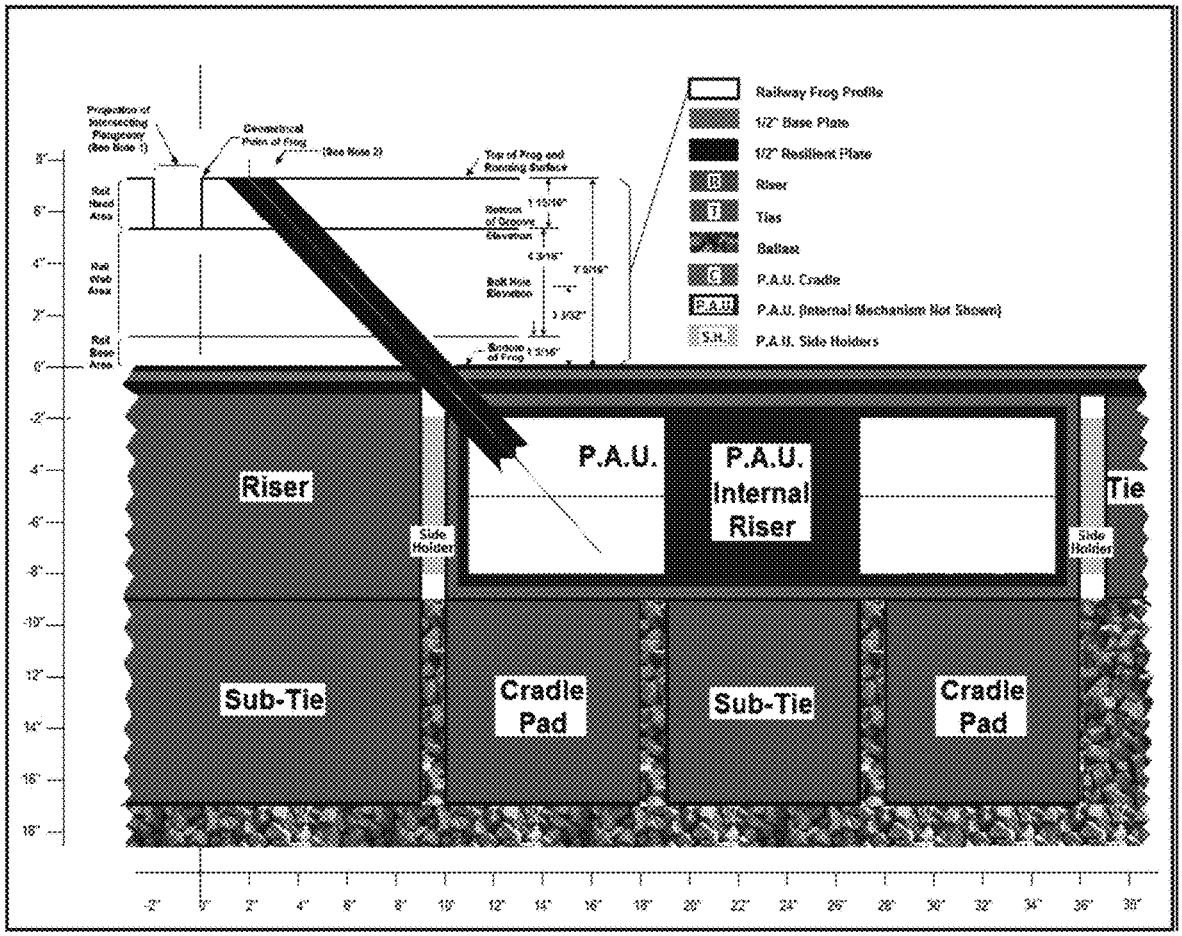
FIG. 10 shows a side view of the piston through the frog into the piston actuation unit according to an embodiment.

According to an embodiment depicted in FIG. 10, the lateral anchoring of the cradle required as a result of the longitudinal forces is achieved both through bolting to the frog plates and through side holders applied against adjacent ties and risers.

According to an embodiment, there are thus four essential functions for a PAU cradle. First, the PAU cradle provides reproducible "slide-in/slide-out" positioning and anchoring for the PAU relative to its operating piston within the frog above it, thus ensuring proper alignment of the two axes during maintenance removal and subsequent reinsertion operations. Secondly, the PAU cradle complements the structural functions of the adjoining risers, both vertically and laterally, by providing load-bearing functions and lateral restraints on the inclined piston, as well as transmitting the compressive forces from the live loads onto the ties below. Third, the PAU cradle secures the PAU to the frog plate located above the PAU cradle so that the extension of the piston relative to the adjacent running surface remains constant with the passage of wheelsets. Lastly, the PAU cradle serves as a protective enclosure for the PAU itself.

The Frog

Modern railway frogs are made using a manganese-steel alloy in order to achieve high impact resistance. In addition, they may also be subjected during fabrication to various hardening techniques, such as explosive hardening.

These metallurgical processes and hardening techniques can be used for the four frogs found in embodiments of the "Gapless Railway Diamond". These techniques maximize their durability and allow the frogs to be used in the conventional mode under exceptional circumstances where the pistons are inoperative, such as in instances of technical failures or during an extended power outage.

The essential element of this proposal is a new type of frog that was developed to achieve gapless functionality in a Railway Diamond and such frog is known as a "Gapless Fixed Point Railway Frog". According to an embodiment, there are six essential modifications that must be made on each of the four frogs and for each of the two intersecting routes, with these modifications being located in areas adjacent to the frog point. First, there is one 1% inch diameter bore along a slant relative to the frog plane corresponding to the value of the piston axis inclination angle away from the point of the frog, for the insertion of the piston sleeve, starting from the mid-width position of the flangeway and at the distance from the virtual flangeway center line intersection point specified below in this section, all the way through to the base of the frog. Second, there is one vertical ½ inch diameter drainage channel under the piston bore. Third, there is one groove that is 5/16 inch wide and 1 inch deep on the upper portion of the main bore, to allow the piston stiffener to slide through. Fourth, there is one 5/16 inch diameter cylindrical bore across the full length of the inclined piston cylinder in the frog, parallel to and below the main bore and used for the ¼ inch diameter rod of the piston lower indexing system. Fifth, there is, for the purpose of the upper indexer, one ½ inch diameter near-horizontal bore in the upper area of the frog, some ½ inch below the base of the flangeway, preferably on the field side of the flangeway, approximately bisecting the intersecting lines, located some 2 inches from the top edge of the piston stiffener groove, away from the frog point. Sixth and lastly, there is an enclosure for piston position upper indexing purposes that is some 1 inch deep, some 4 inches long and some 1 inch wide and that is machined below the flangeway, oriented away from the frog point and starting some ½" from the top edge of the piston stiffener groove and with a vertical bore of some 1" diameter down towards the piston bore. Said enclosure requires the fabrication of a matched removable capping to close off and seal its top face. These last two modifications are discussed in the section below entitled "Piston Position Indexing".

According to an embodiment, there are no compressive surfaces in the design of the moving part arrangement required to achieve the variable geometry. Consequently, the design is immune to jamming as a result of snow, freezing rain and loose foreign materials.

Embodiments of the "Gapless Railway Diamond" can be used in conjunction with various types of frogs commonly used on main line trackage, including solid manganese frogs, rail-bound steel manganese frogs, reversible inserts frogs and lap beams frogs, among others.

Irrespective of the type of frog used, embodiments of the invention should have a minimum separation of 1 inch between the outside walls of the piston cylinders and those of the bolt holes that are required when a frog is bolted to the adjacent trackage. This however will not be an issue with frogs that are welded directly to the adjacent running rails.

Figure 11A:
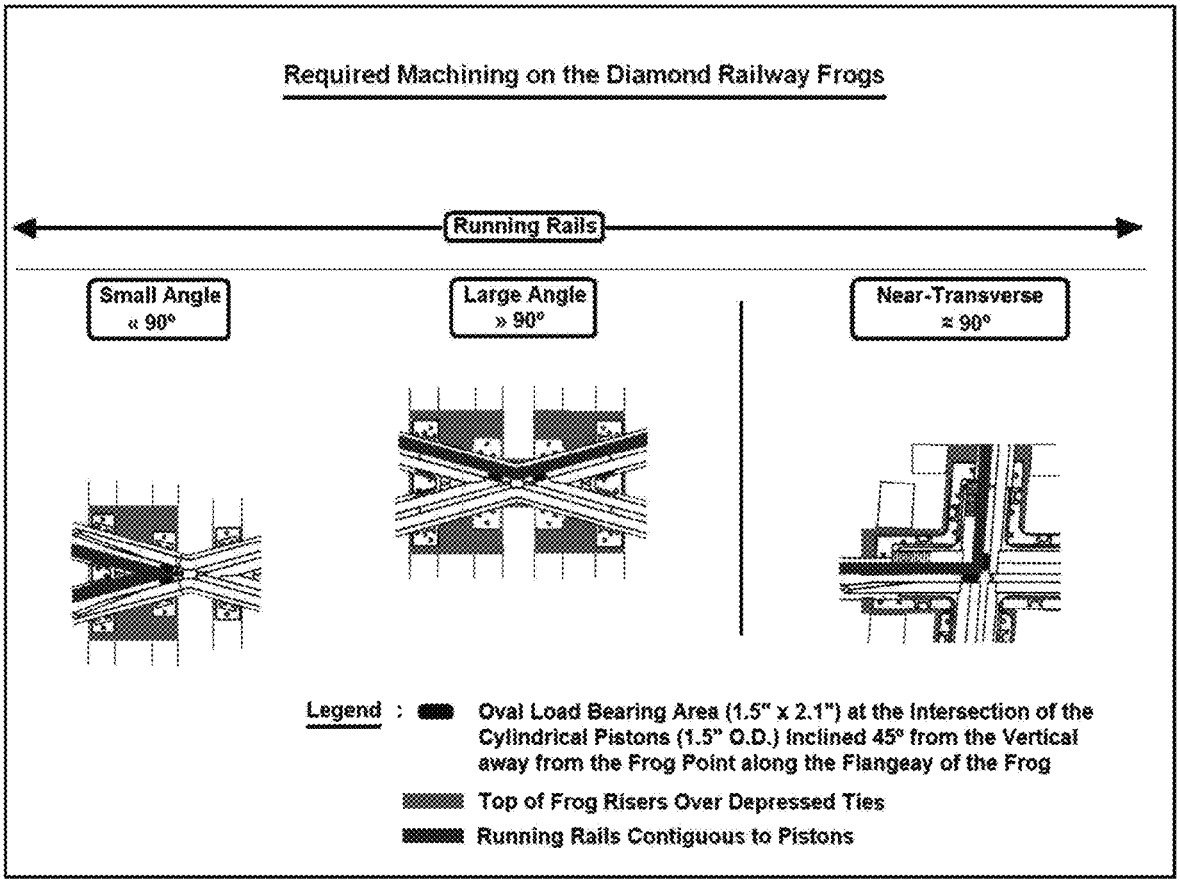
FIG. 11(*a*) shows a top view of three configurations of diamond frogs according to an embodiment.
Figure 11B:
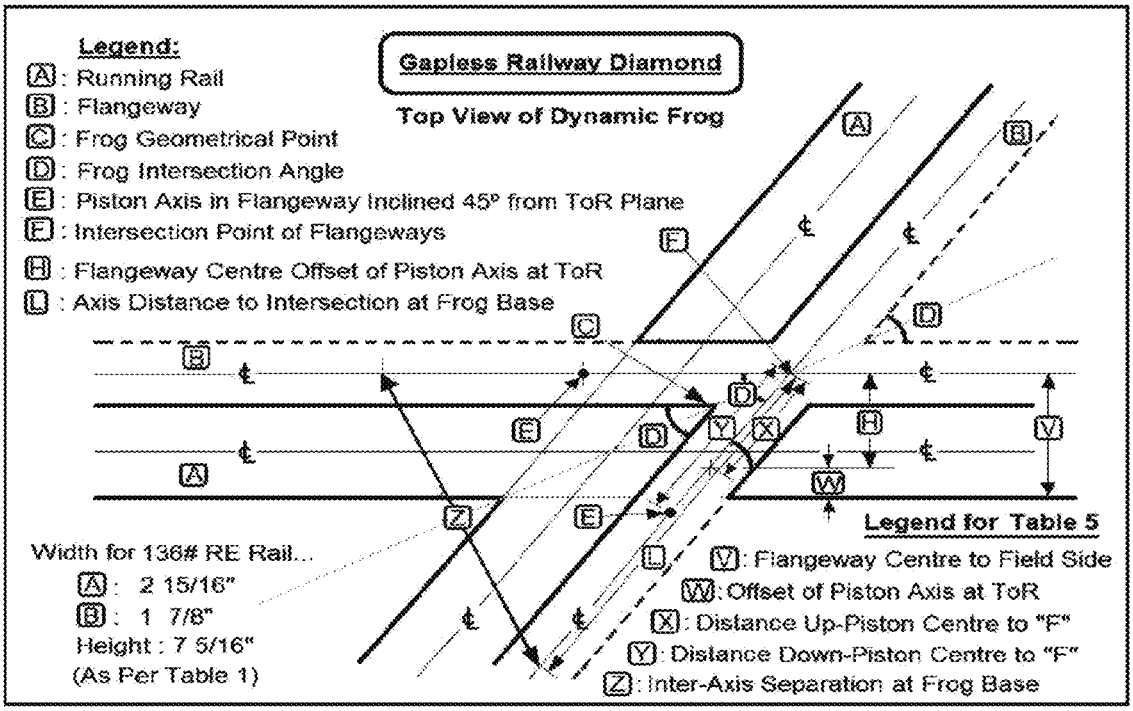
Figure 11C:
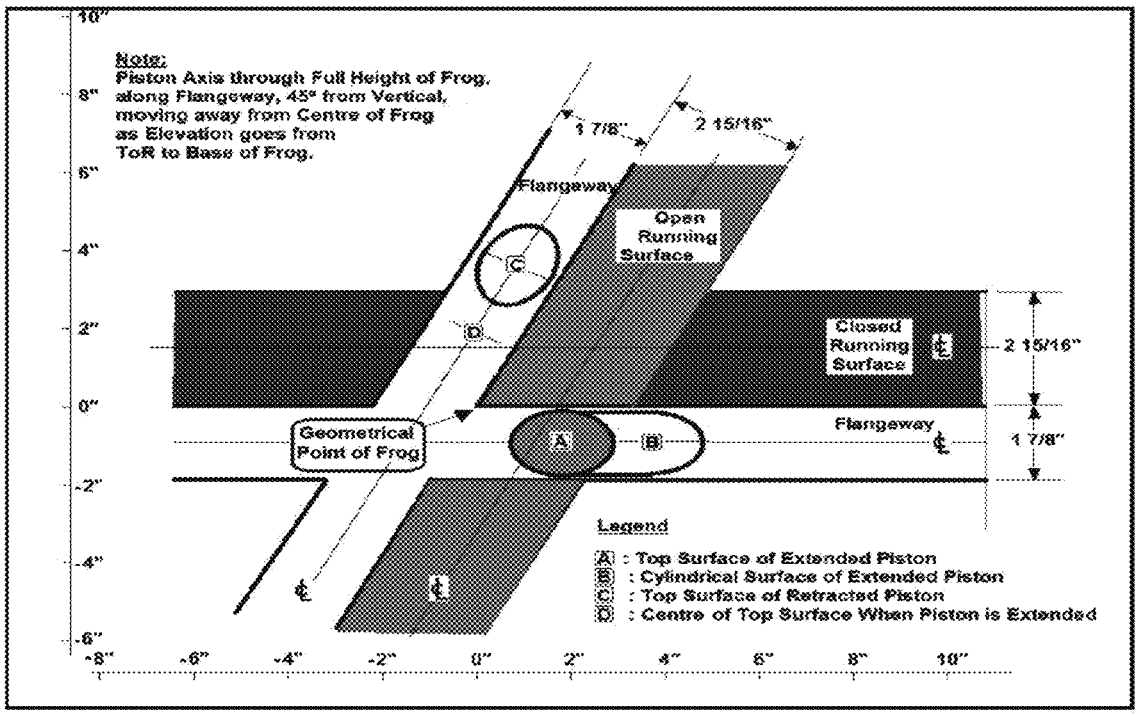

FIG. 11(*a*) illustrates the three possible frog configurations found in diamonds that embodiments of the invention may be used with. Each of these configurations determines the axis separation on the underside of the frog which itself is a function of the intersection angle.

The dimensional relationships are illustrated in FIG. 11(*b*) where the axis offset at top is denoted as "Y" and the inter-axis spacing between conjugate pairs of piston axis on the bottom face of the frogs is denoted as "Z".

Key values of embodiments are summarized in Table 3 below and illustrate how the position of the piston axis from the intersecting point of the flangeways varies with the angle of intersection. This relationship is essential for fabrication purposes.

TABLE 3

Dependency of Piston Position on Intersection Angle

| Intersection Angles | Distance "Y" from Intersecting Flangeway Centre Lines (inches) |
|---|---|
| 30° or 150° | 7.63 |
| 45° or 135° | 5.94 |
| 60° or 120° | 5.20 |
| 75° or 105° | 4.85 |
| 90° | 4.75 |

The Piston

According to an embodiment, the pistons within a "Gapless Fixed Point Railway Frog" are located at the mid-width position of each of the flangeways and provide the actual bridging over the intersecting flangeway gaps. This configuration does not have compressive surfaces and hence, is not susceptible to problems associated with snow and freezing rain precipitations. Furthermore, it covers the full range of intersection angles of interest in a railway diamond.

According to an embodiment in normal operation, those pistons located in the flangeways of the inactive route are fully extended and their top faces are at the Top of Rail (TOR) elevation. This effectively closes the flangeways that are being intersected, thereby providing quasi-continuous running surfaces along the active route and preventing wheel drops over the intersecting flangeways.

Concurrently, in the case of a "Full System" configuration where both intersecting lines have the gapless functionality, the conjugate pistons in the flangeway of the active route are fully retracted into the body of the frogs, thereby allowing unobstructed clearances for the wheel flanges along said active route. In the case of a "Half System" configuration where only one line has gapless functionality, there is no conjugate piston.

This is illustrated in FIG. 11(*c*). Maximum benefits resulting from the elimination of the gaps will be achieved in instances of perpendicular or near-perpendicular intersection angles.

Figure 12A:
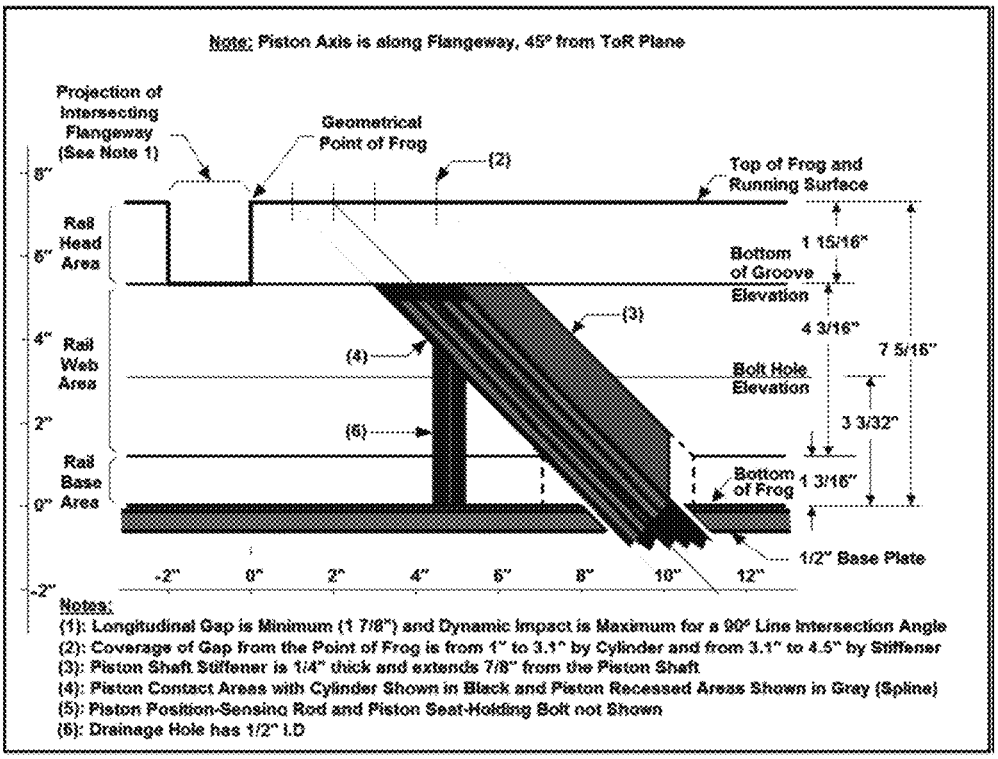
FIG. 12(*a*) shows the side view of the gapless frog rail with the piston retracted, according to an embodiment.
Figure 12B:
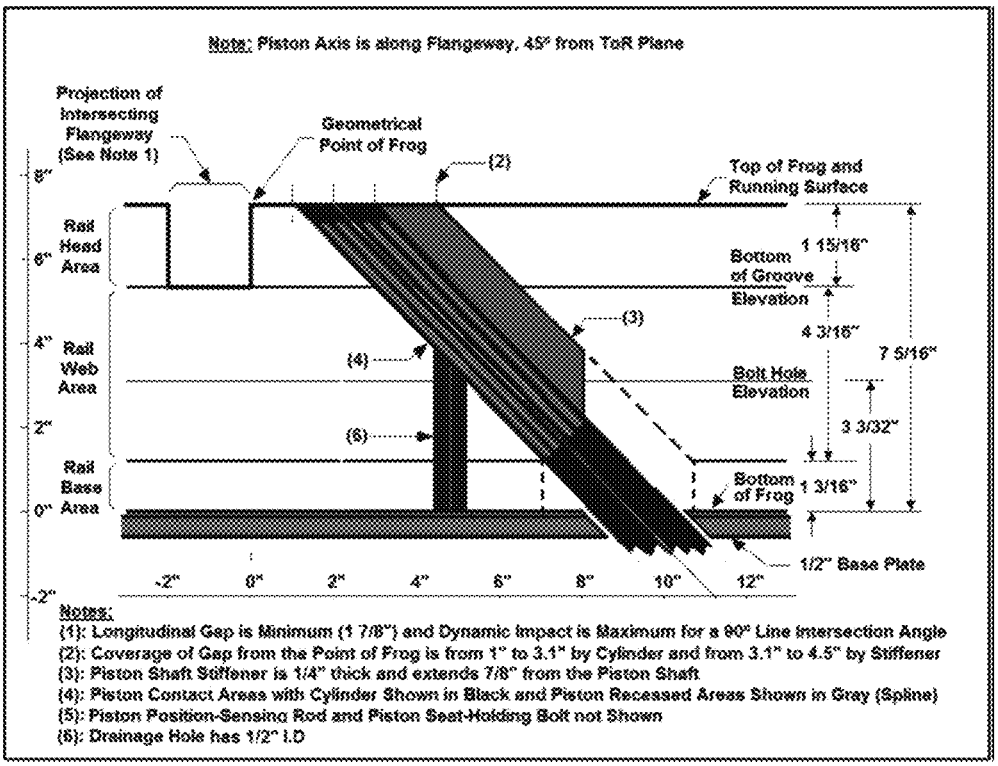

A side view of an embodiment of the piston within the body of the frog in the retracted and extended positions is shown respectively in FIGS. 12(*a*) and 12(*b*).

According to an embodiment, the design load for each piston is 27 tons in the vertical direction. This value includes a safety factor of 50% over the maximum permissible wheel load of 17.875 tons (i.e. 35.75 tons per axle for a four-axle load of 143 tons or 286,000 pounds). Embodiments with a higher piston rating will provide an increased safety factor.

According to embodiments with an axis inclination and as a result of this axis inclination, there is an axial compressive load of 19.1 tons on the shaft, which also includes the 50% safety factor. This value was rounded up to 20 tons for the remainder of this specification.

In addition, there is a lateral force that is applied off the Piston axis as a result of its inclination angle occurring when it is in its extended position and a load is supported, creating a rotational moment over a 3 inches distance. According to an embodiment, the resulting bending moment, including the safety factor, is estimated to be up to 10,000 ft-pounds.

In order to address this, a steel plate is welded to the top portion of each piston shaft in order to act as a side stiffener, thus reinforcing it against the lateral loading and flexing when extended. According to an embodiment, this effectively turns the 1½ inch diameter piston into the equivalent of a steel beam having a 2⅜ inches lateral dimension.

According to an embodiment, the stiffener is ¼ inch thick, 7½ inches long and is mounted on the upper side of the piston cylinder. Prior to welding to the piston, it is nominally 1 inch wide. After being inserted in the ⅛ inch deep piston shaft keyway and welded to the piston shaft, it then protrudes ⅞ inch from the cylindrical wall of the piston and freely slides within the 5/16 inch wide slot machined into the frog.

According to an embodiment, the piston slides from within a sleeve having nominal diameters of 1½ inch internally and 1% inch externally, giving it a wall thickness of ⅛ inch. There is a cut ½ inch wide on the upper portion of the sleeve along its whole length (relative to the piston shaft) in order to allow for stiffener clearance.

This sleeve is effectively a sacrificial component that is fixed within the core of the frog, yet is easily removable when required to address wear and tolerance issues during normal maintenance. As a result, the core of the frog itself is not subjected to any wear resulting from the operation of the piston.

Figure 13A:
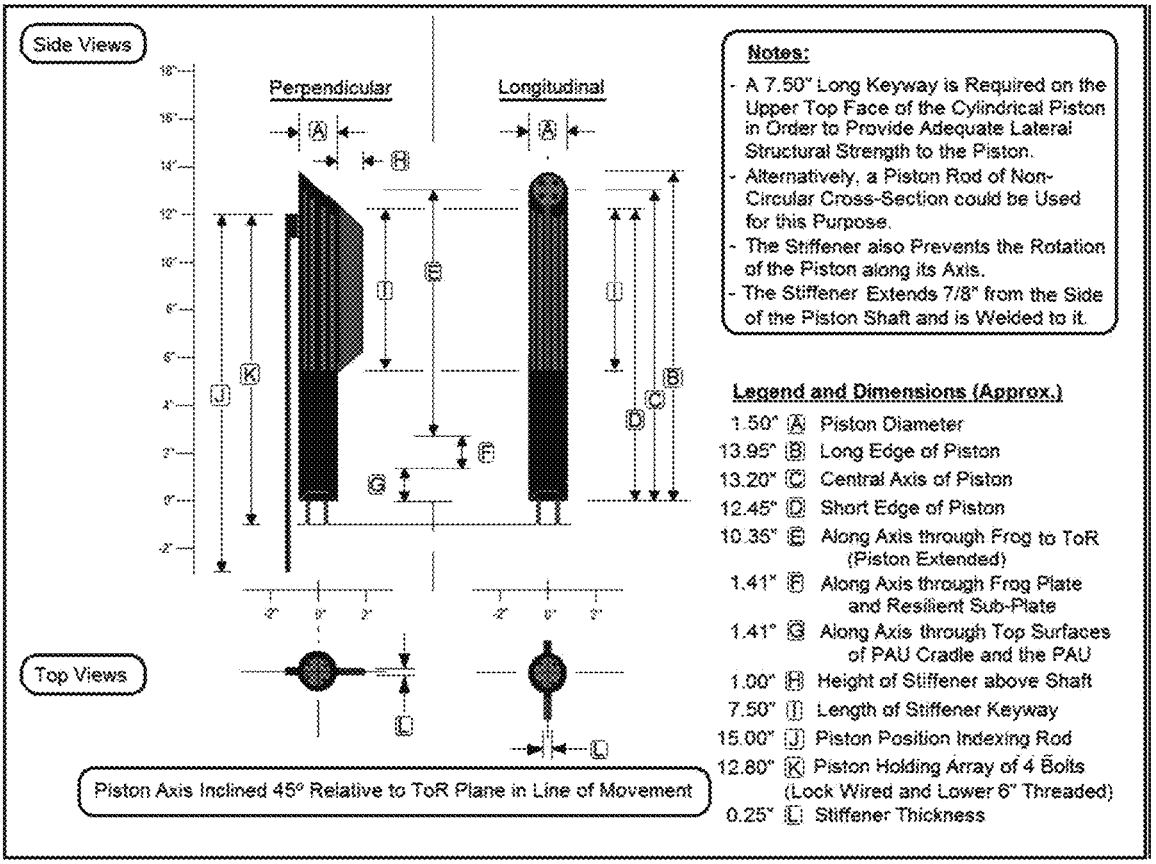
FIG. 13(*a*) shows the dimensional specifications of the piston, according to an embodiment.
Figure 13B:
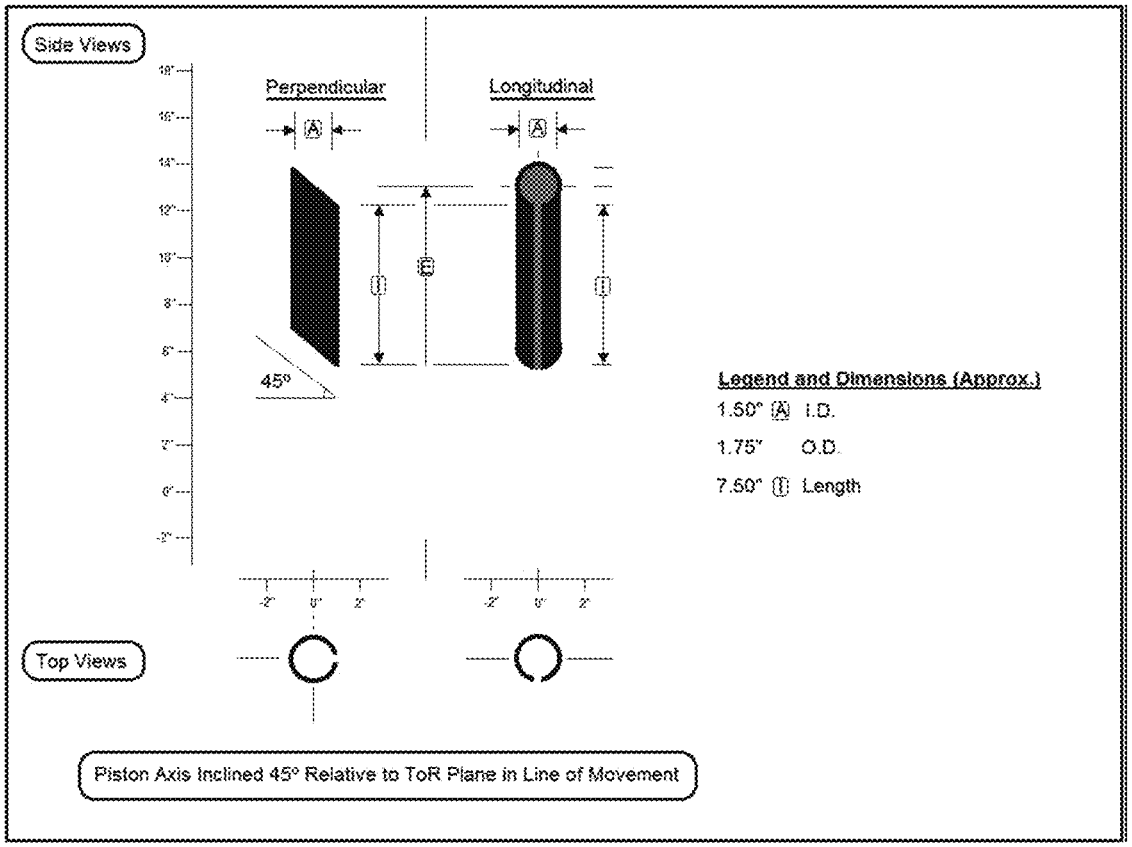
Figure 13C:
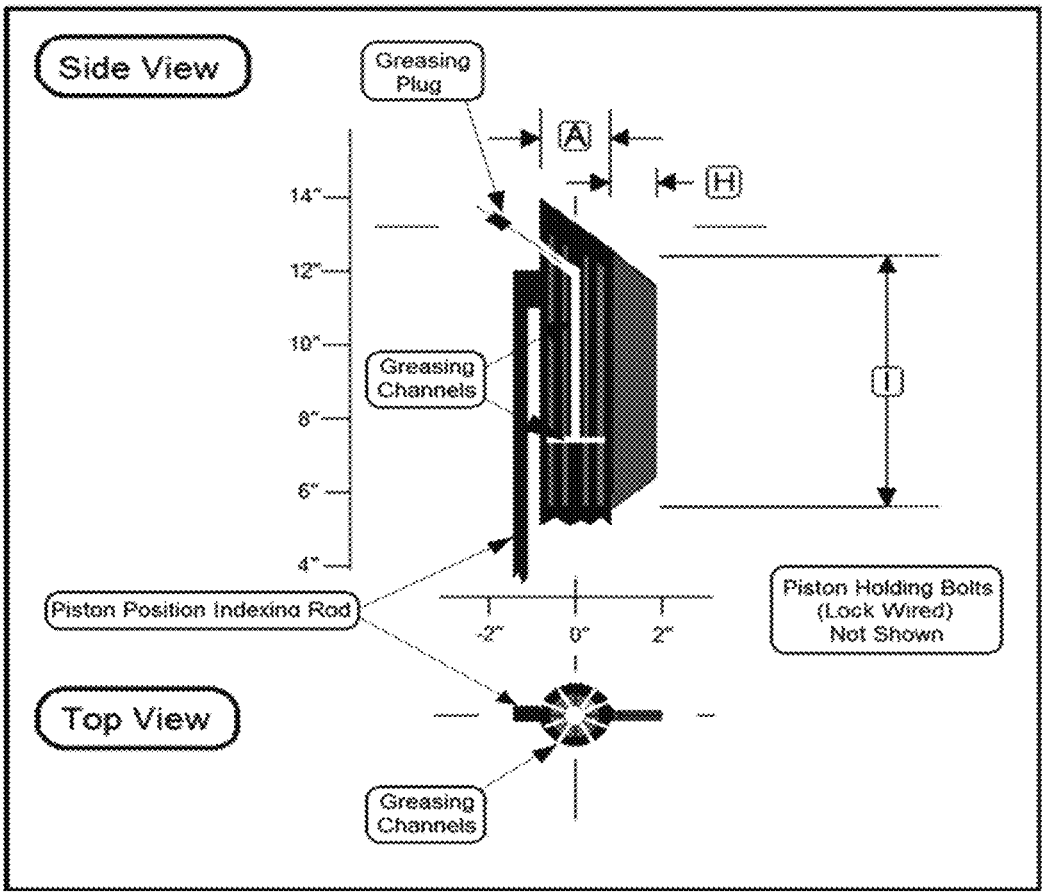

The dimensions, along with those of other components related to the variable geometry of the frog, are summarized in Table 4 and illustrated in embodiments shown in FIGS. 13(*a*), 13(*b*), and 13(*c*), with the embodiment depicted in FIG. 13(*c*) further comprising greasing channels and a greasing plug.

TABLE 04

| Nominal Dimensions of Essential Components | | | |
|---|---|---|---|
| ITEMS | Total Qty of Items | per item | Values |
| FROGS | 4 | | |
| FROG MODIFICATIONS | | | |
| Main bore | | 2 | 1 ¾" i.d. |
| Drain bore | | 2 | ½" i.d. |
| Upper grooves | | 2 | 5/16" |
| Width | | | |
| Depth | | | 1" |
| Indexing rod bores | | 2 | 5/16" i.d. |
| Diam. | | | |
| Length | | | Full |
| Lateral sensor bores | | 2 | 5/16" i.d. |
| Diam. | | | Variable |
| Length | | | |
| PISTONS | 8 | | |
| Diam. | | | 1 ½" |
| Length(central) | | | 13.2" |
| Length(long edge) | | | 13.95" |
| Bolt bores | | 4 | 5/16" i.d. |
| Diam. | | | |
| Length | | | Full |
| Stiffener keyways | | 1 | 7 ½" |
| Length | | | |
| Width | | | ¼" |
| Depth | | | ⅛" |
| Slider grooves | | 8 | 7 ½" |
| Length (average) | | | ⅜" |
| Width | | | |
| Depth | | | ⅛" |
| PISTON SLEEVES | 8 | 1 | |
| Internal | | | 1 ½" i.d. |
| External | | | 1 ¾" o.d. |
| Central length | | | 7 ¼" |
| PISTON STIFFENERS | 8 | 1 | |
| Long length (at base) | | | 7 ½" |
| Width | | | 1" |
| Thickness | | | ¼" |
| PISTON INDEXING RODS | 8 | 1 | |
| Diam. | | | ¼" o.d. |
| Length | | | 15" |
| PISTON BOLTS | 32 | 4 | |
| Diam. | | | ¼" o.d. |
| Length | | | 12.8" |
| CRADLE | 8 | 1 | |
| External height | | | 8" |
| External length | | | 26" |
| External width (with face plates) | | | 8" |
| Internal height | | | 7" |
| Internal length | | | 25" |
| Internal width | | | 7" |
| Side plate length (piston end) | | | 8" |
| Side plate length (motor end) | | | 18" |
| P.A.U. | 8 | 1 | |
| External height | | | 6 ⅞" |
| External length | | | 24 ⅞" |
| External width (piston end) | | | 4 ⅞" |
| External width (motor end) | | | 6 ⅞" |

According to an embodiment, the piston consists of a cylindrical rolled steel rod having a nominal diameter of 1½ inch and a length of 13.2 inches along its central axis (and 13.95 inches along its longest edge). It is inclined relative to the frog plane by the value of the piston axis inclination angle and its center is located at the mid-width position of the flangeway. The possibility of using a rod of rectangular cross-section was rejected on the basis of the higher cost for machining a non-circular cross-section in the hardened steel of a frog. In addition, there was concern about the issue of stress concentrations in a non-circular piston wall. For these reasons, a circular cross-section was retained as it offered a comparable structural advantage while facilitating the machining and the maintenance processes.

Figure 14:
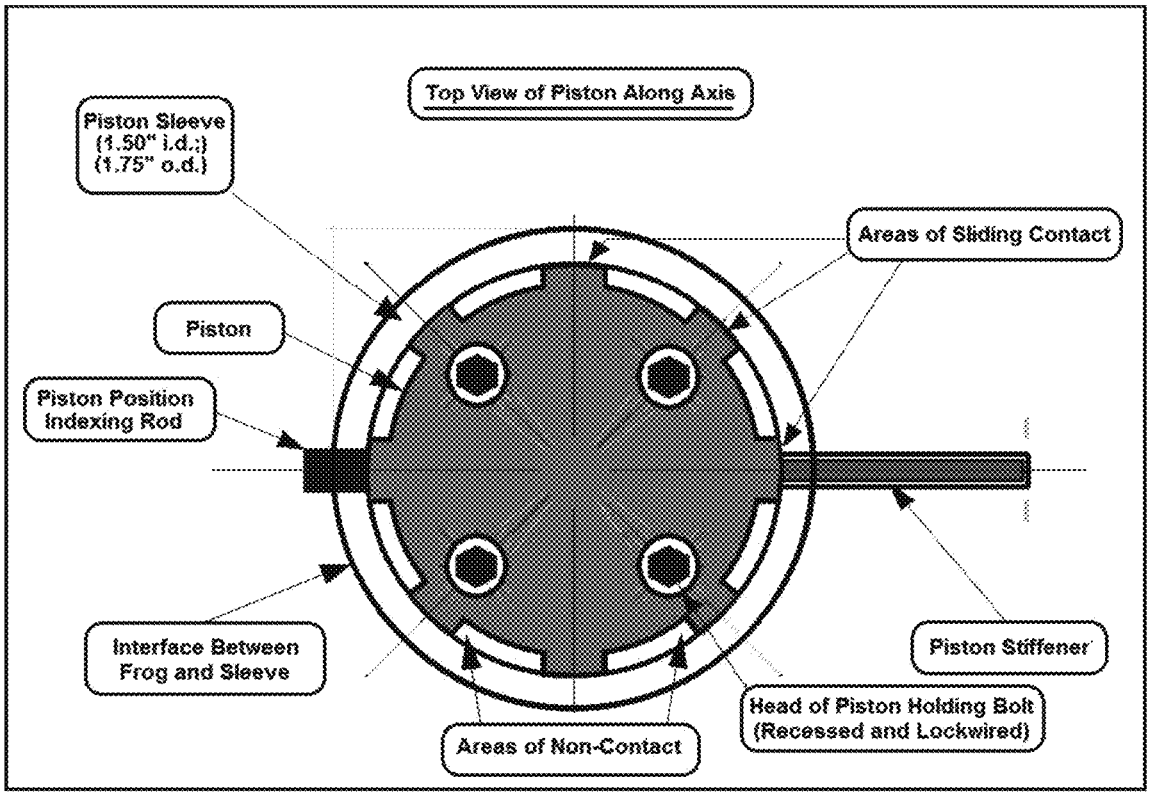
FIG. 14 shows a close-up top axial view of the piston, according to an embodiment.

According to a further embodiment, the piston is physically connected to the PAU by a component known as a "Piston Seat" through four (4) equally spaced ¼ inch diameter bolts 12.8 inches long arranged in a circular array around the piston shaft. These bolts run axially through four 5/16 inch diameter bores along the full length of the piston and they thread into the PAU seat. They attach the piston to its PAU support, yet allow for quick disassembly when required for maintenance purposes. This is illustrated in FIG. 14. Other means of securing are possible.

According to a further embodiment, the heads of these bolts are recessed within the top of the piston in order not to interfere with the passing wheelsets. They are held secured through a combination of lock-washers and lock-wires so as to prevent gradual loosening over time.

According to an embodiment and for control purposes, the piston position within the frog is monitored through a position sensing rod that is attached to the top of the piston and that runs through a separate bore that is parallel to, and located below, the piston cylinder and leading to a lower indexer located in the PAU.

The piston position indexer directly measures the position of the piston head. During the assembly process, it is attached to the piston, which is then anchored to the Piston seat of the PAU, as described below in the section on "Piston Position Indexing" where an additional indexing system, located in the upper portion of the frog, is also discussed.

In light of the system having movable components, the issue of climatic immunity was given particular attention because the device had to be suitable for unattended operations in remote locations and without track heaters, as per the discussion under the "Requirements and Specifications" section above.

Embodiments include steps to minimize the contact areas between moving surfaces, in this case, the pistons and the sleeve walls within the frogs. According to a further embodiment, the pattern on the sides of the piston is similar to that of a spline pattern used to transmit rotational power to or from a shaft.

This reduces the metal-to-metal contact area, without compromising on structural considerations. This is to maintain good sliding of the piston under ice accumulation conditions by facilitating the process of ice shearing taking place upon the retraction of the piston. An embodiment of this aspect of protection against icing effects can be seen in FIG. 14.

According to an embodiment, the piston shafts, particularly in the area of their sliders, should be lubricated during regular inspections with silicone-based grease, particularly during cold weather periods. This is to further minimize the risk of ice binding to the bare metal of the piston shafts and interfering with their free movement.

Given that the pistons extend or retract under a no-load condition in embodiments of the invention, the purpose of this lubrication is not to reduce friction during their travel, but to prevent solid ice binding to the bare metal of the shafts when extended. This lubrication also ensures that any ice accumulation can be easily sheared off when the pistons are retracted within the frogs.

In order to further reduce the possibility of ice build-up on the exposed components of embodiments of the invention, the design calls for the pistons to be fully retracted into the body of their frogs after the completion of each clearance. This corresponds to the "Stand-By Mode" position that was described in the "Specifics of the Design" section above.

Thus, the fabrication of each of the pistons required for the four modified frogs in the embodiments of the invention requires several steps. First, is the cutting of the cylindrical piston shaft segments, each one some 14 inches in length, using a 1½ inch diameter steel rod stock. Second, is the machining of a piston "seat" at the lower end of the piston shaft in order to mate the piston with its PAU. Third, is the machining of four (4) equally spaced 5/16 inch diameter bores along the full length of the piston and ½ inches from its axis for the ¼ inch diameter piston retaining bolts. Fourth, is the cutting of a keyway ¼ inches wide, ⅛ inch deep and 7½ inches long starting at the top of the piston shaft on its upper front face, i.e. on the short side of the piston shaft for holding a welded ¼ inch thick steel piston stiffener that can also provide for the piston indexing function (either through a geared or sliding indexer). Fifth, is the machining of slider grooves, ⅛ inch deep and ⅜ inch wide, of variable lengths averaging 7½ inches on either side of the central keyway and with equal angular spacing for minimizing the effects of frost accumulation at the piston-sleeve interface. Sixth, is the cutting of the top face of the piston along an angle corresponding to the value of the piston axis inclination angle relative to the frog plane. Seventh, is the fabrication of a piston position indexing rod having a length of approximately 15 inches and consisting of Teflon coated steel to minimize the effects of freezing rain, along with a mounting bracket to link the long side of the piston shaft to the piston position indexing system. Lastly, is the fabrication of the piston sleeve, with a ½ inch wide slit along its upper edge.

The Ties (or Sub-Ties)

According to an embodiment, the ties or sub-ties used for the "Gapless Railway Diamond" have an 8 inches by 8 inches cross-section. This is different from the 7 inches by 8 inches or 7 inches by 9 inches cross-sections generally found on ties used on main line trackage. This invention however is not critically dependent on the specific cross-section dimensions of the ties.

These dimensions provide embodiments of the "Gapless Railway Diamond" with increased stability, particularly in the central area of the diamond, where the cumulative tonnage of both lines is carried. The specific tie arrangement used in embodiments depends on the line intersection angle, as indicated in FIGS. 7(*b*) and 8(*b*).

Materials for these embodiments may be either hard wood, pre-stressed concrete or hollow steel. According to a further embodiment, only elastic rail clamps are used. If wood ties are selected, the anchoring to the ties should be done using lag bolts and elastic fasteners in order to achieve proper resiliency.

Although dynamic forces will be markedly reduced, the central area of the crossing will continue to be subjected to the joint traffic of both intersecting lines. Consequently, the wear in this area will occur at a faster rate than on either of the two intersecting lines and ease of access is designed into embodiments of the system in order to facilitate the required maintenance tasks. Proper access to the sub-grade will therefore expedite maintenance, further improving the advantages and economic benefits of this invention.

According to an embodiment, ease of access for maintenance purposes was accomplished by eliminating the central single tie in the near-transverse intersections and providing the required gauge-maintaining function through the use of frog plates and double ties on the secondary line as well as on the primary one.

Although not essential to achieve the functionality of the "Gapless Railway Diamond", the use of granitic ballast and resilient components, in conjunction with good drainage, will optimize the quality of the construction, will help to reduce the maintenance requirements over the long term and increase the overall service life of the sub-grade, thus further reducing the overall ownership cost.

For embodiments used with shallow angle diamonds, the tie layout is illustrated in FIG. 6(*a*), as well as in FIGS. 7(*a*) and 7(*b*).

For near-transverse diamonds, the gauge maintaining function is achieved in the same manner for both lines, namely by the rigid frog plates and by the supporting side-by-side ties. This is different from the current practices where an asymmetrical tie arrangement is used. The proposed arrangement, although not essential to achieve the intended functionality, will facilitate the maintenance of the central area of the diamond without in any way affecting its structural engineering. For such intersections, the tie arrangement is illustrated in FIG. 6(*b*), as well as in FIGS. 8(*a*) and 8(*b*).

Consequently, several measures are adopted in embodiments of the invention. First, the sub-grade of the diamond is designed to high standards, preferably using granitic ballast and heavy "bridge-type" ties of 8 inches by 8 inches cross-section in the immediate approaches thereto. Second, elastic track and frog connectors are used and bolted to the ties, with any form of spiking being avoided. Third, resilient pads and mats are used above and below the ties. Fourth, access to the central core sub-grade is facilitated by rearranging the tie configuration for the near-transverse intersections, thus leaving the central area of the diamond totally free of obstructions that can impede the work related to the maintenance of the ballast. Fifth, effective drainage is provided and maintained, both at ground and sub-ground levels, to avoid the reduced sub-grade support resulting from unavoidable ballast abrasion and reflected in "mud pumping".

The Piston Actuation Unit (PAU)

Overview of the PAU

The Piston Actuation Unit (PAU) is the essential driver component that powers each piston in each of the four "Gapless Fixed Point Railway Frogs" of a "Gapless Railway Diamond" to provide the variable geometry necessary to achieve gap-free quasi-continuous running surfaces. There are possible design variants for a PAU that provide similar functionality to that illustrated herein to achieve flangeway gap closure in the angular range of interest for a railway diamond. Consequently, other variants in the design of the PAU do not detract from the claims made in this Patent application. This will be further discussed below in the section entitled "Alternative Configuration Management Systems".

According to an embodiment, the basic principle of the PAU is to provide an axial horizontal movement that is converted to an inclined displacement in vertical elevation of a load-bearing piston. When raised, this piston supports the wheel tread across the intersecting flangeway, with the required power either coming from an electric or a hydraulic motor. Said PAU is located within a cradle that serves both structural and alignment purposes and its centerline is parallel to, and below that of, the flangeway, in the vertical space that is some 8 inches high between the sub-ties and the frog itself, on the point side of the frog.

According to an embodiment, a "Full System" configuration, where both intersecting lines have gapless functionality, has two such PAU's associated with each of the four frogs and consequently, there are eight PAU's in a "Gapless Railway Diamond". Each of the PAU's controls a single flangeway piston that can be either retracted or extended in its flangeway, thereby effectively making the flangeway either open or closed. On the other hand, a "Half System"

configuration, where only one line has gapless functionality, only has a single PAU in each of the four frogs and each of these is located in the flangeway of the low traffic line.

In addition to operating the flangeway piston and performing component monitoring, embodiments of the PAU provide, through the PAU cradle, a load-bearing function that complements that of the risers, carrying compressive vertical load from the extended piston shaft to the sub-tie and to its two adjacent cradle pads.

Each PAU on a given frog controls the flangeway piston that provides it with its variable geometry capability. In the case of a "Full System" configuration, the pistons operate as a conjugate pair and hence, they are always in opposite phase to each other while lined up for traffic.

When a route is set up, the following sequence of events occurs at each of the four frogs. In the case of a "Full System" configuration, the piston in the flangeway of the active line (i.e. the through line) is fully retracted into its frog, thereby providing an open flangeway and allowing movement, while the conjugate piston in the flangeway of the inactive line (i.e. the intersected line) on the same frog is fully extended so that its load pad is at the Top of Rail (ToR) elevation, thereby closing its flangeway and providing an unbroken running surface for the movement on the active line where it intersects said flangeway. In the case of a "Half System" configuration, there is only a piston in the flangeway of the low traffic line and it is either extended to provide gapless functionality to the movements on the high traffic line or retracted to permit movements on the low traffic line. In this latter instance, there is no gapless functionality.

The vertical and longitudinal loads on the PAU (and its associated piston) are intermittent, as they only occur when traffic on the intersecting line goes over an extended piston. Consequently, there are no applied loads on the PAU when the piston is in either the retracted or transitional states, or during the interval between the passage of two wheelsets.

There will however be instances where loading will occur during the extension or retraction processes as a result of ice shedding operations, especially during retraction of piston shafts that are coated with clear ice. However, this will only occur on a sporadic basis and the resulting forces are estimated to be no more than one tenth those corresponding to a live load.

The general configuration of the PAU is illustrated in FIG. 10 showing a schematic side view of the inclined piston in the flangeway, as previously discussed in the sections on "Possible Options", "The Retained Option" and "Details of the Retained Option" above. The legend for FIGS. 15(*a*) to 15(*c*), 17, 18(*a*) and 18(*b*) is as follows:

| Legend | |
|---|---|
| A | Gap-Closing Piston Shaft |
| B | Load-Bearing Linkage |
| C | Threaded Rotating Sleeve |
| D | Mechanical Support |
| E | Drain Holes |
| F | P.A.U. Enclosure |
| G | P.A.U. Cradle |
| H | Clevis Connector |
| I | Common Axis Plane: Flangeway, Piston and Link Rod |
| J | Piston Position Sensing Rod |
| K | Piston Position Sensing Unit and Interface with Control System |
| L | 50 Watts Electrical Heater (with 3° C./38° F. Setting) |
| M | Clutch/Locking Unit (Mech.) or Solenoid Isolation Valves (Hydr.) |
| N | Hydraulic Motor with Hydraulic and Control Lines |
| O | Axis of Worm Drive to Jackscrew/Rotating Sleeve |
| P | Removable Vertical Structural Faces (Parallel to Flangeway) |

-continued

| Legend | |
|---|---|
| Q | Actuator Shaft |
| R | Platon Seat |
| S | Piston Seat-Connecting Bolt (1 of 4) |
| X | Thrust Bearing |
| Y | Roller Bearing |
| Z | Needle Hearing |

According to an embodiment, the physical dimensions of the PAU are 6⅞ inches in height and 24⅞ inches in length, with its width ranging from 5 inches to 7 inches. This allows it to slide laterally into the internal 7 inches height and 25 inches length of the cradle, where it is then secured into position and the two facing sidewalls of the cradle are bolted on. These dimensions are listed in Table 4.

According to an embodiment, all of the vertical sides of the PAU consist of ½ inch thick steel plates, as is the case for those of the cradle. In addition, the central portion of the PAU, which sits directly above the sub-ties and hence is directly subjected to the loading from the frog, basically consists of a central solid core with a pass-through for the jackscrew. This amply meets the structural requirements and the geometrical constraints in the full range of intersection angles of interest.

The most restrictive constraints occur at small intersection angles, as a result of two PAU's being in close proximity to each other. According to an embodiment, the PAU has a tapered form factor that allows for the full range of intersection angles (30° to 150°) specified in Table 1. This leads to a standardization of the PAU fabrication process, irrespective of the intersection angle, and facilitates the inventory management of spare parts, thus benefiting the overall economics of the invention.

As a result, the PAU has smaller lateral dimensions at the piston end than at the threaded end and hence, it has an irregular form. For this reason, embodiments are 7 inches wide at the power end where the drive mechanism is located and 5 inches wide at the load end where the connection to the piston link is located. According to an embodiment, the external configuration is symmetrical relative to the central axis throughout the length of the PAU, excluding the adjunct of peripheral components, such as the configuration management module.

Maintenance work performed on the operating mechanism should be preventative and done on the basis of time-in-service, so as to minimize unscheduled outages. This will require the development of a maintenance schedule, with intervals for the periodic removal and overhaul of key components. Such work will be facilitated by the fact that some risers are readily removable in embodiments of the invention.

According to embodiments of the invention, the actuation of the PAU can be either mechanical or hydraulic. The comparative merits of both were evaluated and are shown in the "Evaluation of the Drive Options" section below. The mechanical mode, based on a variant of the jackscrew, was found to be preferable. The motorization itself can either consist of electric or hydraulic motors. This is discussed in "The Drive Motors: Electric vs. Hydraulic" section below, where comparative merits were considered on the basis of compactness, suitability to hostile environments and torque capabilities.

Evaluation of the Drive Options

According to embodiments of the invention, the basic operating principle of the PAU can be achieved either mechanically, i.e. based on an electrically motorized jackscrew, or hydraulically, i.e. based on a power hydraulic system. In this latter instance, it can be of a hybrid nature where the mechanical jackscrew of the PAU is driven by a hydraulic motor or alternatively, the system is entirely based on a hydraulic piston instead of a motorized jackscrew.

Option 1: The Mechanical Actuator

According to embodiments that use the mechanical drive option, the PAU consists of a threaded non-rotating central actuation shaft, 1½ inch in diameter, and said shaft can travel along its longitudinal axis, parallel to and under the flangeway that it connects to. This translational movement results from the rotation of the threaded collar, driven by a worm-gear arrangement, against the non-rotating threaded central shaft of the actuator.

In these embodiments, the horizontal shaft within the PAU's connects through a clevis bracket to the linkage with the piston seat at the load end, thus controlling the opening or closing of its associated flangeway. Details are shown in the embodiments depicted in FIGS. 15(*a*), 15(*b*) and 15(*c*).

According to a further embodiment, the worm-gear assembly is "throated" in order to increase the load bearing area between the worm and the gear, thus minimizing the effects of wear and maximizing service life. The design is based on the "single throat" configuration that requires curvature on the worm-gear to achieve sufficient gear contact area. Given that the PAU only operates under no-load conditions, the more elaborate "double throat" configuration, where both the worm and the gear components are intricately meshed, was deemed to be unnecessary.

According to embodiments of the invention, the rotational input comes from a reversible motor, either hydraulic or electric. Its duty cycle is low as the rotational movement only occurs briefly prior to route set-up. There are two sub-options.

Sub-Option 1-A: Mechanical Actuator Driven by an Electric Motor

Because of dimensional considerations, there should be no more than two electric motors driving the PAU's of the diamond, given the physical limitations in the immediate area. In a "Full System" configuration, each of two motors controls one of the two intersecting lines, whereas in a "Half System" configuration, only one motor is required.

According to an embodiment, the drive shafts are of the bi-directional flexible type rather than the rigid rod arrangement generally used in railway applications. This allows for good field site configuration as the flexibility in the linkage mechanism reduces the number of required angular couplers.

The torque load on these linkages is low as a result of the worm type gearing arrangement within the PAU's and the rotation occurring only under no-load conditions.

Moreover, a mechanical actuator driven by an electric motor makes use of existing familiarity of railway maintenance crews, as it does not require the certification and special tooling that the hydraulic option would require. This is further discussed in the section on "The Drive Motors: Electric vs. Hydraulic" below.

Sub-Option 1-B: Mechanical Actuator Driven by a Hydraulic Motor

This corresponds to embodiments where individual hydraulic motors are mounted directly on each of the PAU's. This eliminates the need for external drive shafts, thus reducing the mechanical complexity in the vicinity of the diamond.

Hydraulic motors are well suited to this application, as they are compact and provide high torque at low rotational speeds and are immune to harsh environmental conditions. This results in fewer possible failure points, a safer working environment and economic advantages.

In both of these options, the worm-gear arrangement provides RPM reduction as well as partial self-locking capabilities. The gearing does not provide full self-locking because of the high frequency vibrations generated in the diamond structure under traffic conditions. This can result in an inadvertent gradual movement of the actuator if it is not otherwise properly restrained.

Consequently, full self-locking requires separate provision for each of the PAU's in order to achieve full self-locking. This is accomplished through a separate fail-safe mechanically isolating and braking clutch mounted within each of the PAU's along with a hydraulic isolating manifold. This is located in the configuration management module (see "Configuration Management Module" section below).

Option 2: A Purely Hydraulic Drive

Under the alternative option of a hydraulic drive, embodiments of the PAU consist of a hydraulic cylinder that runs parallel to, and under, the flangeway that it connects to. Its central shaft moves along the longitudinal direction of the PAU's. The possibility of using such a cylinder along the same axis as the load-bearing piston providing the gapless functionality was examined but not retained for technical reasons.

This arrangement is entirely hydraulic and does not require a motor, either electric or hydraulic, as there is no rotational movement. Such a purely hydraulic system offers a relative simplicity and compactness for the PAU's, as well as reliability under adverse conditions. In this configuration, the horizontal jackscrew within the PAU's is replaced with an hydraulic piston that connects through a clevis bracket to the linkage with the load-bearing piston seat at the load end, thus controlling the opening or closing of its associated flangeway.

However, said system is not intrinsically self-locking and a protection system must be provided in each of the PAU's in order to avoid the possibility of piston displacement as a result of accidental hydraulic leakage or failure. This is achieved hydraulically within each of the PAU's using usual practices, such as used in forklift truck applications.

There is also a significant volume of hydraulic fluid required as a result of the eight cylinders. This increases the thermal load required in extremely low temperature conditions. In addition, this results in additional material and labor costs when the system is purged as part of its regular maintenance. Such an entirely hydraulic drive option increases the possibility of spillage during maintenance operations and has implications in terms of additional personnel training. This also requires the use of an environmentally acceptable fluid.

The operating hydraulic pressure does not need to be high, as the PAU's are only operated under no-load conditions. However, there are controlled valves that isolate the system prior to any live load being applied to it. The master cylinder with the PAU's and the isolation valves must be rated for a standard hydraulic pressure of 3,000 psi.

In order to support the active loads, the bore diameter of the master cylinder should be 4½ inches and a travel stroke length of 6 inches provides a retracted length of less than 18 inches that readily fits into a PAU enclosure. Alternatively, a system with a larger bore, such as 6 inches and small stroke, could be used, as these are commonly found in hydraulic press applications.

This essentially requires double acting piston capabilities so as to be able to allow retraction, particularly when the drag is significant as a result of pistons being ice-coated. However, this option is not recommended. Thus, the recommended option for the drive system is based solely on the mechanical actuator driven either by either one or two electric motor(s) (Sub-Option 1-A) or by either four or eight hydraulic motors (Sub-Option 1-B).

Controls and the PAU

On terms of traffic control, a diamond is a point where two railway lines converge and intersect. Consequently, it is a source of potential movement conflict and traffic flows need to be controlled. RTC procedures ensure that this done in a safe and expeditious manner.

The issue is more complex with the "Gapless Railway Diamond" as the system must also control the configurations of various components, in addition to performing the traffic management function normally associated with traditional diamonds. This means that the system must also perform configuration management for all the PAU's, in addition to its traditional function of conflict avoidance and resolution.

As such, this is similar to a power turnout, except that, in this case, it has to control and monitor the operation of up to eight PAU's, instead of being limited to a single switch point and possibly, a single movable point frog.

According to embodiments of the invention and in order to achieve a fully automated gap management function, the interface to the RTC system consequently must, in addition to performing traffic conflict protection, also automatically control the following operations and provide status feedback. First, a piston actuation controller allows each of the pistons to be positioned appropriately. Second, a locking function is provided through the clutch unit, which is further discussed in the "Piston Position Locking" section below. Third, piston position sensors allow the system to monitor the configuration of the components, as further discussed in the "Piston Position Indexing" section below. Fourth, a drive system provides the rotational power required by the actuating jackscrew, either from electric or hydraulic motors. Fifth, certain features should be included to enhance system reliability, such as low wattage electric heaters in the PAU and in the hydraulic oil (if Sub-Option 1-B is used); the former is to prevent condensation build-up and the latter is to maintain acceptable viscosity at low temperature. Sixth and lastly, peripherals such as the external control enclosure and the wayside control panel must be linked to the actuators and to interface with the RTC system.

According to an embodiment, the system requires the capability to set and monitor in real time the configuration of up to eight pistons according to the routing being set. Only after all the requirements are fulfilled, including the various configurations being set and locked, is the operating clearance issued confirming, through wayside signals or otherwise, the authorization for a movement to proceed.

According to an embodiment, the piston locking function is done at the power end to ensure that rotational power to each of the PAU's is fully disabled while the piston position is fully extended or retracted. This is done by the activation of a fail-safe brake clutch that disables the power drive to the load side while locking its load shaft, thus ensuring that that there is no unintentional change in its position.

Conversely, the piston indexing function is performed at the indexing end of each PAU by determining the actual position of the piston and its load-bearing pad.

This means that the indexing function is based on the detection of the actual position of the piston, whereas the locking function is performed in the power transmission stage that drives the actual piston position.

Both of these functions are consistent with the fail-safe philosophy in railway signaling practices.

Mechanical Aspects of the PAU

According to an embodiment, the actuator worm-gear is operated through a brake and power clutch assembly that is mounted directly to the PAU through its configuration module.

This arrangement provides the PAU's with a compact and rugged design that can be fitted within the confines provided by the risers. The rotational power required by each PAU is provided either by hydraulic motor mounted directly on their respective PAU's or by either one or two shared electric motor(s) linked to the PAU's using bi-directional flexible drive shafts in conjunction with load splitters.

Thus, there are multiple drives in a "Gapless Railway Diamond", one for each of the pistons, and each one is directly connected to a PAU. Consequently, there will be a need to have either multiple external flexible drive shafts or hydraulic lines connecting to the configuration management modules (see "Configuration Management Module" section). Provision should be made to have these arranged so as to provide a safe environment for field personnel.

Each PAU is designed so that while under load, its internal coupling link is aligned with the piston axis and, consequently, the holding force imposed on the piston by the actuator is axially centered, thus minimizing lateral forces on the piston assembly.

According to a further embodiment, the minimal static ratings for the piston are 20 tons axially and 27 tons at an inclination angle of 45° from the piston axis. These values are only for when the piston is under load and in the extended position, as it is always under no load conditions when it moves or when it is in the retracted position. The 27 tons value is from the side load that the inclined piston is subjected to. A side stiffener is added to the piston shaft to provide the required rigidity against flexing.

According to an embodiment, the maximum compressive load transmitted to the threaded actuator shaft in the PAU through the piston linkage is estimated to be approximately 15 tons and this, in turn, is transmitted longitudinally to the PAU enclosure assembly and ultimately, to the risers and sub-ties assemblies.

According to an embodiment, the PAU is not subjected to such loads on a continuous basis, but rather only as traffic rolls by on the extended pistons located in the flangeways being intersected. These are transmitted, through the cradle and the frog plate, vertically to the ballast (sub-ties and cradle pads) as well as longitudinally to the adjacent pads, ties and risers.

The only exception to this is when shedding ice during the operation of the pistons, as outlined in the "Overview of the PAU" section above.

Optimal Design of the PAU

According to an embodiment of the invention, the internal operating and indexing mechanisms of the PAU must be custom-fabricated. In particular, the threaded portion of its jackscrew should extend over the full length of the movable shaft, in order to reduce the static loading on the threaded throat of the jackscrew.

Embodiments with the preferred design include a thrust bearing at the base of the PAU and a needle bearing at its top portion. Everything else remains as previously discussed.

Figure 15A:
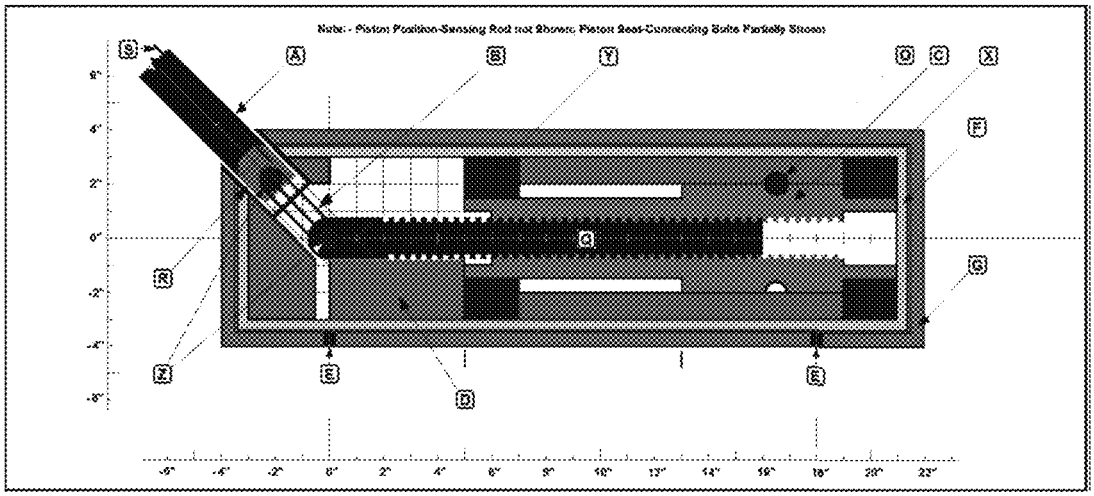
FIG. 15(*a*) shows a side view of the piston actuation unit's mechanical drive with a long threaded shaft configuration and with the piston in the extended position, according to an embodiment.
Figure 15B:
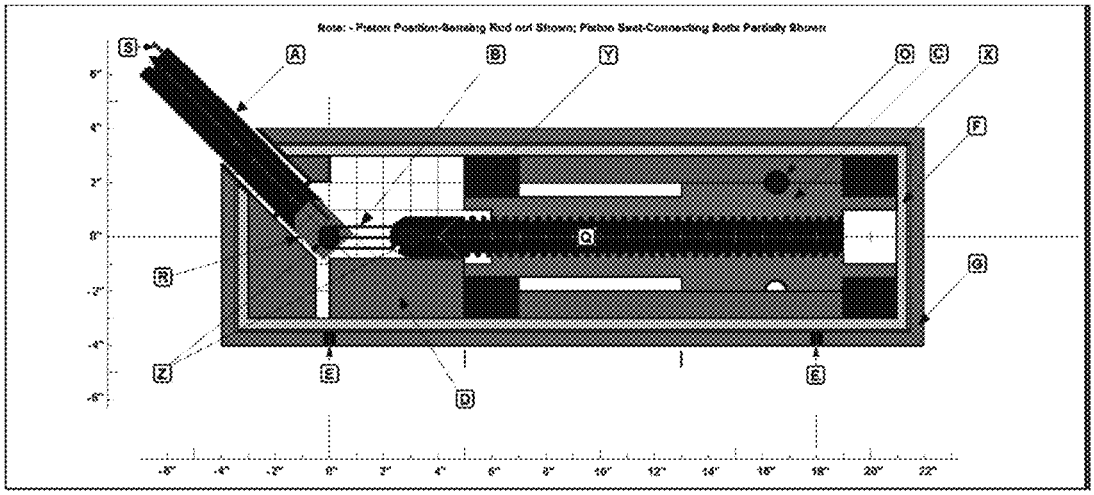
Figure 15C:
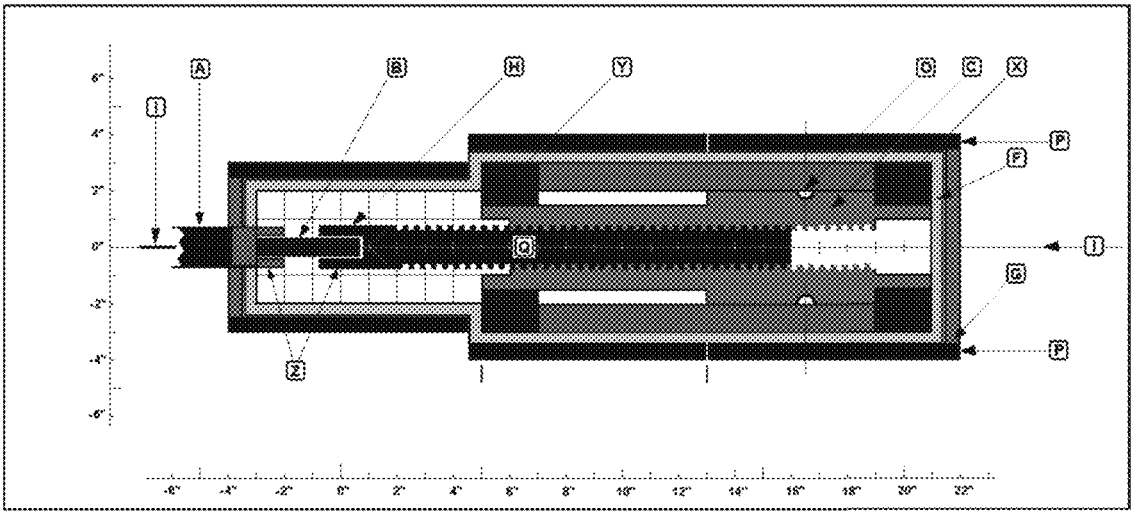

Embodiments of the preferred design for the PAU are shown in FIGS. 15(*a*), 15(*b*) and 15(*c*).

Figure 16A:
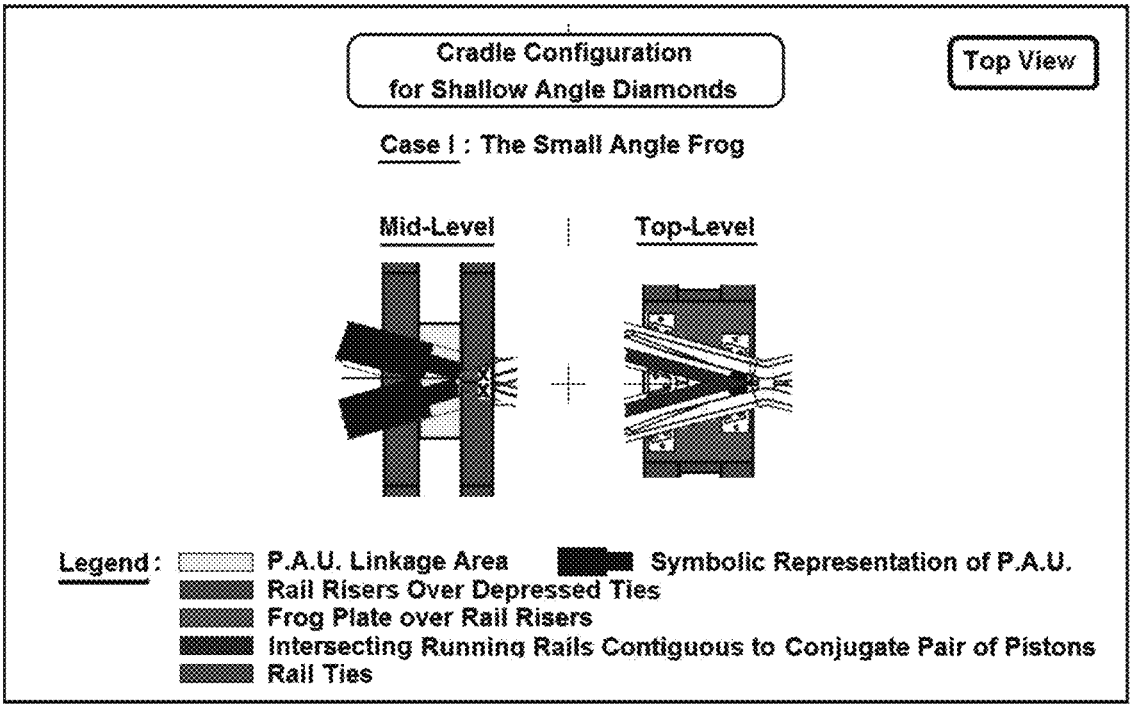
FIG. 16(*a*) shows a piston actuation unit configuration for a small intersection (acute) angle at a frog point, according to an embodiment.
Figure 16B:
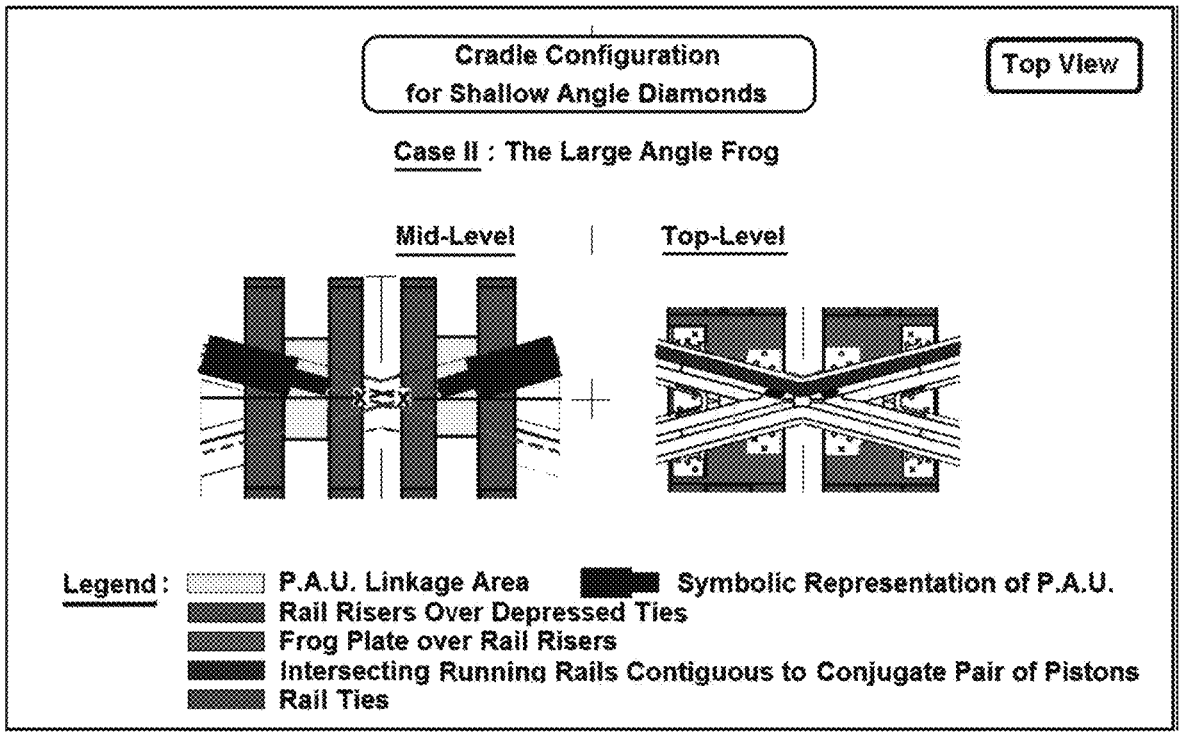
Figure 16C:
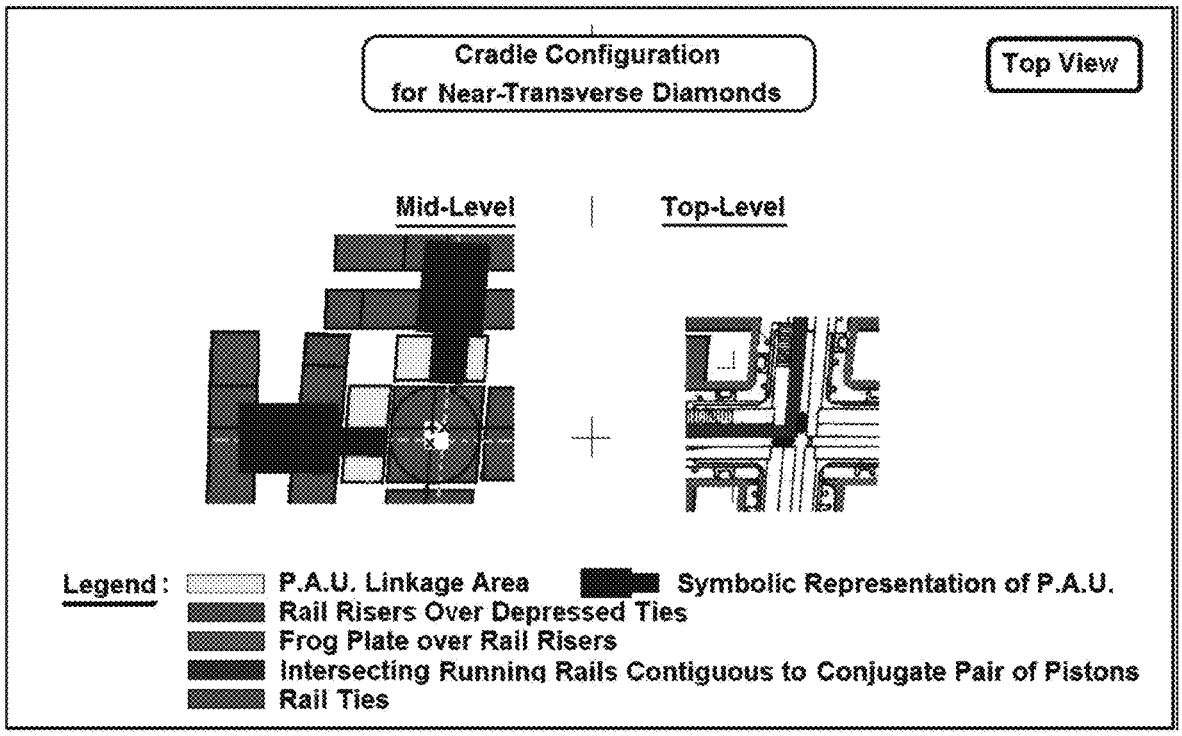

There are the three possible frog configurations (see "The Frog" section above and FIG. 11(*a*)) and this requires three different types of PAU configurations. These are the "side-by-side" layout for shallow (or acute) angle frogs, the "face-to-face" layout for large (or obtuse) angle frogs and the "quasi-perpendicular" layout for the four frogs used in near-transverse diamonds. These three cases are respectively illustrated in FIGS. 16(*a*), 16(*b*) and 16(*c*).

The last of these, namely the near-transverse case, represents the situation where the greatest benefits will be achieved from the adoption of this invention for a given traffic level.

Configuration Management Module (CMM)

According to an embodiment, the CMM acts as the interface between the PAU and the external control interface.

This is also where the various links to the PAU from the central controller are connected. Thus, the CMM contains the components required for the power system as well as for instrumentation and electrical purposes. According to a further embodiment, it is located on one side of the PAU, on the gauge side of the frog, as this arrangement is furthest from the intersecting line and provides for a more suitable configuration. This also facilitates the inspection and maintenance functions. According to an embodiment, the configuration management module controls the actuation of the piston and is linked to a central control unit that is interfaced with the RTC system to provide automatic configuration setting.

According to a further embodiment, the configuration management module includes a fail-safe clutch mechanism that mechanically isolates the PAU when the system is in locked position, thus preventing any inadvertent configuration change. This locking function is engaged when power is cut-off and only allows movement when energized. This is the subject of the following section on "Piston Position Locking".

The other essential component of embodiments of the invention is that of the lower and upper piston position sensors located at the lower and upper locations of the frog. These are located so as to measure the piston position in two distinct manners and are connected to the internal piston lock module and to the external control system. This will be further described in the section below on "Piston Position Indexing".

Piston Position Locking

According to an embodiment, the piston position locking function ensures that the frog configuration is not inadvertently altered after a clearance has been issued and prior to it being fully completed. According to a further embodiment, this is accomplished by having electrically driven clutches on each of the CMM's mounted in a fail-safe manner such that a permissive traffic control indication cannot be displayed unless all PAU's are in a locked position.

According to an embodiment, the circuitry performs its functions, within each of the PAU's, when the "lock" status is required (i.e. when the pistons are either fully retracted or fully extended). Particularly, it functions to isolate the drive shaft by disabling power to each of the primary clutches, brake the drive shaft by electrically grounding each of the electrical clutches so that they revert to their "lock" default mode (i.e. a non-rotating "brake" mode) and disable the hydraulic feed by closing, in a fail-safe mode, the hydraulic valves of the PAU's hydraulic manifold.

This triple redundancy of the "locking" function ensures that the configuration is unchanged during the validity period of a clearance and that the movable components remain in their authorized configuration.

The protection control function is part of the localized safety function that is located in the configuration management module and is controlled from the wayside bungalow.

This reflects the RTC philosophy of providing system safety through "vital" system functions at the local (field) level, while overall "non-vital" system control is accomplished as a supervisory function.

Figure 17:
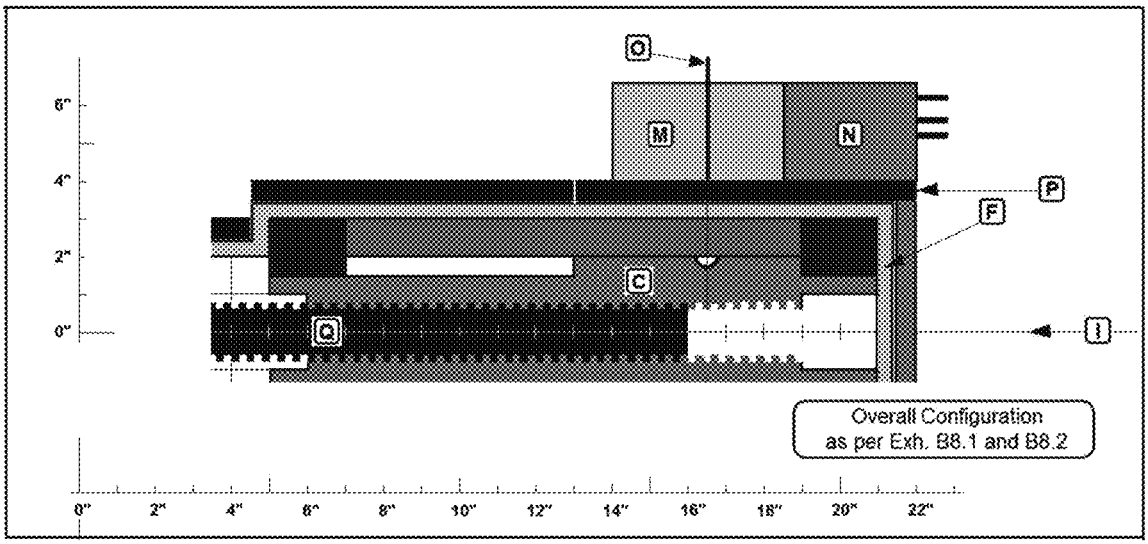
FIG. 17 shows a top view of a piston actuation unit's mechanical drive with a hydraulic motor and clutch brake unit, according to an embodiment.

An embodiment of a PAU mechanical drive with a compact hydraulic motor mounted directly on the PAU with a built-in clutch brake unit is shown in FIG. 17.

Piston Position Indexing (PPI)

Embodiments of the invention require piston position sensing information and this is provided in real-time by the electrical signal sent by sensing switches activated by the position indexing rod. This corresponds to the lower indexing system and has been discussed in "The Piston" section above, with the dimensional details of piston embodiments shown in FIG. 13(*a*).

According to a further embodiment, the piston position indexing rod is anchored to the top edge of the piston, within 1 inch of its upper extremity that is the actual load bearing area that bridges, when required, one of the intersecting flangeway gaps.

Hence, it determines the actual piston position directly, without introducing uncertainties from indirect measurements.

According to a further embodiment, this rod has a ¼ inch diameter and is not subjected to any loading, except possibly the shearing of some thin ice. It runs through the frog in a 5/16 inch bore that is parallel to and located below the main 1% inch bore. Its bottom end carries the piston position information down to the PAU where the actual sensing switches are located.

As this is a light-duty application, the material dimensional requirements are minimal. In order to address adverse environmental conditions, embodiment consists of a rod that is Teflon or soft-rubber coated, i.e. rubberized. This ensures maximum immunity against ice accumulation under wet freezing precipitation conditions.

According to embodiment, the surface coating of the rod will ensure that any ice accumulating on the rod when it is extended will be easily scrapped off when the piston transitions between configurations.

Figure 18A:
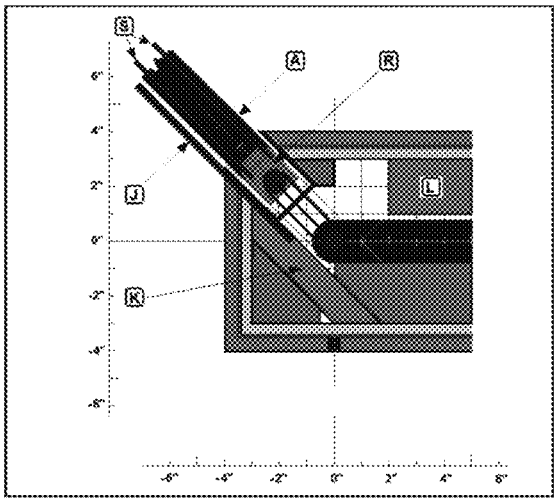
FIG. 18(*a*) shows a piston actuation unit indexer with the piston in an extended position, according to an embodiment.
Figure 18B:
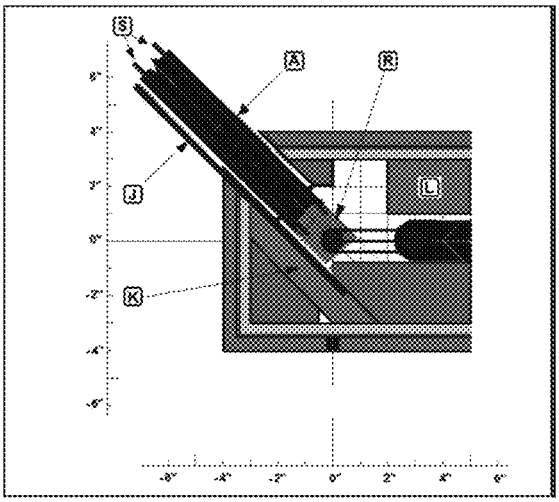

An embodiment of the PAU indexer is illustrated in FIGS. 18(*a*) and 18(*b*), which show, respectively, the indexer when the piston is in the extended and retracted positions.

Figure 19A:
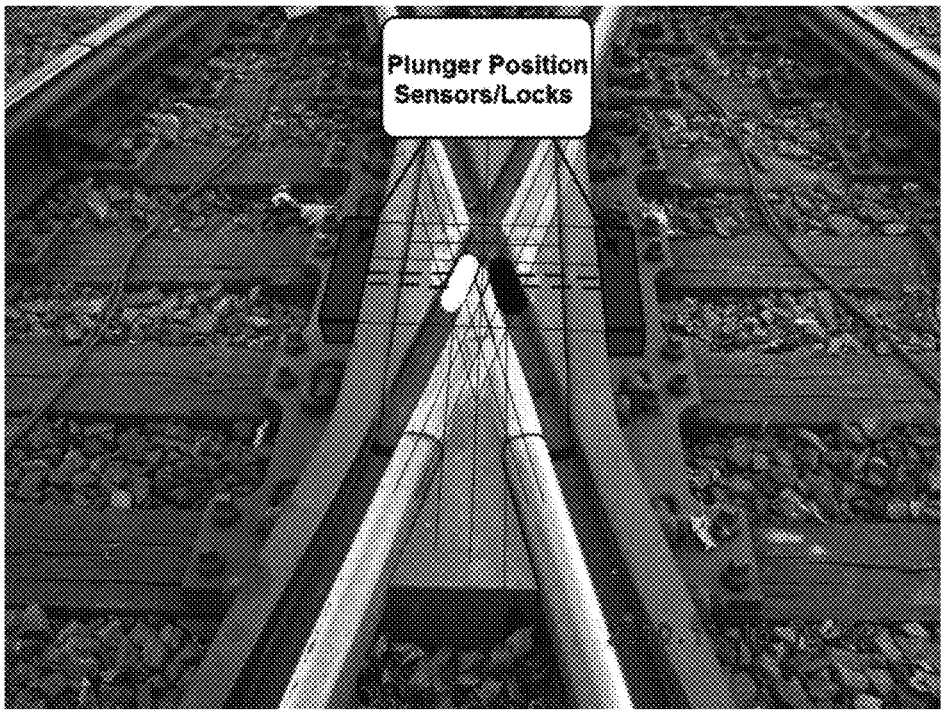
FIG. 19(*a*) shows external position sensors in use on a shallow angle diamond, according to an embodiment.
Figure 19B:
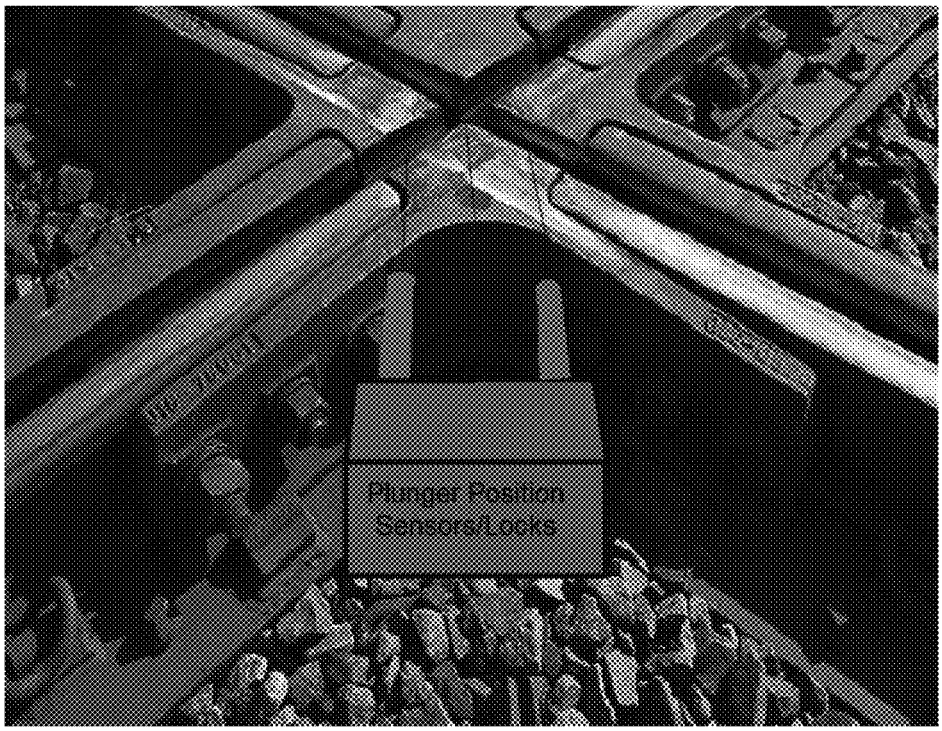

According to an embodiment schematically illustrated in FIGS. 19(*a*) and 19(*b*), there can also be a piston position upper indexing system that is mounted externally to the PAU, near the top of the frogs, thus providing redundancy to the system. This will be further discussed below in the section entitled "Alternative Configuration Management Systems".

This arrangement makes use, for each piston, of the horizontal channel and the water-tight enclosure for the piston position upper indexing components that is some 1 inch deep, some 4 inches long and some 1 inch wide and that is machined below the flangeway.

The advantages of embodiments with this design are that the piston position can be determined in a fashion that is independent of the PAU. In addition, either the lower or the upper indexing system is required, but using both provides indexing redundancy.

Embodiments with the piston position upper indexing components require adequate protection against possible damage from external factors, as these are at near track level.

The actual merits of these two types of arrangements for the piston position indexing systems are open for future considerations and do not affect the other benefits provided by embodiments of this invention.

The Drive Motors: Electric vs. Hydraulic

According to embodiments, either electric or hydraulic power can be used to drive the PAU's. This section discusses the relative merits of these options and their implications.

There can be either four or eight of these PAU's, with each of the four frogs of the diamond having either one PAU in the case of a "Half System" or two PAU's in the case of a "Full System".

The system only operates intermittently during changes in frog geometry. This means that its duty cycle will be low, as actuation will only be required during the route setup mode. This typically corresponds to a duty cycle of less than 10%, i.e. for an actuation lasting no longer than 30 seconds, and is expected to occur at intervals of not less than 5 minutes.

Moreover, the PAU's will operate under light load conditions, as there is no traffic on the diamond while its configuration is being modified. In fact, the only time where there will be other than minimal load conditions on the mechanism during dynamic phase of configuration changes is when there has been ice accumulation on the extended pistons, as this will require an additional torque on the drive mechanism. Other instances where a load is present correspond to the static situation where the configuration is fixed and traffic is proceeding over the supporting pistons that are locked in place. As a result, there is then no load being placed on the drive mechanism, only on the locking mechanism.

Electric motors are commonly used in the railway environment. However, as they are susceptible to dampness and grime, they require a protective heated enclosure, generally of sizeable dimensions; this is a concern in the limited space around a diamond. As a result, an electric motor cannot be mounted in close proximity to the PAU's (contrary to a hydraulic motor) and it must be sited away from the diamond, like for a power turnout.

Under this option, space constraints limit motorization to no more than two electric motors supplying all the PAU's and this is best done through flexible drive shafts and load splitters. Consequently, these and the electrical lines used for control and instrumentation of the PAU's should be properly protected against damages and arranged to avoid hazards to personnel.

In contrast, hydraulic motors are compact and are suitable for hostile environments. However, they do require a central hydraulic pump and auxiliaries. They also have minimal cooling requirements and are immune to electrical power transients, which is particularly desirable in remote locations. As a result, this option would allow the hydraulic motors to be mounted directly on the PAU's, thus avoiding the need for external flexible drive shafts.

Most importantly however is the fact that hydraulic motors have high torque at low speed. This is significant to address the possibility of ice accumulation on the extended piston shafts resulting from freezing precipitations, as this could lead to jamming prior to piston retraction while shedding ice that had accumulated during extension. Consequently, it is essential to have a high torque capability at the piston end of the PAU's to prevent any possibility of jamming or front-end overheating. However, the torque reducing gearing in the design of the PAU's ensures that the torque requirements are acceptable to both electric and hydraulic motors at their drive shaft end.

Embodiments using hydraulic motors would require the use 4-bolts Geroler motors with bi-directional rotation capabilities. This type of motor is of the LSHT type, which stands for "Low Speed High Torque" motor. In order to reduce their vulnerability and maintenance requirements, these motors are protected against physical impacts by external shrouds.

In a hydraulic system, considerations about low temperature operations require provision for the hydraulic fluid to be rated for low temperatures, typically temperatures around −40° C. In addition, there must be a suitably rated heater at appropriate locations, such as the main hydraulic reservoir. Provision is also made in the design for a throttling orifice at each of the PAU in order to achieve a slow re-circulation of the fluid to prevent low temperature viscosity issues. This is in addition to the low wattage heater located within the PAU enclosures.

The hydraulic fluid used in embodiments should meet environmental standards, such as biodegradability, in order to protect against the adverse consequences of any inadvertent spillage. Furthermore, the hydraulic and electrical lines used for control and instrumentation of the PAU's should be properly protected against damages and arranged to avoid hazards to personnel.

According to an embodiment, only one hydraulic pump is required to supply all of the hydraulic motors. This pump is driven by electric power and installed in the immediate vicinity of the diamond in an enclosure that is both mechanically and thermally protective.

In both types of drives, i.e. electric or hydraulic motors, the power is applied to the PAU's until the last load pads has attained its intended position and its drive shaft has been isolated from the power drive and locked by the clutch system. This ensures that all the load pads are positioned at the proper elevation, irrespective of their individual variations in wear history.

Under anomalous conditions, the Emergency Release Sequence (ERS) allows the system to remain operational, subject to conditions similar to those currently applicable with existing equipment. This is discussed in the section describing the ERS.

Single Route Variant

A special situation arises when one of the intersecting lines handles a very low level of traffic, such as short freight transfers or infrequent commuter trains, while the other one handles a high level of traffic. The frog damage is then concentrated along the high traffic line crossing over the secondary line flangeways, although said flangeways are seldom required for traffic.

In such instances, the external damage inflicted to the frogs of a traditional diamond is concentrated along the high traffic line, whereas the internal damage is largely not line-specific, being scattered quasi-randomly within the body of the frogs.

However, the oversight and maintenance requirements basically remain unchanged from what they are when both lines carry a more uniform level of traffic.

In addition, with a traditional fixed geometry diamond, noise and ground vibrations are generated with the passage of every train on the high traffic line, even though the gaps that cause this are only required for the odd movement on the low traffic line. These issues are aggravated at high operating speeds.

Consequently, the fact that the traffic is concentrated along one of the lines does not materially reduce the extent of the problems and maintenance costs associated with traditional diamonds.

However, it is possible to reduce the damages along the high traffic line by using a simplified embodiment of the "Full System" for the "Gapless Railway Diamond". This configuration results in a marginal reduction in system complexity and hence, in its capital and operating costs.

This embodiment, known as the "Single Route Variant" (or "Half System" for short), provides gapless functionality on only one of the two intersecting lines, namely on the high traffic line, when the traffic levels on the intersecting line are very low. According to this embodiment, the pistons and the PAU's are located only along the low traffic flangeways, with four these being required instead of eight. This embodiment has already been discussed in the section on "A System for Achieving Variable Diamond Geometry".

This embodiment provides the benefits of the invention for the high traffic line, as this is where the bulk of the frog damages is concentrated. Movements over this line can then operate over continuous running surfaces, without the need for any mitigation measures. This can have an appreciable effect on line capacity.

Movements on the low traffic line however are subjected to the intrinsic limitations of traditional open-gap Diamonds. Hence, mitigation measures are necessary to avoid damage to the frogs as well as to the sub-grade. This may be acceptable in instances where capacity is not limited on the high traffic line.

Ideally, the permissible speed on the low traffic line over the crossing should be as low as possible in order to avoid any impact damages to the frogs and ballast. The resulting crossing time will have an insignificant impact on the capacity of the high traffic line, as this only occurs infrequently for short trains, and for generally brief periods, even when accounting for approach block time.

This embodiment result in maintenance expense reductions and elimination of any mitigation measures that could have been otherwise adopted for movements along the high traffic level line.

In addition, this will require no mandated restrictions, such as with the OWLS or FFB systems. Furthermore, it does not have any restriction on revenues passenger car on the low traffic line and this can be an important consideration in the case of rail commuter operations on such lines.

This embodiment provides other benefits, such as reductions in noise and ground vibrations, as movements on the high traffic line no longer encounter open gaps and those running over the low traffic line are short and infrequent.

Given that the "Partial Gapless Railway Diamond" is an active track component with a variable geometry capability, this requires full integration with the RTC system, both for traffic control purposes and for the temporary disabling of the gapless functionality on the high traffic line.

The Peripherals

General Considerations

The "Gapless Railway Diamond", referred to as the "GRX", requires connections to three peripheral units located in its immediate vicinity, namely the "Signal Bungalow", the "Control Enclosure" and the "Command Panel".

The first one of these is linked to the "Rail Traffic Control System" (RTCS). It is the logical interface sets up authorized routings, while executing and monitoring the configuration settings. The second one serves the site-specific functions of commanded executions and real-time monitoring of configuration settings, whereas the third one provides local input for the management of technical incidents and maintenance.

Full traffic protection is provided to traffic, along with the controlling and monitoring of the variable geometry of the GRX. The RTCS related commands and monitoring are performed through the "Control Enclosure" while the local commands are performed, when required, through the "Wayside Command Panel", with both of these units being located in close proximity to the diamond.

Generally, additional functionality will be required into the existing RTCS equipment located in the existing bungalow, whereas the other two peripherals ae an integral part of the GRX.

The Four Modes of Operation

The GRX has four (4) distinct modes of operation, namely the "Automatic Mode", the "Released Mode", the "Disabled Mode" and the "Maintenance Mode". In all of these modes, full protection is provided by the RTCS.

The "Automatic Mode" is the normal mode that is interfaced with the RTCS and provides automatic gapless operation for the diamond with full status monitoring of its related components. The configuration of the GRX is controlled and monitored by the RTCS and the instructions to the train crews are conveyed through wayside and/or in-cab signaling.

The "Released Mode" is for the use of Transportation personnel when a GRX technical failure prevents proper configuration or monitoring. This allows the disabling of the GRX from its control and monitoring system while maintaining full conflicting traffic avoidance.

The "Disabled Mode" is for the use by the maintenance personnel while operations are allowed to continue. This mode retracts all pistons within the bulk of the frogs and the configuration management function is then unserviceable. However, the track is passable and operations can proceed with full protection against conflicting movements. The diamond is then considered as having a fixed geometry and a slow order is recommended for damage mitigation purposes, i.e. until the tail end has cleared the diamond and a higher permissible track speed is encountered.

Finally, the "Maintenance Mode" is also for the use of Engineering personnel when the track is closed to traffic. It logically uncouples the system from the RTCS to allow maintenance operations after the issuance of a "Track Occupancy Permit" by the dispatcher. While in this mode, the RTCS recognized that the GRX is impassable and ensures that all traffic control signals to said diamond display their most restrictive aspect. Upon work completion, the dispatcher must be notified before both intersecting lines are restored to traffic.

The default mode is the "Automatic mode", while the "Released Mode" is for the use of train crews and both the "Disabled Mode" and the "Maintenance Mode" are for the use of the engineering department maintenance forces.

All of these modes are under the central control of the rail traffic controller and are subject to standard practices for normal and abnormal operating conditions.

Shared Resources

In embodiments where multiple diamonds are clustered in close proximity, it is possible to share some resources, resulting in an economy of scale.

This applies particularly in Sub-Option 1-B where hydraulics is used to drive the PAU's. In this instance, components such as the hydraulic pump and the thermostatically maintained hydraulic reservoir, can be dimensioned accordingly to be shared by all the units in a cluster. This allows for consolidation of resources and can be quite cost effective as the number of diamonds in a cluster is increased.

Other instances are when a back-up electrical system, such as a battery bank, is used to ensure continuity of operation of the system.

The Signals Bungalow

The added functionality at the diamond requires the upgrade of components within the "Vital System" circuitry of the RTCS system located in the RTCS bungalow.

According to an embodiment, the driving and control equipment for the GRX located in the "Wayside Enclosure" are both logically linked to the RTCS through interfaces located within said bungalow whose vital circuitry controls the traffic over the diamond.

In most situations where embodiments of the invention will prove most beneficial, there is already such a bungalow containing the essentials for traffic control and signal displays at the diamond. Consequently, the additional instrumentation that must be added will basically consist of work on the RTCS electronics and most likely will not require the construction of additional facilities. This however can only be evaluated on the basis of a site-specific analysis.

Depending on the type of technology used in the bungalow, such a modification may require either an upgrade or a new controller, particularly if a given logical rack is currently at or near its limit. In terms of system commands, this is basically a binary system whereby routes can only be aligned along one of two intersecting routes where there is no possibility of interconnection between them.

The information from the multiple sensors of the GRX configuration is processed by the RTCS after having been consolidated by the circuitry in the remote enclosure located adjacently to the diamond. This provides the RTCS with the parametric information necessary for it to determine a "Go/NoGo" decision for a contemplated routing.

The situation is basically analogous to one where a new turnout would be introduced into an already existing crossover track arrangement.

The Control Enclosure

The control and monitoring requirements associated with the GRX are analogous to that of power turnouts where the logical link to the RTCS carries bi-directional route setting commands to the switch points and performs real-time monitoring on their status. However, with the GRX, the logical links to the RTCS carry bi-directional route setting and sensing commands to and from multiple load-bearing pistons, instead of the simpler arrangement of switch points in the case of a turnout.

Although there are numerous variable geometry parameters that must be set and monitored, the outputs of their sensors are consolidated in the interfaces located in the secure wayside enclosure located in close proximity to the GRX. The result is a binary route position indicator that is then processed by the RTCS as a routing constraint that has to be met, in addition to the traditionally performed traffic control and conflict avoidance functions. The enclosure also contains the interfaces to the Command Panel, as well as controls for the operation of the clutching and locking mechanisms, the piston indexing systems and the required electrical functions.

In the embodiment, all movable GRX components remain physically and logically locked in position once a clearance has been issued, so that they cannot be inadvertently be moved until said clearance has been completed or voided. This ensures that configuration integrity is maintained for each of the moveable elements according to the route selected by the RTC system and that said route remains locked to provide full protection against any conflicting traffic.

The appropriate information is then displayed to the train crews by means of the wayside signal system, or through any other traffic control system, as per normal traffic management protocols.

The Wayside Command Panel

This panel is used to access three functions locally. These are the "Released Mode", the "Disabled Mode" and the "Maintenance Mode".

Any track component that is controlled remotely by the centralized RTCS must also be capable of local control and operation from the wayside. This allows for continuity of operations when a technical failure occurs either at the field site or within the telecommunication process. This also allows for preventative maintenance, including full diagnostic and testing, as the system is then isolated from central control. In the case of a turnout, this allows a movement to switch from one route to another when the system is inoperative.

A similar situation may arise with the GRX. In this case however, a failure of the variable geometry mechanism may lead to one or more piston(s) not being fully retracted along an intended routing, thus causing obstructions along the flangeways. In such instance, it is imperative to promptly restore the line to service by bypassing the variable geometry of the GRX pending full correction of the problem by maintenance personnel.

This requires that all pistons to be brought in their retracted positions. This is accomplished by using either live power or by using the emergency power backup from a battery bank kept in floating charge conditions and located in the signals bungalow. This particular sequence, referred to as the "Emergency Release Sequence" (ERS), is expected to be used infrequently by train crews, but is seen as desirable in light of possible future incidents. It effectively brings the system into the "Disabled Mode" where it is then operated as a traditional fixed geometry diamond with suitable mitigation measures.

The dispatcher will already be aware of such a problem when it occurs, as the route selection process will be unable to clear. He must then issue a clearance to the train crew prior to the activation of this mode, as is standard procedures when encountering a defective absolute signal.

This clearance authorizes the train crew to use the "ERS" procedure and it gives authority to proceed after it confirms that all the pistons have been retracted along the route. After activation of this mode, the system can only be operated in the "Disabled Mode" and cannot be returned to the "Automatic Mode" by the dispatcher until after proper repairs and certification have been performed by maintenance crew.

Thus, in this mode, all the pistons are fully retracted within the frog castings and appropriate frog damage mitigation measures are recommended.

If this is successful, the train crew then has authority to proceed over the defective GRX at no more than 15 MPH until the tail end of the train has cleared and a less restrictive speed is permissible. This is largely to avoid damages to the frogs until normal operation of the GRX can be resumed.

If this is not successful, the track must be considered as impassable and no movement can proceed until the problem has been fully addressed by the track maintenance forces.

The "Wayside Command Panel" is also used when performing regular maintenance and system diagnostic work, as will be discussed briefly in the following section.

The system is returned to the "Automatic Mode" of operation after the dispatcher has been notified by the local maintenance crew of work completion.

The Maintenance Function

The maintenance required by the GRX system will be different from that currently required and performed on traditional diamonds. As a result of the variable geometry, the frog damage will be greatly reduced and so will be the maintenance requirements related to metallurgical wear and damage. However, there will be a need to maintain the mechanisms responsible for the variable geometry in top conditions in order to maintain the reliability of the operations.

The emphasis should then be on maintaining the proper functioning of the various mechanisms, along with regular inspections of the control electronics. The maintenance should be focused on maintaining the appropriate conditions for the mechanically operating components, such as the PAU's.

The essential variable should then be that of "Time In Service", as the primary factors for the degradation of the system should be calendar time, with the secondary variable being that of the number of cycles performed. This is expected to be more significant than total traffic and total tonnage carried.

As stated earlier in this document, the focus of the maintenance effort should be proactive, not reactionary to respond to wear and impact damage, as occurring in traditional diamonds. This means that the focus of the maintenance should not be that of avoiding eventual visible degradations, but instead of maintaining proper conditions for the reliable functioning.

The maintenance should primarily be focused on the GRX itself, as the peripheral equipment should undergo the regular inspections and maintenance associated with the RTCS. If a comparison can be made, it is somewhat like maintaining proper level and alignment on a turnout, as well as proper lubrication.

This process can be performed with minimal down-time, particularly since the GRX itself will provide easy accessibility of the components since it is raised above the ballast level and provisions have been made for the certain components being removable, such as risers and the side panels. Given that this type of work will adversely affect the structural strength of the GRX, it should only be performed under full closure of the GRX to traffic, with the usual procedures to ensure safety being followed.

It is important to note that the maintenance should be preventative in nature, not corrective, and that a maintenance program should be developed accordingly for the GRX system.

Any maintenance work affecting the security of the movements should be performed under the "Maintenance Mode" and enabled through the "Wayside Command Panel" with the direct involvement of the dispatcher who must issue a Track Occupancy Permit (TOP) for the process.

Configuration Summary

The proposed "Gapless Railway Diamond" will provide a solution to the serious problems long associated with the crossing of flanged wheels over what is known as a railway diamond.

Although the system can be operated either by electric or hydraulic motors, the optimal choice is to use two electric motors with flexible driveshafts along with load splitters. Each motor should control the configuration of one of the two intersecting routes. This arrangement readily allows for the requirement of special functions, such as the "Emergency Release Sequence".

Provision was made in the design process to achieve utmost system reliability while stressing the importance of proper proactive maintenance and to provide means for continued operations of the lines under conditions of unavoidable future technical incidents.

It is expected that the necessary process of further development and certification will lead to its prompt adoption by the railways.

Energy Absorber Considerations

Experience in heavy-haul railway environments has amply demonstrated the benefits of including energy absorbing materials in the design of a track infrastructure.

This is equally valid in general railway environments where maintenance must be performed in areas that are particularly difficult to access, such as in tunnels or where there is intricate and interconnected trackage.

The sub-grade area of the central area of a diamond also falls under this category, as it is often neglected for maintenance purposes as a result of its difficult access. Such maintenance is important in addressing issues of ballast deterioration that would otherwise hinder the essential function of facilitating water drainage.

Although this deterioration will be reduced from the much lower dynamic loadings associated with the embodiments of this invention, it will not however be entirely eliminated. It will continue to occur as a result of continued soil compression loadings associated with regular traffic.

In addition, the sub-grade of a diamond is subjected to the joint traffic of both intersecting lines and consequently, it will degrade at a faster rate than that of the individual approach tracks.

Consequently, the design of embodiments must first minimize factors that contribute to ballast deterioration and secondly facilitate sub-grade access to efficiently perform any future required maintenance work. This will reduce overall lifetime costs.

The first of these points can be accomplished by including energy absorbing elements in the sub-grade of embodiments of the "Gapless Railway Diamond". The second point, namely facilitating access to the sub-grade, has been described with respect to tie configuration in the section on "The Ties or Sub-Ties" above. The first of these considerations will be addressed here.

Although not essential to this invention, resilient material should be included in the initial installation, in conjunction with adequate sub-grade drainage, as this will provide optimal long-term performance and service life for a marginal incremental cost. Overall high quality engineering and rigorous maintenance procedures are essential to achieve the full economic potential of embodiments of the "Gapless Railway Diamond".

Specifically, resilient pads should be positioned between the frog plates and the ties. In addition, resilient and permeable mats should be used between the sub-grade and the native soil, as well as resilient strips affixed to the underside portions of the ties themselves.

This will ensure minimal degradation of sub-track materials and components, particularly in instances of high axle-loadings, high-speed operations and near-transverse line intersections. This will also reduce the need for future line outage requirements, with the effect of this being particularly significant in areas involving multiple lines in close proximity.

This will also help achieve further reductions in noise and ground vibrations, particularly in the case of a hybrid railway diamond (see the "Single Route Variant" section above) where flangeway gaps remain along the low traffic line.

Thus, the embodiments of the "Gapless Railway Diamond" requires a high-quality sub-grade whose intrinsic structural quality will effectively complement the merits of this invention with respect to the above ground track structure.

As a result of the elimination of the large dynamic impact forces and the provision for a resilient and well-drained sub-grade, the service life for the infrastructure foundations is expected to be comparable to that of the adjacent track, even though the sub-grade of the diamond proper carries the joint traffic of both intersecting lines.

Alternative Configuration Management Systems

As previously indicated in the section entitled "The Piston Actuation Unit (PAU)", there are conceivably various other ways to achieve the required translation movement to operate the piston that opens and closes a flangeway. This document has presented the option whereby the action of a jackscrew is translated, through a lever and bearings system, to the required movement of the piston.

It is possible to use other means of indexing for the piston position, while maintaining the basic principles of the Gapless Railway Diamond and meeting the full list of design requirements and specifications outlined in Table 1.

Final Considerations

Descriptive Summary

Embodiments of the invention described herein were developed to address the problems that have been perennially confronting the railways in areas where two lines intersect at-grade.

As a result of its design, the invention eliminates the large dynamic forces generated within the track structure and sub-structure by the traffic going over traditional diamonds.

It does so with full reliability and in compliance with applicable structural requirements by providing variable geometry capabilities to each of the four frogs in such crossings.

This results in gap-free continuous running surfaces, thus eliminating the wheel drops in the open gaps of traditional diamonds. This is particularly important in the North American railway environment in light of the high permissible axle loads.

Embodiments of this invention will result in significant savings in the maintenance of railway infrastructure and increase component service life, as well as provide potentially significant improvements in terms of operations and line capacity.

In addition, it will completely eliminate the noise and ground vibrations associated with traditional diamonds.

The invention and its embodiments are referred to as a "Gapless Railway Diamond".

The Gapless Railway Diamond provides continuous running surfaces over intersecting flangeways, thus eliminating the large dynamic impacts associated with current designs and consequently, providing significant economic, operational and environmental benefits.

Given that a railway diamond basically consists of four frogs, this required the parallel development of a new type of railway frog that can selectively achieve full gap closure over intersecting flangeways.

Said railway frog is based on a modification to the current philosophy of railway frog design and comprises, in its most general scope:

- two load-bearing pads in each of the two intersecting flangeways to provide, when extended, full wheel tread support and, when retracted, full wheel flange clearance;
- two slanted pistons located in each of the two intersecting flangeways, adjacent to the frog "point";
- two piston actuating mechanisms, located below the frog and underneath each of the two intersecting flangeways and each one being within a cradle whose function is both load-bearing, complementing that of the risers, and used for alignment purposes during maintenance; and
- a fully load-bearing riser arrangement that provides the vertical clearance required underneath the frog for each of the two operating mechanisms.

The elements in the preceding paragraph can be simplified when one of the lines has a low level of traffic and it is opted to apply the gapless functionality only to the high traffic line, thus reducing, albeit marginally, complexity and capital cost requirements.

In a preferred embodiment, the modified frog of the present invention achieves configuration change by means of a jackscrew driven either by electric motors or by hydraulics.

The modified frog of the present invention is designed so as to support variable geometry on line intersection angles ranging from 30° to 150°, thus fully addressing the problems identified above.

The modified frog of the present invention is a railway track component that provides vital information to the RTCS through real-time configuration monitoring of the variable geometry of the diamond.

In a preferred embodiment of the invention, design strength of the cradle enclosure provides full load-bearing capabilities, while also facilitating the maintenance by easing, when required, the removal and reinsertion of the mechanism and key riser components.

The modified frog of the present invention provides said enclosure with longitudinal restraint and secures the piston actuator to the track structure above it to allow for the dynamic vertical action under traffic, while providing protection to the mechanism.

The modified frog of the present invention avoids the congestion and inaccessibility in the central part of the diamond by having the piston axis slanted at an approximate angle of 45° relative to the frog plane, thus facilitating maintenance access and inspection.

The modified frog of the previous paragraph includes a lateral stiffener to address the side-loading issue of the slanted piston.

The modified frog of the present invention has a piston position locking mechanism to ensure the invariance of the settings under traffic.

The locking mechanism of the previous paragraph is preferably achieved by taking a multi-aspect approach, namely by physically disconnecting the power shaft, braking the load side of the drive shaft and electrically isolating the power supply.

The modified frog of the present invention has a primary piston position indexer, along with an indexing connecting rod, that is parallel to the piston, along with a secondary indexer separately connected to the piston.

The modified frog of the present invention wherein the piston has grooves to facilitate the piston sliding process, particularly under certain weather conditions.

The modified frog of the present invention further comprising suitably configured component sealing and drainage to avoid any water accumulation in the system.

The modified frog of the present invention comprising a configuration management module where some indexing and locking functions may be performed.

The modified frog of the present invention, wherein the design provides immunity against vandalism and jamming from adverse environmental factors, such as snow and freezing rain precipitations, without the use of thermal sources, as a result of the absence of any compressive surfaces in the design.

The modified frog of the present invention where the mechanism enclosure has a form factor that is independent of the line intersection angles, thus facilitating fabrication and inventory procedures.

The present invention also provides the provision for an interface with the RTC equipment for normal automated operations and a Wayside Command Panel to allow for anomalous conditions and to facilitate system maintenance.

The present invention also provides the provision to bypass the system to allow continued operation of traffic under degraded mode, should a technical anomaly occur, after a conditional clearance is issued to train crews by the dispatcher authorizing the disabling of the system using the "Wayside Command Panel" and providing limited authority to proceed.

The present invention also provides the provision of maintenance and diagnostics functions to the "Wayside Command Panel" to allow for total disabling and testing of the system after a work block clearance has been issued by the dispatcher.

Hence, this invention is a dynamic component that, like a turnout, requires proper configuration as part of the automatic route setting procedure, along with provisions for operations under anomalous technical conditions and prompt recovery capabilities.

Embodiments can operate either automatically through the "Rail Traffic Control System" (RTCS) system or in a downgraded mode with clearance from the dispatcher issued to train crews. The protection procedure is similar to that used with power-operated turnouts that are common in the industry.

The modifications to the track structure are minimal from a mechanical perspective. The bulk of the complexities arise from the actuation mechanism and the interface with the RTC system required to operate and control system components in an automatic manner.

Capital Cost Implications and Return on Investment

A preliminary estimate for the required capital cost, including field installation but excluding the initial development and certification costs, has indicated that the initial capital cost is expected to be over 2.5 times higher than for a traditional diamond. It should be noted that these estimates included certain items such as control systems and modifications to the RTC system that will not be required in subsequent replacements. In addition, the emphasis has been put on certain items such as resilient materials that are not necessary for the functioning of the invention but are nonetheless deemed essential to a good quality design.

However, this increased initial cost is offset by the longer service life that is expected to be comparable to that of the adjacent trackage. In practice, the service life of the "Gapless Railway Diamond" is conservatively estimated to be at least 750 Millions Gross Tons (MGT's) of traffic and this is at least three times longer than for traditional diamonds. In fact, it is expected to be comparable to that of the adjacent trackage. In addition, there will be cost reductions by an estimated factor of five from reductions in maintenance expenses over the lifetime of the project.

The overall financial return on investment is expected to be tentatively in the upper 20%, excluding the initial development and certification costs.

Peripheral Matters

The strictly economic outlook on embodiments of the invention does not account for indirectly related issues such as reduced damages to wheel treads and traction motors, possibly increased track capacity, reduced wear and fuel consumption, as well as improved cycling times.

In addition and irrespective of its economic merits, embodiments of the invention can demonstrate corporate goodwill by providing a practical solution to social concerns resulting from noise and ground vibrations produced by traditional diamonds.

Embodiments of the invention conceivably may be used in low traffic situations where there might not be sufficient economic justification, but significant public pressure to address noise issues and the general disturbances posed by traditional diamonds. In other words, there are various social benefits to embodiments of the invention in addition to its favorable economics.

Additional Considerations

Herein, implications and relationships applicable to embodiments of the invention have been discussed in detail. These include drainage, ties and ballast considerations, driving mechanisms based on either electric or hydraulic motors, the use of energy absorbing (resilient) materials, wayside control systems, the interface with the RTC system, component expected service life, development and testing requirements, fabrication and field assembly costs, possible initial sites, operations under normal and perturbed conditions, as well as expected maintenance requirements. Additionally, there is the possibility of having a single route variant when capital cost requirements must be reduced to an absolute minimum when traffic on the intersecting secondary line is extremely low and infrequent.

Such issues are related to embodiments of the invention described herein and are illustrative of the fact that the problems associated with a flanged wheel transportation system such as a railway and posed by traditional railway diamonds were carefully examined in their entirety.

The embodiments of the invention described herein are also a very realistic solution that fully takes into account the harsh realities of the railroading environment, in addition to recognizing the limitations of currently used diamonds, particularly in light of the maturity of the railway industry and its ever increasing demands.

Closing Remarks

There has long been a demand in the railway industry for a type of railway diamond that reduces costs and eliminates public nuisance issues in a totally effective, reliable and safe manner within the hostile operating environment of railways.

Embodiments of the invention described herein provide a way for the rail industry to achieve these objectives.

This work is dedicated to two great railroaders that the inventor was blessed to have met, namely the late Mr. Con Bach (ex-Canadian National Railways) and the late Mr. Edward C. Snell (ex-Jersey City Police Department).

Various embodiments of the invention have been described in detail. Since changes in and or additions to the above-described best mode may be made without departing from the nature, spirit or scope of the invention, the invention is not to be limited to those details but only by the appended claims. Section headings herein are provided as organizational cues. These headings shall not limit or characterize the invention set out in the appended claims.

What is claimed:

1. A fully gapless railway frog, comprising:

a slanted piston located in a flangeway adjacent to a frog point;

an actuating mechanism located below a quasi-horizontal railway frog plane;

aligned with the flangeway, and within a piston actuator unit which is itself within an alignment load-bearing cradle;

a riser arrangement providing vertical clearance underneath the quasi-horizontal railway frog plane; and a piston position locking mechanism, wherein the piston position locking mechanism disables the power source, brakes the drive shaft or isolates hydraulic supply lines when a lock status is required.

2. The railway frog of claim 1, wherein the actuating mechanism is driven by mechanical or hydraulic means.

3. The railway frog of claim 1, wherein power for actuation is provided either by an electric or a hydraulic motor.

4. The railway frog of claim 1, further comprising instrumentation or sensors for monitoring a variable piston configuration.

5. The railway frog of claim 1, further comprising slide-in slide-out positioning of the actuating mechanism relative to the alignment load-bearing cradle and removal of key riser elements comprising the riser arrangement.

6. The railway frog of claim 1, wherein the alignment load-bearing cradle provides a longitudinal restraint, secures the actuating mechanism to track structure such that the actuating mechanism is repositionable after reinsertion, and protectively encloses the actuating mechanism.

7. The railway frog of claim 1, wherein the slanted piston is slanted at an approximate angle of 45° relative to the quasi-horizontal railway frog plane.

8. The railway frog of claim 1, further comprising a lateral stiffener supporting the slanted piston.

9. The railway frog of claim 1, further comprising a piston position lower indexer connected to a back end of the piston with an indexing connecting rod that is parallel to the slanted piston.

10. The railway frog of claim 1, wherein the piston has facilitative grooves for sliding of the slanted piston.

11. The railway frog of claim 1, further comprising a drainage channel positioned under the slanted piston.

12. The railway frog of claim 1, further comprising a configuration management module where unit processing is done relative to the positioning, indexing and locking of the slanted piston.

13. The railway frog of claim 1, wherein the alignment load-bearing cradle is a protective encasing for the actuating mechanism and the piston actuator unit.

14. A fully gapless railway diamond, comprising: four railway frogs, each further comprising:

a slanted piston located in a flangeway adjacent to a frog point;

an actuating mechanism located below a quasi-horizontal railway frog plane and within a piston actuator unit which is itself within an alignment load-bearing cradle; and a riser arrangement that provides vertical clearance underneath the railway frog;

an interface with rail traffic control equipment for automated operation; and a wayside control panel for manual operation.

15. A method for piston positioning relative to a top of rail elevation of a railway diamond comprising an interface with rail traffic control equipment for automated operation; a wayside command panel for manual and maintenance operations; and four railway frogs, each further comprising of a slanted piston located in a flangeway adjacent to a frog point, an actuating mechanism located below a quasi-horizontal railway frog plane and aligned with the flangeway and within a piston actuator unit which is itself within an alignment load-bearing cradle, and a riser arrangement that provides vertical clearance underneath the railway frog; comprising the steps of:

activating, according to a pre-set operating protocol, at least one of the actuating mechanisms within each of the four frogs, to extend at least one of the slanted pistons into at least one of the flangeways to provide a continuous load-bearing running surface for rail traffic; and activating, according to a pre-set operating protocol, at least one of the actuating mechanisms within each of the four frogs, to retract at least one of the slanted pistons into at least one of the flangeways to provide a cleared active route.

16. The method of claim 15, wherein manual operation is effected as an emergency response to anomalous operation of the rail traffic control equipment.

17. The method of claim 15, further comprising the step of activating a maintenance and diagnostics mode for maintaining system availability and continuity of operations.

18. The method of claim 15, wherein the continuous load-bearing running surface for rail traffic is provided for railway lines at an intersection angle ranging from approximately 30° to 150°.

* * * * *